US011846479B2

(12) United States Patent
Foster et al.

(10) Patent No.: US 11,846,479 B2
(45) **Date of Patent: *Dec. 19, 2023**

(54) FIREARMS AND COMPONENTS THEREOF FEATURING ENHANCED BOLT LUG SHAPES

(71) Applicant: Ronald Andrew Foster, Boise, ID (US)

(72) Inventors: Ronald Andrew Foster, Boise, ID (US); Ronald C. Foster, Boise, ID (US); David Paul Schenker, Boise, ID (US); Patrick Edwin Johnston, Boise, ID (US)

(73) Assignee: Ronald Andrew Foster, Boise, ID (US)

( * ) Notice: Subject to any disclaimer, the term of this patent is extended or adjusted under 35 U.S.C. 154(b) by 124 days.

This patent is subject to a terminal disclaimer.

(21) Appl. No.: 17/321,488

(22) Filed: May 16, 2021

(65) Prior Publication Data

US 2022/0057162 A1 Feb. 24, 2022

Related U.S. Application Data

(63) Continuation-in-part of application No. 16/669,627, filed on Oct. 31, 2019, now abandoned, which is a (Continued)

(51) Int. Cl.
*F41A 3/22* (2006.01)
*F41A 21/48* (2006.01)
(Continued)

(52) U.S. Cl.
CPC ..... *F41A 21/482* (2013.01); *F41A 3/22* (2013.01); *F41A 3/30* (2013.01); *F41A 3/66* (2013.01)

(58) Field of Classification Search
CPC ..... F41A 3/22; F41A 3/30; F41A 3/66
See application file for complete search history.

(56) References Cited

U.S. PATENT DOCUMENTS 1,393,057 A 10/1921 Vollmer
2,425,684 A 8/1947 Patchett
(Continued)

FOREIGN PATENT DOCUMENTS

EP 2273228 A2 1/2011
GB 2207493 A 2/1989

*Primary Examiner* — J. Woodrow Eldred
(74) *Attorney, Agent, or Firm* — Pedersen & Company, PLLC; Ken J. Pedersen; Barbara S. Pedersen

(57) ABSTRACT

Firearms, and components of firearms, improve shooting accuracy and tolerance to debris/elements that may enter the receiver during use of the firearm in the field. The outer surface of the barrel and the receiver inner surface, and/or the bolt lugs and the receiver inner surface may feature tight-tolerance or press-fit mating, to enhance axial alignment for shooting accuracy. The bolt lugs may be configured to provide said tight-tolerance mating with the receiver when in the loaded and locked position, but may also be configured to provide space for accommodating debris/elements that enter the firearm so that bolt movement is not hindered by the debris/elements, and operation of the bolt, including cycling of the bolt in the firearm action when the shooter goes to load the next round, is smooth and consistent.

8 Claims, 49 Drawing Sheets

Related U.S. Application Data continuation of application No. 15/721,612, filed on Sep. 29, 2017, now Pat. No. 10,466,005, which is a continuation-in-part of application No. 15/047,569, filed on Feb. 18, 2016, now Pat. No. 10,132,579.

(60) Provisional application No. 62/488,802, filed on Apr. 23, 2017.

(51) Int. Cl.
*F41A 3/66* (2006.01)
*F41A 3/30* (2006.01)

(56) References Cited

U.S. PATENT DOCUMENTS

| | | | | |
|---|---|---|---|---|
| 3,889,574 | A | 6/1975 | Sanford | |
| 4,152,855 | A | 5/1979 | Dubiel et al. | |
| 4,547,988 | A | 10/1985 | Nilsson | |
| 4,655,118 | A | 4/1987 | Bruderer et al. | |
| 4,723,369 | A | 2/1988 | Badali | |
| 4,930,238 | A | 6/1990 | Poff | |
| 5,233,124 | A | 8/1993 | Peterson | |
| 5,926,988 | A | 7/1999 | Casull | |
| 6,000,161 | A | 12/1999 | Aalto | |
| 6,182,389 | B1 | 2/2001 | Lewis | |
| 6,209,249 | B1 | 4/2001 | Borden | |
| 7,219,461 | B1 | 5/2007 | Keeney et al. | |
| 7,975,417 | B2 | 7/2011 | Duplessis et al. | |
| 8,302,340 | B1 | 11/2012 | Irwin | |
| 8,375,616 | B2 | 2/2013 | Gomez et al. | |
| 8,701,326 | B2 | 4/2014 | Zonshine | |
| 8,782,939 | B2 | 7/2014 | Constant et al. | |
| 8,844,182 | B2 | 9/2014 | Ibarguren | |
| 8,925,230 | B2 | 1/2015 | Warburton et al. | |
| 9,010,009 | B2 | 4/2015 | Buxton | |
| 9,057,572 | B2 | 6/2015 | Matteson | |
| 9,151,553 | B2 | 10/2015 | Constant et al. | |
| 9,448,020 | B1 * | 9/2016 | Olson | F41A 3/66 |
| 9,851,167 | B2 | 12/2017 | Smith | |
| 10,132,579 | B2 | 11/2018 | Schenker et al. | |
| 10,466,005 | B2 | 11/2019 | Foster et al. | |
| 10,670,354 | B2 | 6/2020 | Schenker et al. | |
| 2007/0107290 | A1 | 5/2007 | Keeney et al. | |
| 2008/0092733 | A1 | 4/2008 | Leitner-Wise et al. | |
| 2012/0311908 | A1 | 12/2012 | Kenny et al. | |
| 2014/0075807 | A1 | 3/2014 | Lewis | |
| 2014/0115938 | A1 | 5/2014 | Jarboe | |
| 2014/0196347 | A1 | 7/2014 | Komatsu et al. | |
| 2016/0033226 | A1 | 2/2016 | Potter et al. | |
| 2016/0054096 | A1 | 2/2016 | Dzwill | |
| 2016/0252314 | A1 | 9/2016 | Mather | |
| 2018/0128567 | A1 | 5/2018 | Foster et al. | |
| 2020/0309477 | A1 * | 10/2020 | Bennink | F41A 21/10 |

* cited by examiner

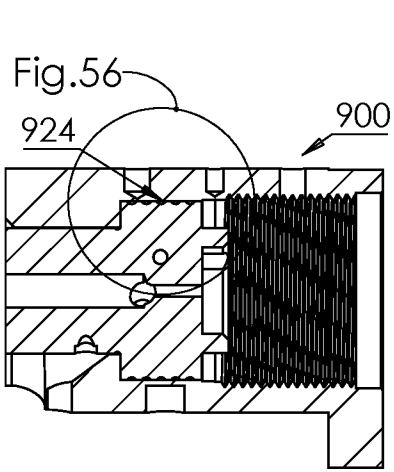
Fig.56
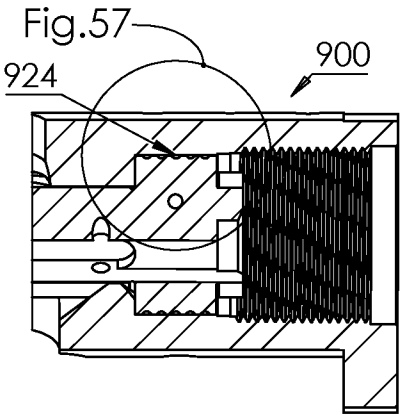
Fig.57
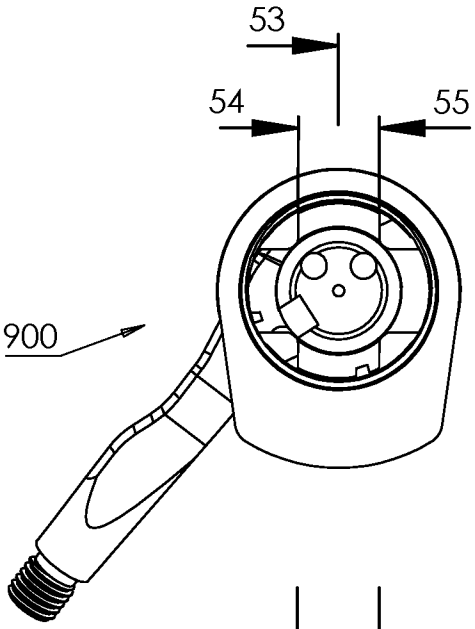
Fig.52
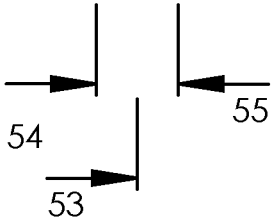
Fig.53
Fig.54
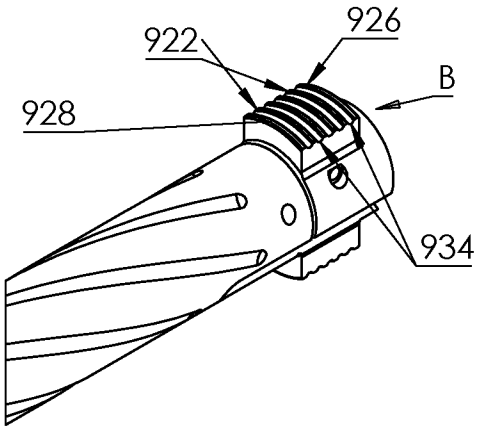
Fig.51
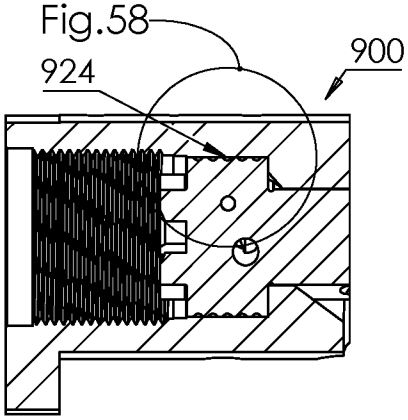
Fig.58
Fig.55

FIREARMS AND COMPONENTS THEREOF FEATURING ENHANCED BOLT LUG SHAPES

This application is a continuation-in-part of Non-Provisional application Ser. No. 16/669,627, filed Oct. 31, 2019 and entitled "FIREARMS AND COMPONENTS THEREOF, FOR ENHANCED AXIAL ALIGNMENT OF BARREL WITH ACTION", which is incorporated herein in its entirety by this reference and which is a continuation of Non-Provisional application Ser. No. 15/721,612, filed Sep. 29, 2017, and issuing on Nov. 5, 2019 as U.S. Pat. No. 10,466,005, which claims benefit of Provisional Application Ser. No. 62/488,802, filed Apr. 23, 2017, entitled "Firearms and Components thereof, for Enhanced Axial Alignment of Barrel with Action", which Non-Provisional and Provisional Applications are incorporated herein in their entirety by this reference, and wherein Non-Provisional application Ser. No. 15/721,612 is a continuation-in-part application of Non-Provisional application Ser. No. 15/047,569, filed Feb. 18, 2016, and entitled "Firearm with Locking Lug Bolt, and Components thereof, for Accurate Field Shooting", wherein Non-Provisional Application Ser. No. 15/047,569 is also incorporated herein in its entirety by this reference.

BACKGROUND

Field of the Invention

This invention relates generally to firearms, and especially firearms with a barrel directly connected to the receiver of the firearm action, and to firearms having disconnectable and/or interchangeable barrels. More particularly, this invention relates to improvements in coaxial alignment of components of such a firearm. This invention may also relate to improvements in limiting the effect of rain, water, freezing water, snow, ice, dirt, vegetation, and/or other elements entering the firearm in a field environment, for example, during target shooting, hunting, or combat in inclement, uncontrolled, unclean, or other un-pristine environments.

Background/Related Art

Firearms having an action comprising a bolt with locking lugs are well-known and may feature different types of bolt actuation, for example, bolt-handle action, lever action, pump action, automatic action, and semi-automatic action. Conventionally, there has been a compromise in the design of such firearms between accuracy and tolerance to elements that may enter and interfere with the firearm action. A key to accuracy is to have the bullet travel straight down the firearm barrel and exit the muzzle pointing the same direction the barrel was pointed when the trigger was pulled. One or more misalignments may be responsible for inaccuracy in bullet travel, for example, misalignment of the cartridge in the chamber, misalignment of the barrel bore relative to the bolt and/or receiver, and/or axial-misalignment of threads or other connection means ("barrel connection means" or "barrel-receiver connection means"), or an inaccurately-cut radial receiver face for connection of the barrel to the receiver by said threads or other connection means.

A compromise in rifle design typically makes a rifle either more usable and tolerant to dirt and weather but not as accurate (a "field rifle"), or more accurate but less usable in the field (a "benchrest rifle"). In field rifles, a combination of multiple of the above-mentioned misalignments, for example, tends to create an inaccurate firearm, as conventional field firearms are made with loose tolerances to allow movement and cycling of the action in spite of interference by elements present in outdoor or other non-controlled/non-clean environments. Field rifles therefore have relatively loose tolerances between moving components, because loose tolerances allow ice and dirt to be present, without limiting operability of the action, and also permit less expensive manufacture. Field rifles, with relatively thin components and barrels, are also much lighter for being carried about in rough field terrain.

Conventional benchrest rifles, on the other hand, have such tight tolerances that they don't work well with dirt and weather encountered in the field and require frequent cleaning after only one or a few rounds are fired, but they are consistently more accurate. The components of benchrest rifles are built heavier than field rifles, to resist flexing that causes harmonic vibrations. For example, benchrest rifles are built with heavy barrels to reduce the "barrel whip", when the round is fired, that can cause inaccuracy. Benchrest rifles are usually impractical in the field due to their weight.

The patent literature illustrates attempts to increase accuracy of bolt-action firearms. U.S. Pat. No. 6,209,249 Borden discloses a bolt for a firearm with increased accuracy. The bolt body has front and rear exterior bosses with diameters slightly larger than the rest of the bolt body, resulting in a tighter tolerance between portions of the bolt and the bolt runway in the regions of the bosses. U.S. Pat. No. 7,975,417 Duplessis et al. discloses joining a barrel to the receiver of a bolt-action rifle with a threaded insert. The Duplessis, et al. threaded insert may be considered a separate, trunnion piece that helps set the rifle headspace, to offset/account for barrel machining error, and that helps with barrel interchangeability.

Custom rifle manufacturers have made some improvements, or have pushed the boundaries of turning a conventional field rifle into a more accurate long-range rifle, by reducing the tolerances between the bolt body and the bolt bore of the receiver of the rifle thereby reducing bolt and cartridge misalignment. Instead of the approximately 0.015 (fifteen thousandths) inch clearance between the bolt and the receiver in many field rifles of the past, these custom manufacturers often make the clearance approximately 0.005 (five thousandths) inch. Reducing this clearance makes the bolt better aligned with the receiver. This compromise, however, makes the rifle action more susceptible than a field rifle to binding and blockage from outdoor interferences such as dirt and ice, and makes the rifle still not as accurate as a benchrest gun that often has approximately 0.0005 (five ten-thousandths) inch clearance.

A BORDEN™ rifle action has very tight tolerances between the receiver and the bolt bosses that are behind the bolt lugs, specifically, approximately 0.0005 (five ten-thousandths) inch, starting from when the bolt starts to enter lock up (the beginning of the rotation), all through the approximate 90 degree rotational turn into the "locked-up" (also, "battery") position. The bolt bosses are what have been called "BORDEN™ bumps", which are in the bolt body and lying behind (proximal to) the bolt lugs and in front of (distal to) the bolt handle. These bosses have a larger maximum diameter than the bolt body, serving the purpose of reducing clearance between the bolt and the receiver bore in the location of the bosses. Such bosses, however, are behind (proximal to) the bolt lugs, and are susceptible to binding and blockage when outdoor interferences such as dirt and ice enter between the bolt bosses and the receiver bore. Thus, the BORDEN design relies on precise manufacture of the portions of the bolt main body and the receiver that are behind (proximal to) the bolt lugs and behind (proximal to) the lug abutments/stops, respectively. That is, the BORDEN design relies on precise manufacture of structure/surfaces that are separate, and distant, from the bolt lugs, bolt distal face, and the barrel threaded connection to the receiver.

Therefore, there is still a need to provide greater shooting accuracy in a "field-capable" firearm, including but not necessarily limited to those with an action comprising a bolt with locking lugs. An object of certain embodiments is to improve axial alignment of multiple of a bolt, cartridge, receiver, and barrel, for increased shooting accuracy. Especially-preferred embodiments improve axial alignment of the barrel and receiver of a field-capable firearm, including barrels permanently, detachably, replaceably, and/or interchangably connected to the receiver by threads and/or other connectors/connection-means. Said improved axial alignment may be done by specially-adapting one or more regions of the distal end of the receiver, and one or more regions of the barrel where the barrel connects to the distal end of the receiver. This may be done by providing specially-adapted axial-mating surface(s) on each of the receiver and the barrel. An object of certain embodiments is to accomplish said improved axial alignment of the receiver and barrel while having an axial-mating surface of the barrel mate with an axial-mating surface of the receiver that is the "same surface" with which bolt lugs mate when the lugs. For example, adjacent portions of the same surface formed in a single machining step may be used for mating of a bolt lug in the locked position with the receiver, and for mating of a barrel with the receiver.

An object of certain embodiments is to achieve said improved axial alignment while also achieving consistent operability in the adverse conditions experienced in field environments. An object of certain embodiments is to provide a firearm that shoots with near-benchrest accuracy, but that tolerates build-up of dirt, ice, water, or other interfering elements on moving parts, without undue binding or blockage and the resulting excessive mechanical failure of the moving parts. An object of certain embodiments is to accomplish said tolerance of interfering elements by means of the lug having a debris-cleaning/scraping capability. An object of certain embodiments is to achieve said improved axial alignment by means and methods that also reduce machining steps and also reduce or eliminate hand-tooling and customizing of the shape and length of each rifle barrel firing chamber/head-space. An object of certain embodiments is to provide a field-capable firearm that is accurate in spite of imperfections in the firing chamber/headspace shape or surfaces and in the cartridge casings, and/or the imperfections from fouling of the firing chamber/headspace surfaces that are intended to align the distal shoulder of the casing. Certain embodiments of the invention meet or exceed one or more of these objects, as will be further understood from the following discussion.

SUMMARY

Components of a firearm are adapted for improved accuracy. At least one adaptation in the components for improving accuracy provides increased coaxial alignment between two or more of: a bolt, a cartridge, a receiver, and/or a barrel of a firearm, for example, including both firearms typically considered field firearms or firearms typically considered benchrest firearms.

Said at least one adaptation may comprise one or more axial mating surfaces on the barrel, for example, one or more an axially-extending, circumferential, non-threaded surfaces of the barrel. Said at least one adaptation may comprise one or more receiver axial mating inner surfaces, for example, one or more axially-extending, circumferential, non-threaded surfaces of the receiver cooperating with, to be in a close-tolerance-mating/press-fit relationship with, the barrel axial mating surfaces. The preferred axial mating surface(s) of the barrel may be selected from the group of an axial mating surface that: is proximal of barrel connection threads or other barrel connection means, distal of barrel connection threads or other barrel connection means, and/or in-between sections of barrel connection threads or other barrel connection means. The preferred receiver axial mating surface(s) may be selected from the group of an axial mating surface that is: proximal of receiver threads or other connection means located in the receiver, distal of receiver threads or other connection means located in the receiver, and/or in-between sections of connection threads or other connection means located in the receiver.

Conventional barrel connection threads or other connection means are important, for example, for retaining the barrel on the receiver until purposely disconnected and/or interchanged with another barrel. Said threads or other connection means are typically substantially for preventing axially-directed forces during shooting from forcing the barrel axially away from the receiver. On the other hand, in certain embodiments of the present invention, said axial mating surfaces are primarily or entirely for ensuring axial alignment of the barrel with the receiver during shooting. Thus, there may be one, two, or more of the axial mating surfaces on the barrel, and, if multiple, they may be spaced apart along a length of the barrel including on opposite sides/ends of threads or other connection-means. Thus, there may be one, two, or more cooperating axial mating surfaces in or on the receiver, and, if multiple, they may be spaced apart along a length of the receiver including on opposite sides/ends of threads or other connection-means.

One or more of the barrel axial mating surfaces may be provided on portion(s) of the barrel that are received inside the receiver upon connection of the barrel to the receiver. In certain embodiments, the placement of axial mating surfaces may result in tight-tolerance/press-fit axial mating at a location in the range of ¾-2 inches, or 1-1.5 inches for example, inside the distal end of the receiver, and/or at a location close to the distal extremity of the receiver such as inside the receiver in the range of ⅛ inch up to 0.99 inch, ⅛ inch up to ½ inch, or ¼ up to ½ inch, from the distal extremity of the receiver. For example, one of said barrel axial mating surfaces may be provided by a proximal extension on the barrel that mates, around at least a portion of the circumference of the barrel, with at least a portion of the inner surface of the receiver. This may be done by providing an axial, non-threaded extension that protrudes proximally beyond the threaded region, or other connection means, of the barrel, to mate with the axial, receiver inner surface. For example, also, or instead, of the proximal extension, one of said axial mating surfaces may be provided on the barrel distal of the threads or other connection means, including at or very close to the distal extremity of the receiver inner surface.

In firearms with a rotating and locking-lug bolt, the axial receiver inner surface that the axial non-threaded extension mates with may be a portion of the same inner surface with which the lugs mate when locked. Thus, said mating of the non-threaded extension results in significantly more precise and exact coaxial alignment of the barrel bore with the receiver bore/boltway and with the locked bolt, compared to the misalignment caused by the mandatory thread clearances in a threaded barrel connection.

In certain embodiments, therefore, a single surface provides ramps/surfaces both for mating with bolt lugs only during lock-up, and for mating with portions of the axial mating surface of a proximal barrel extension. This single surface is at least a portion of the receiver inner surface forward (distal) of the lug stops and rearward (proximal) of the receiver threads. For example, when the receiver inner surface is ramped from the lug stops to the threads of the receiver, then the bolt lugs mate with proximal regions of the ramp crests, and the barrel extension mates with distal regions of the same crests, which is an example of the barrel extension mating with "the same surface" with which the lugs mate in the locked position. Said mating of the lugs and the proximal barrel extension with the same surface, and the distal location of said same surface in the action, simplifies and/or makes more accurate and precise, the machining step(s) for the firearm action.

Alternatively, when the receiver inner surface is ramped near the lug stops, but is another shape near the receiver threads, then the bolt lugs mate with the crests near the lug stops, and the axial mating surface of the barrel extension mates with one or more regions of, or the entire, said another shape near the receiver threads, for example, a cylindrical region of the receiver inner surface. Thus, it is preferred that troughs are provided in the receiver inner surface near the lug stops, to provide more clearance for debris entering the receiver that might otherwise interfere with the rotating bolt, but said debris-receiving troughs are not necessarily required where the installed barrel extension resides, because it does not move during operation, and debris at the installed barrel is not a significant concern.

Certain embodiments of the bolt lugs outermost surfaces may additionally or instead comprise axial curvature, and/or other axial non-linearity, for reducing the surface area of said outermost surfaces that mates with the receiver inner surface in the locked position. Said reduction of the surface area of the outermost surfaces of the lugs that mates with the receiver inner surface limits the effect of rain, water, freezing water, snow, ice, dirt, vegetation, and/or other elements entering the firearm in a field environment, for example, during target shooting, hunting, or combat in inclement, uncontrolled, unclean, or other un-pristine environments. Said axial curvature or non-linearity provides at least one region of maximum lug diameter and at least one region of lug diameter that is smaller compared to said maximum lug diameter.

In the case of axial curvature, certain embodiments feature the outermost surface of each lug curving in an axial direction between a single maximum lug diameter and one or more end edges that are reduced in diameter; this places the maximum lug diameter region relatively close to the receiver inner surface, and the rest of the outermost surface of each lug relatively distant from the receiver inner surface. These embodiments may be described as being convex in the axial direction.

Other examples of non-linearity are concavity, or ridges and recesses, in said outermost surfaces. For example, certain embodiments feature the outermost surface of each lug curving concavely in the axial direction, thus having two maximum/enlarged diameter regions, one at or near each of the proximal and distal end edges of the outermost surface, and a minimum diameter between said proximal and distal end edges. Thus, in the loaded and locked condition, this concave shape provides two maximum/enlarged lug diameter regions (at or near the two end edges) close to the receiver inner surface, and the rest of the outermost surface of each lug (the central region) relatively distant from the receiver inner surface. Alternatively, for example, certain embodiments feature the outermost surface of each lug having multiple maximum diameter regions and also multiple reduced diameter regions, created by ridges and recesses extending across the outermost surface. The ridges and recesses may extend across the outermost surface at various angles to the longitudinal axis of the bolt, preferably "substantially transverse" angles meaning greater than 45 degrees (46-90 degrees) to the bolt longitudinal axis. Preferably, the ridges and recesses extend across the outermost surface at 60 up to 90 degrees to the longitudinal axis of the bolt.

Having the maximum and minimum diameters in the convex, concave, and ridge and recess embodiments extend transversely, or substantially transverse, to the longitudinal axis of the bolt, allows environmental elements that may be on the bolt lug outermost surface and/or in the receiver, to move into the smaller-diameter/recessed region(s) of the lug outermost surface and slide circumferentially in/along those smaller-diameter/recess region(s) throughout bolt rotation, thus, minimizing resistance to bolt rotation and jamming of the bolt. Thus, the elements residing in the smaller-diameter/recesses region(s) do not interfere with bolt rotation, or with mating of the maximum diameter region(s) of the outermost surface with the receiver inner surface. In other words, due to said axial curvature or other axial non-linearity, the elements tend to remain in the smaller-diameter/recesses regions, and the bolt may move distally and then rotate into the locked position with minimal or no interference by the elements.

Alternative embodiments of axial non-linearity of the outermost surfaces of the bolt lugs may comprise one or more protrusions provided on the outermost surface of each lug, said one or more protrusions representing the maximum diameter region(s) of the outermost surface. The protrusion(s) are sized and placed so that there are smaller-diameter regions of the outermost surface around/between the protrusion(s). The protrusion(s) mate(s) with the receiver inner surface in the bolt's locked position and said smaller-diameter regions catch/retain the elements to prevent the elements from interfering with bolt rotation or mating of the protrusion(s) of the outermost surface, for example, as discussed above for convex, concave, and ridge and recess embodiments.

Applicant has determined that certain embodiments of the axial non-linear bolt lugs that are beneficial for bolt rotation and mating, as described above, also enhance stability of the bolt when "out of battery", that is, when the bolt is pulled back to move the lugs proximal of the lug stops and into the rearmost position in the receiver interior space. In the out of battery position, if the bolt moves to an orientation wherein the longitudinal axis of the bolt is non-parallel to the longitudinal axis of the receiver (called herein "canting" or "tilting"), cycling of the bolt when the shooter proceeds to load the next round can be slower or less smooth. Preventing this canting/tilting of the bolt by stabilizing the out of battery bolt position to remain parallel to the receiver longitudinal axis, allows smoother cycling of the bolt forward in the receiver to its forwardmost loaded position.

Bolt stability in the "out of battery" position may be enhanced by placing the enlarged/maximum diameter region of the outermost surfaces at or near the distal end edge of each lug, and preferably also at or near the proximal end edge of each lug. This places bolt lug structure closer to the receiver inner surface behind (proximal) of the lug stops, thus minimizing or preventing canting/tilting of the distal end of the bolt from the receiver longitudinal axis. If, instead, the smaller-diameter/recessed regions of the lugs were placed at or near the distal and proximal end edges (and especially distal end edge), space would exist between the smaller-diameter region at the distal end edge and the receiver inner surface behind the lug stops, which could allow in certain embodiments the distal end of the bolt to cant/tilt away from the receiver longitudinal axis. Therefore, preferred embodiments having concavity, ridges, or protrusions place enlarged/maximum diameters at or near the end edges of the lug outermost surface, tend to keep the bolt from canting/tilting when in said rearmost position and when being pushed distally toward and through the lug stops, hence stabilizing the bolt during cycling of the bolt.

Summarily, certain embodiments align two or more, or all, of a bolt, receiver, and barrel of the firearm in a coaxial and concentric configuration, for example, by providing surfaces of extremely tight tolerances in the receiver for mating with one or more axial mating surfaces, or portions of one or more axial mating surfaces, of the barrel and/or with the locked lugs. Even when such extremely tight tolerances are provided for locked lugs against the receiver inner surface, looser tolerances, preferably in the form of smaller diameter regions/recesses, may be provided for certain portions of the bolt lugs to allow space/room for environmental elements, so that during axial travel and bolt rotation, interference by the environmental elements is minimized or eliminated and field operability is enhanced. Placing enlarged/maximum diameter regions, and not the smaller diameter regions, of the lug outermost surface at or near distal end, and preferably also at or near the proximal end, of each lug serves to stabilize the lugs and hence the bolt in the receiver throughout the cycling of the bolt.

BRIEF DESCRIPTION OF THE DRAWINGS

FIG. 51 is an isometric view of the distal portion of a bolt having bolt lugs adapted to have an axially non-linear outermost surface that is one embodiment having multiple ridges and multiple recesses between the ridges that extend circumferentially across the outermost surface, specifically, transverse relative to the longitudinal axis of the bolt.

FIG. 52 is a distal end view of an assembled receiver and the bolt of FIG. 51, adapted according to certain embodiments of the invention, wherein the axial-non-linearity creates space, when the bolt is in the distal, loaded position, between a smaller-diameter region of the outermost surface of the lug and the axial receiver inner surface, to hold/accommodate debris/elements that have entered the receiver from the environment and prevent debris/elements from interfering with bolt rotation or mating/alignment in the receiver.

FIG. 53 is a cross-sectional view of the distal portion of the receiver and bolt along the line 53-53 in FIG. 52.

FIG. 54 is a cross-sectional view of the distal portion of the receiver and bolt along the line 54-54 in FIG. 52.

FIG. 55 is a cross-sectional view of the distal portion of the receiver and bolt along the line 55-55 in FIG. 52.

DETAILED DESCRIPTION OF CERTAIN EMBODIMENTS

Figure 1:
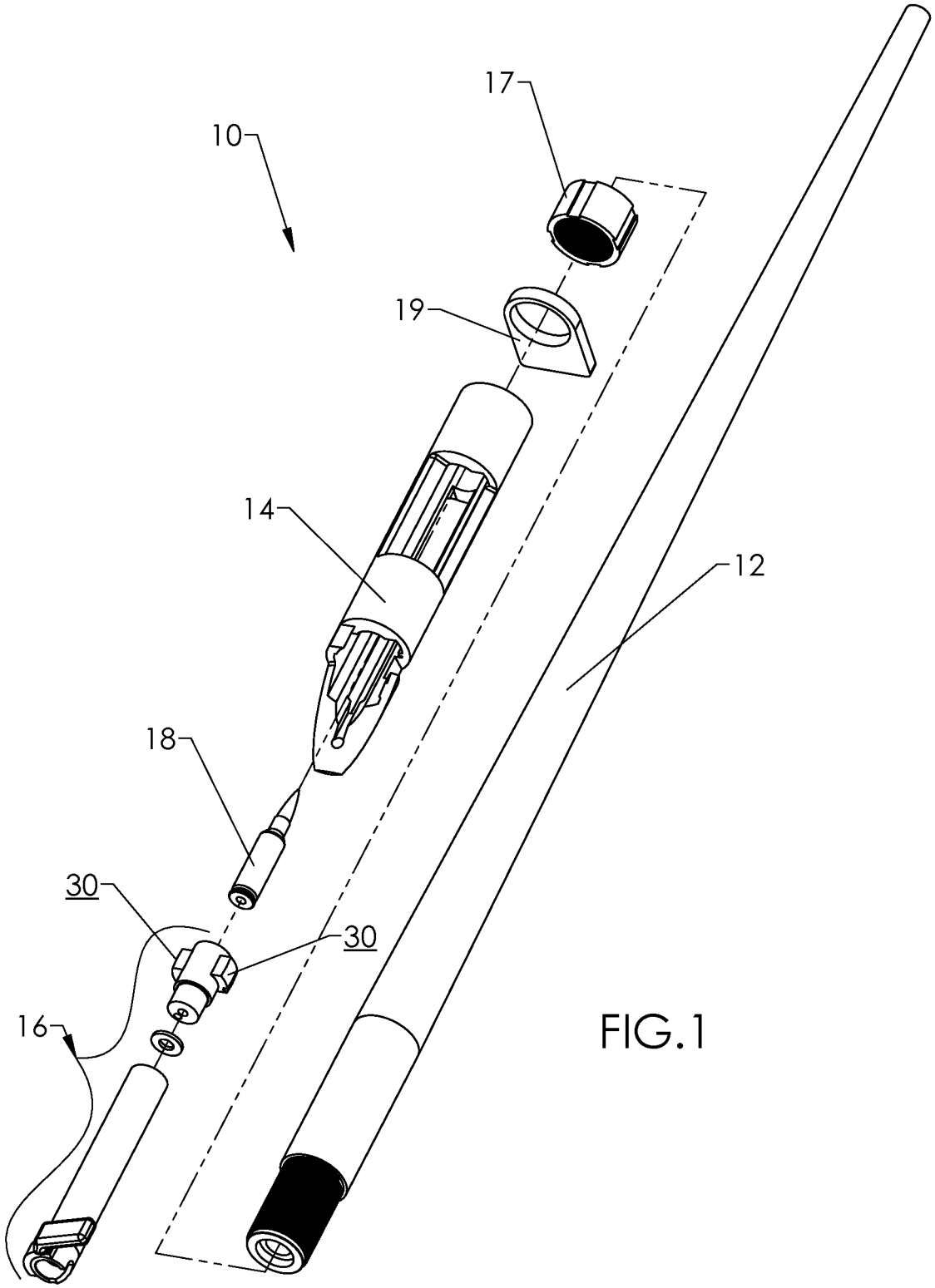
FIG. 1 is an exploded, proximal top perspective view of one embodiment of adapted bolt, receiver, and barrel components for a right-handed bolt action rifle, according to the disclosed technology.

Referring to the drawings, there are shown some, but not the only embodiments, of the invention. The figures portray a bolt-action firearm and components thereof, but other firearms may benefit from axial alignment created by one or more of the features/adaptations described herein. For example, the specially-adapted axial mating surfaces for axial alignment of a barrel connected to a receiver may apply to various actions, for example, bolt-handle action, lever action, pump action, automatic action, semi-automatic action, and/or break action. Further, the specially-adapted axial mating surfaces for coaxial alignment may apply to barrels and receivers connected by means other than threads, or connected by threads and also other means. For example, one or more cooperating axial mating surfaces for extremely tight tolerance/press-fit mating between portion(s) of the barrel and portion(s) of the inner surface of the receiver, may be used in combination with connection means comprising or consisting of: threads, continuous threads, interrupted threaded, bayonet(s), ramp or cam lug(s), threaded or clamping collars/nuts, and/or other detachable or permanent connectors/fasteners, and combinations thereof. Said connection means are for holding the barrel on the firearm prior to and during shooting of the firearm, for example, for preventing movement of the barrel away from the receiver in a direction parallel to the longitudinal axis of the barrel, for example, upon firing of the firearm. Said connection means will be understood by those of skill in the art, in view of this disclosure.

As illustrated by the exemplary embodiments of the Figures, certain embodiments of the disclosed technology have the bolt and barrel align in a coaxial and concentric configuration with the receiver, by being indexed off of the same distal, axial receiver surface, using very tight tolerances in certain regions and/or at certain times during operation, for improved shooting accuracy, while also using looser-tolerances in other regions and/or at certain times during operation, to allow for the debris and/or temperature variation of field environments.

In certain embodiments, non-threaded regions of axial surfaces of each of the receiver and the barrel mate, and a portion of the bolt lugs mate at certain time(s) during operation with another non-threaded region of the same axial surface of the receiver, to provide a coaxial and concentric configuration of all of the receiver, barrel, and bolt.

In U.S. Non-Provisional application Ser. No. 15/047,569, filed Feb. 18, 2016, incorporated hereby by reference, multiple adaptations are disclosed for obtaining coaxial-alignment of all of a bolt, bolt-face, bolt-lugs, receiver, cartridge, and barrel, in embodiments that also provide field-capability-enhancement. In certain embodiments of the present invention, all of the co-axial features and field-capability-enhancement described in Ser. No. 15/047,569 are preferred. Regarding the co-axial alignment, this is because the lack of any one of the co-axial features may result in a loss of accuracy, for example, due to excessive barrel whip when the gun is fired, or even incomplete/inconsistent closure of the bolt or the force of the firing pin and/or ejector spring of the firearm. Regarding field-capability, this is because a highly-accurate firearm that quickly is fouled by weather or debris may be undesirable. However, certain embodiments of the invention include one or more, but not necessarily all, of the co-axial alignment features, and/or one or more, but not necessarily all, of the field-capability-enhancement features. For example, certain embodiments may include a receiver and barrel(s) that comprise the axial mating enhancement feature(s) disclosed herein, but not any, or not all, of the bolt and lug enhancement features disclosed herein.

In many embodiments, aligning/indexing all rifle components that are critical for axial alignment of the cartridge and bullet (namely the barrel, bolt and receiver) off of one machined surface reduces inevitable machining error from aligning off of several different surfaces. Said one surface is preferably an interior, not-exactly-cylindrical surface of the receiver distal of the lug stops, in order to improve field operability. To accomplish said alignment/indexing, the outermost surfaces of the bolt lugs mate with a more proximal region of said one surface, while a proximal non-threaded extension (also called herein "tenon" or "tenon portion") of the barrel, and especially its outer circumferential axial mating surface, mates with a more distal region of said one surface. By providing coaxial alignment of components/surfaces very close to the location of the cartridge in the chamber, as in the preferred embodiments, the risk of machining error is reduced compared to the conventional technique of separate machining of different, distant surfaces to try to form good alignment in the rifle action.

Said mating of the barrel proximal tenon to said one surface significantly reduces "axial play" of the barrel relative to the receiver bore and the bolt distal face. This barrel connection may be contrasted to conventional connection of the barrel to the receiver by threads alone, wherein the necessary clearance in threads, to prevent binding when the barrel is screwed into the receiver, results in a lot of "axial play" of the barrel relative to the receiver bore and the bolt distal face.

In certain preferred embodiments, one or more additional, or one or more alternative axial surface(s), of the barrel is/are provided for extremely-tight tolerance/press-fit mating with portion(s) of the interior surface of the receiver. For example, a circumferential, axial mating surface such as portrayed in FIGS. 30 and 31 may be provided distal of the threads or other barrel connection means, either for supplementing the proximal tenon mating surface, or replacing the proximal tenon mating surface in which case the proximal tenon or the receiver could be modified to lessen or eliminate the tight-tolerance mating at the proximal-most extremity of the barrel.

Referring Specifically to the Drawings

FIGS. 1 through 25 illustrate embodiments featuring multiple of the preferred adaptations in the rifle action, according to the disclosed technology and according to Non-Provisional application Ser. No. 15/047,569 incorporated herein, for improved accuracy while maintaining weather-, dirt-, and ice-tolerance for acceptable field operation of the rifle. The embodiments in FIGS. 1-25 comprise all three of the preferred adaptations (that is, adaptation in the receiver, the bolt, and the barrel), because this is expected to provide the most superior shooting accuracy, but other embodiments may comprise one or more, but not all, of the adaptations, for example, one or two of the adaptations.

Figure 10:
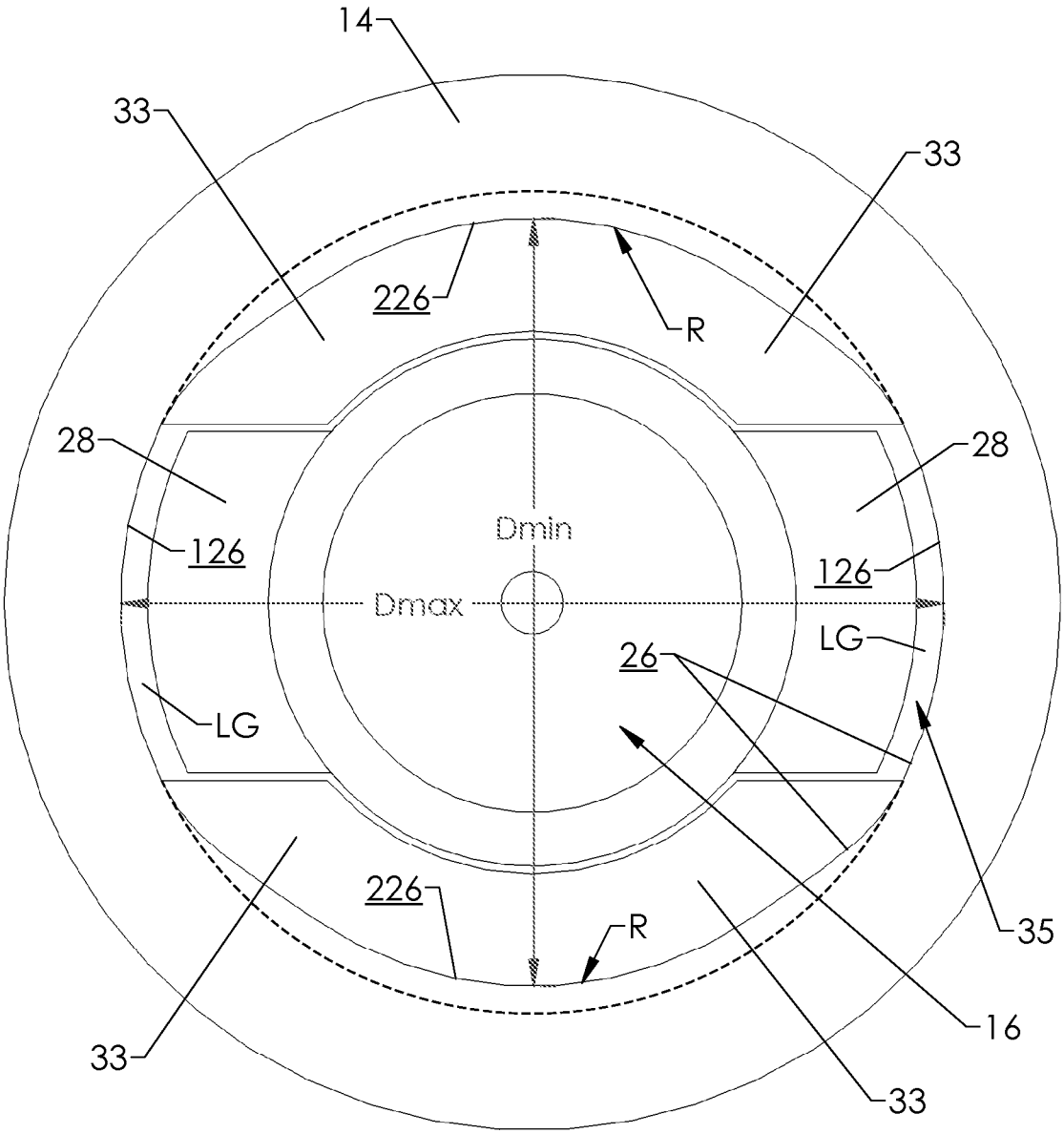
FIG. 10 is a schematic distal end view of the bolt pushed forward in the receiver to the loaded but unlocked position of FIGS. 2-9, wherein the lugs are distal of the lug stops in the lug rotation space, at/adjacent the troughs of the ramps (exaggerated for illustration) on the inner surface of the receiver, in a loose tolerance condition.
Figure 11A:
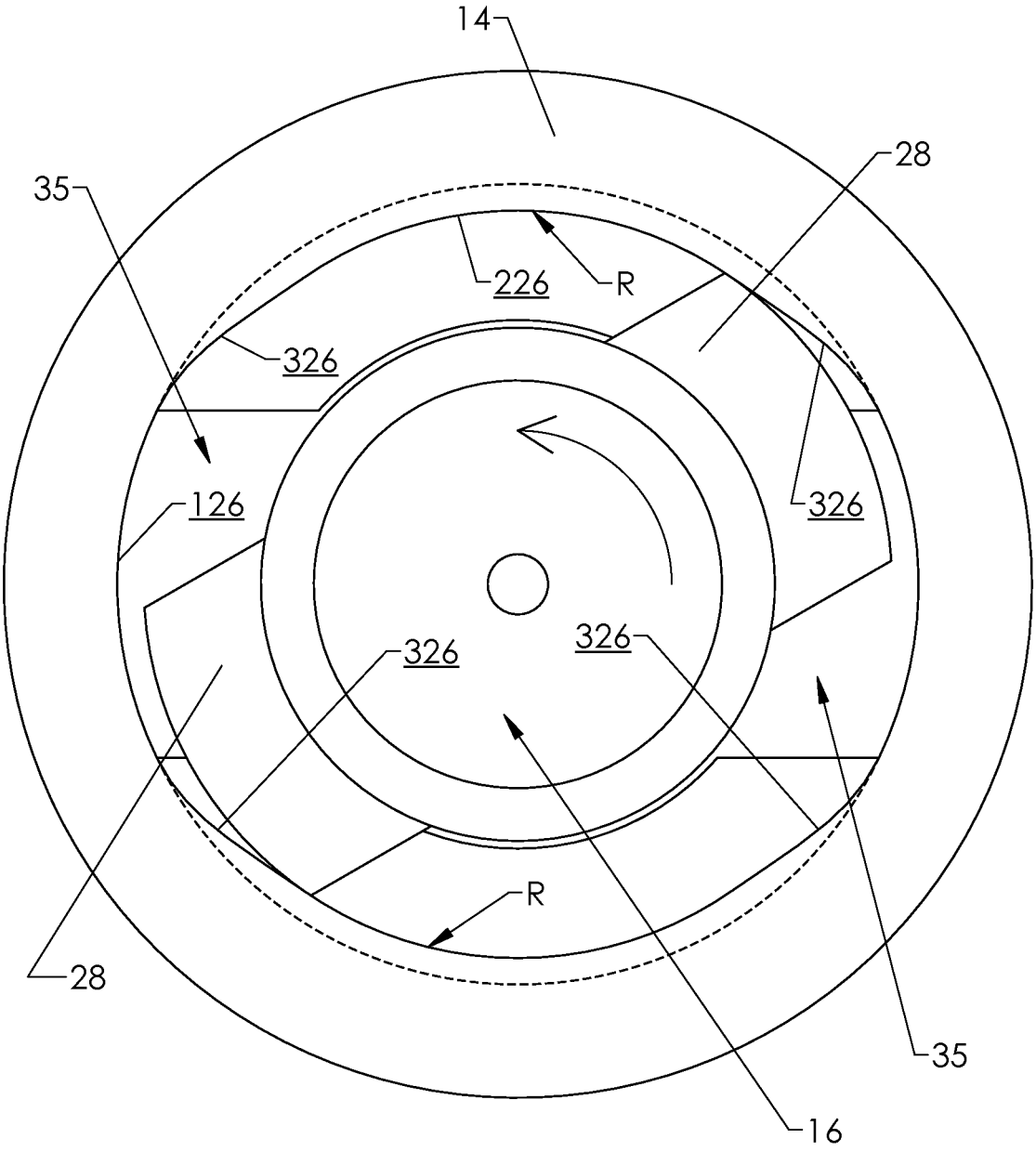
FIG. 11A is a schematic distal end view of the bolt of FIG. 10 being rotated counterclockwise, as in the right-handed action shown in FIGS. 1-9, wherein the outermost end surfaces of the lugs are beginning to slide along the ramps toward the crests of the ramps (the ramps being exaggerated for illustration).
Figure 21:
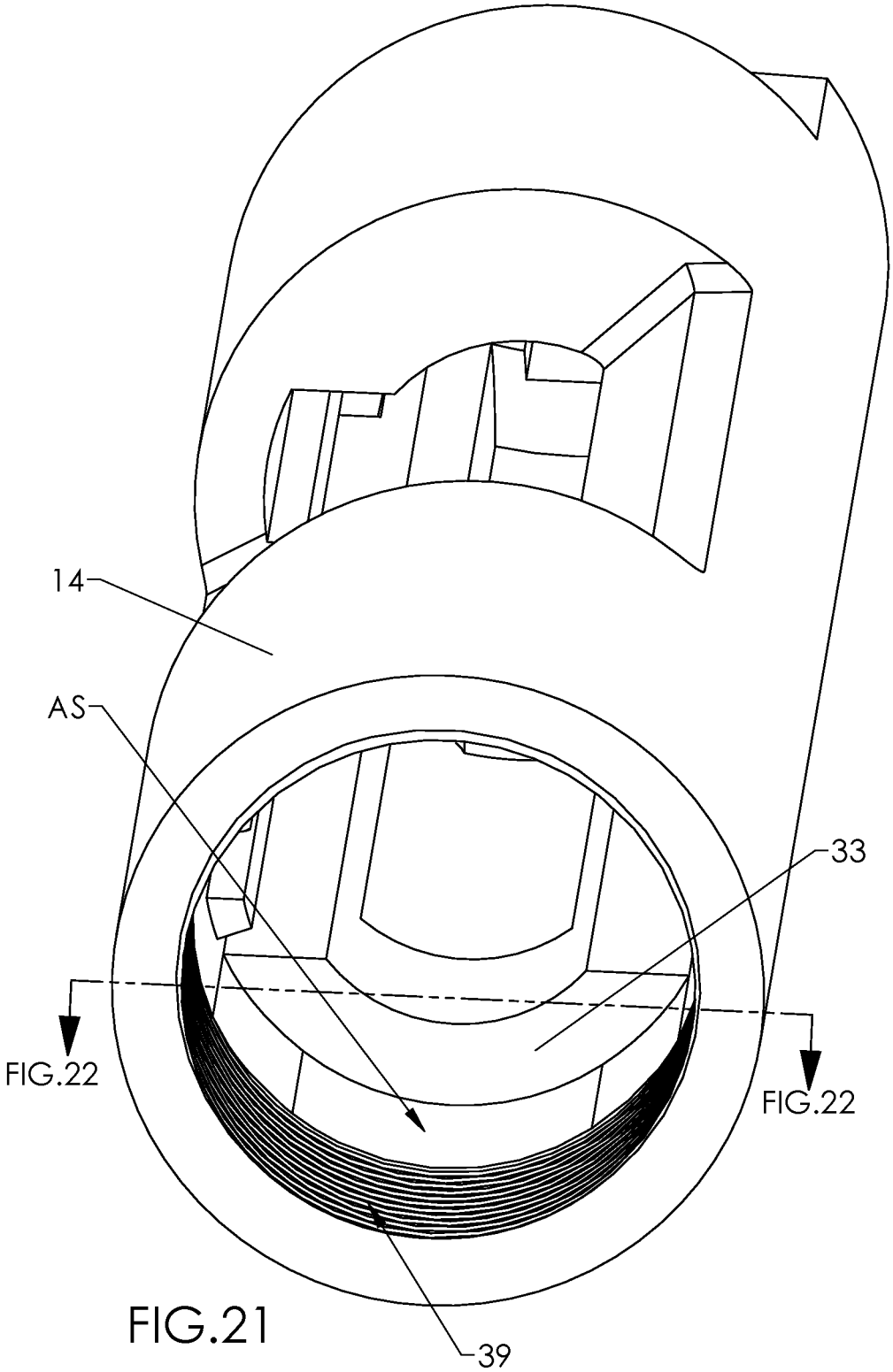
FIG. 21 is a distal end perspective view of the receiver of FIGS. 1-9, and 13-20, but wherein the bolt has been removed from the receiver.
Figure 22:
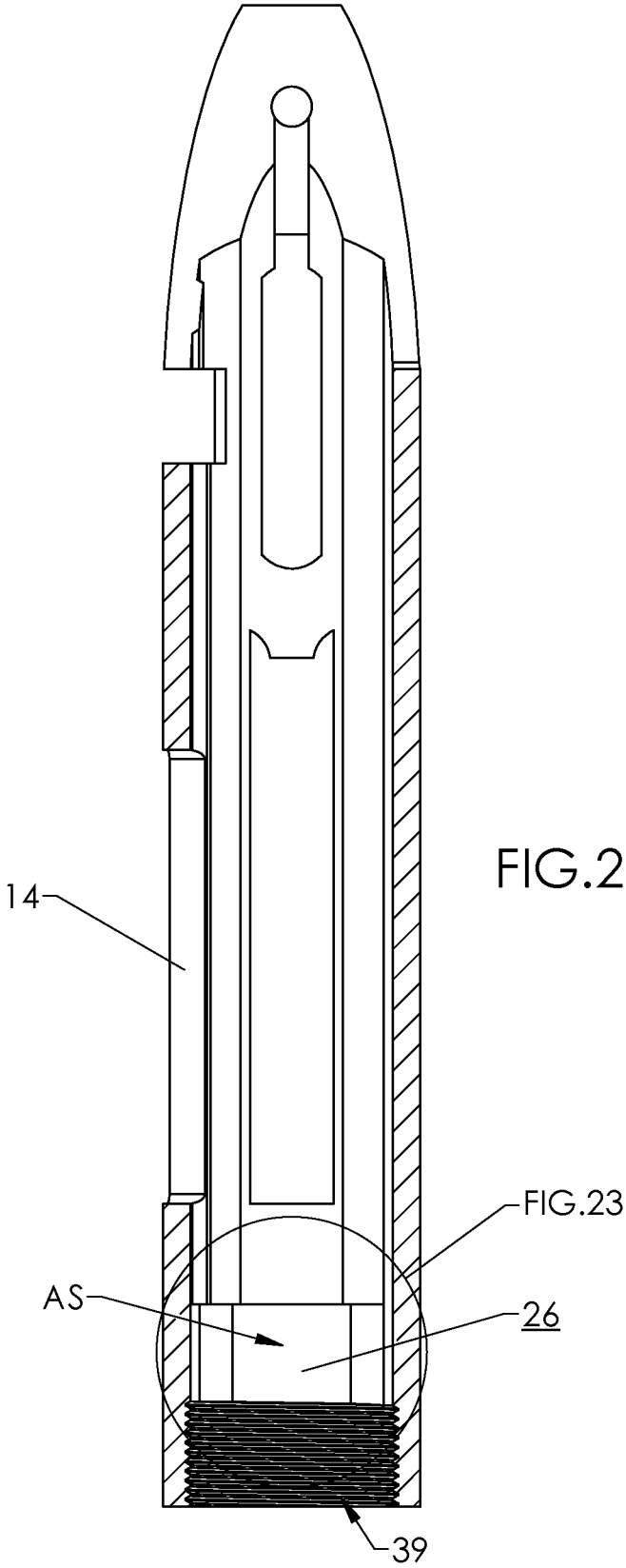
FIG. 22 is a cross-sectional view of the receiver of FIG. 21, viewed along the line 22-22 in FIG. 21.
Figure 23:
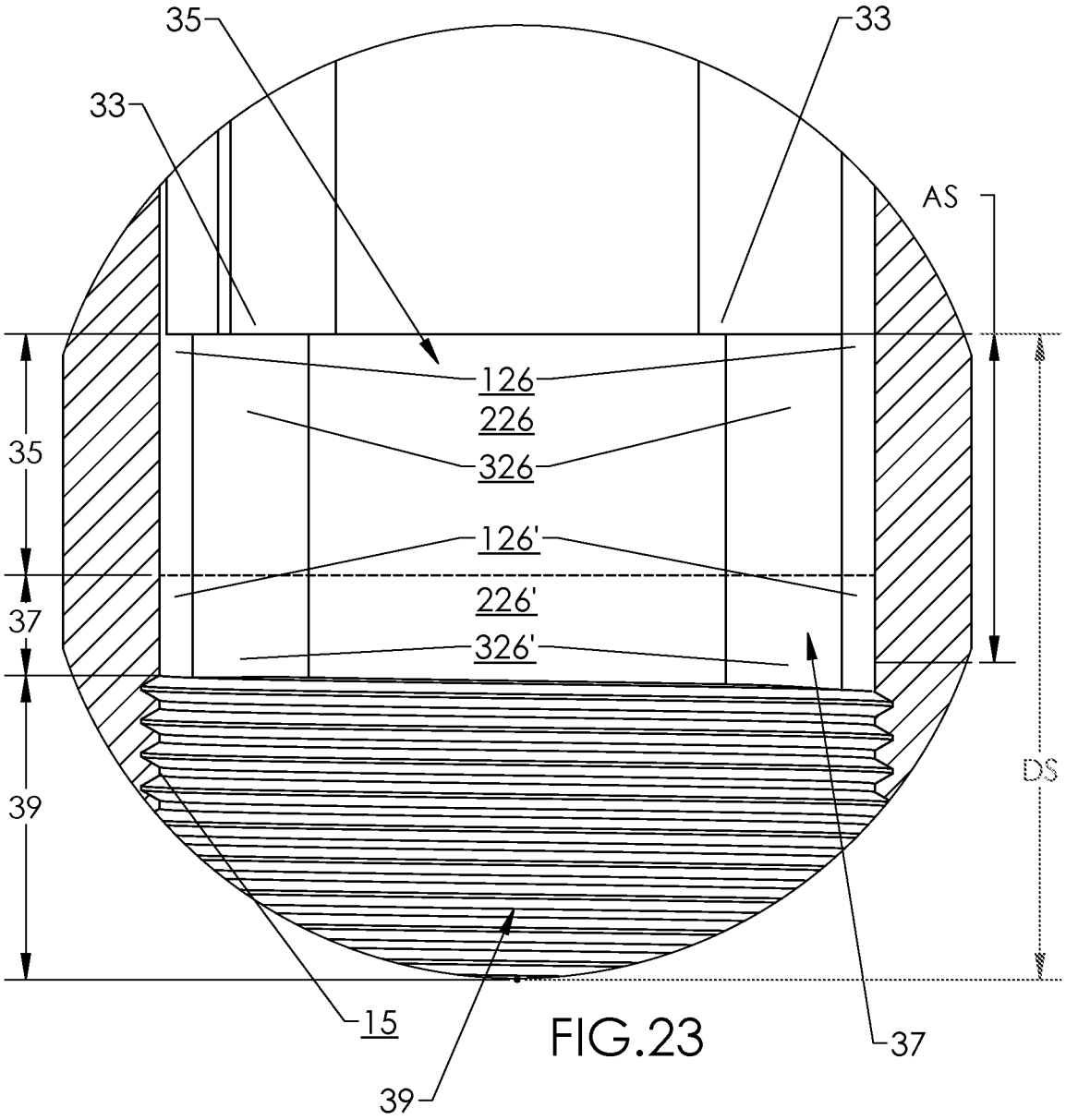
FIG. 23 is an enlarged detail view of the area circled in FIG. 22.
Figure 24:
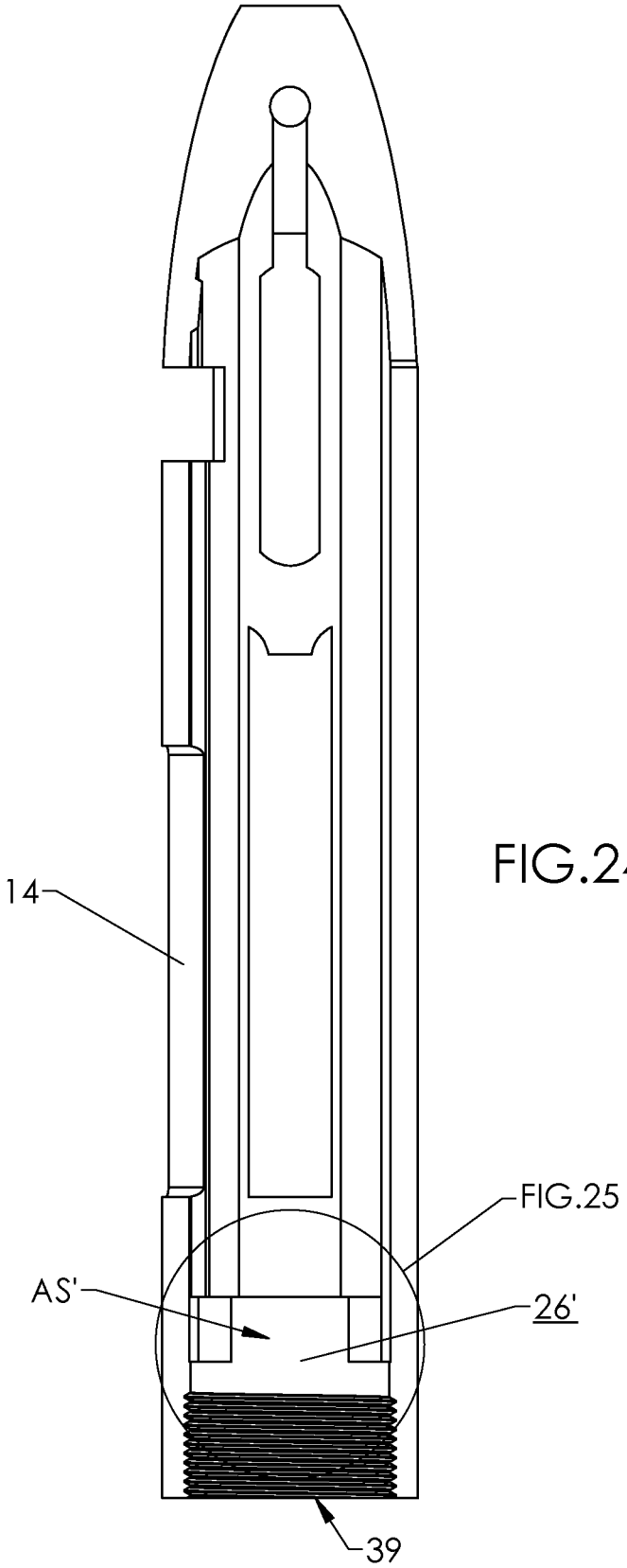
FIG. 24 is a cross-sectional view of the receiver of FIGS. 1-9, and 13-20, showing an alternative receiver distal inner surface curvature.
Figure 25:
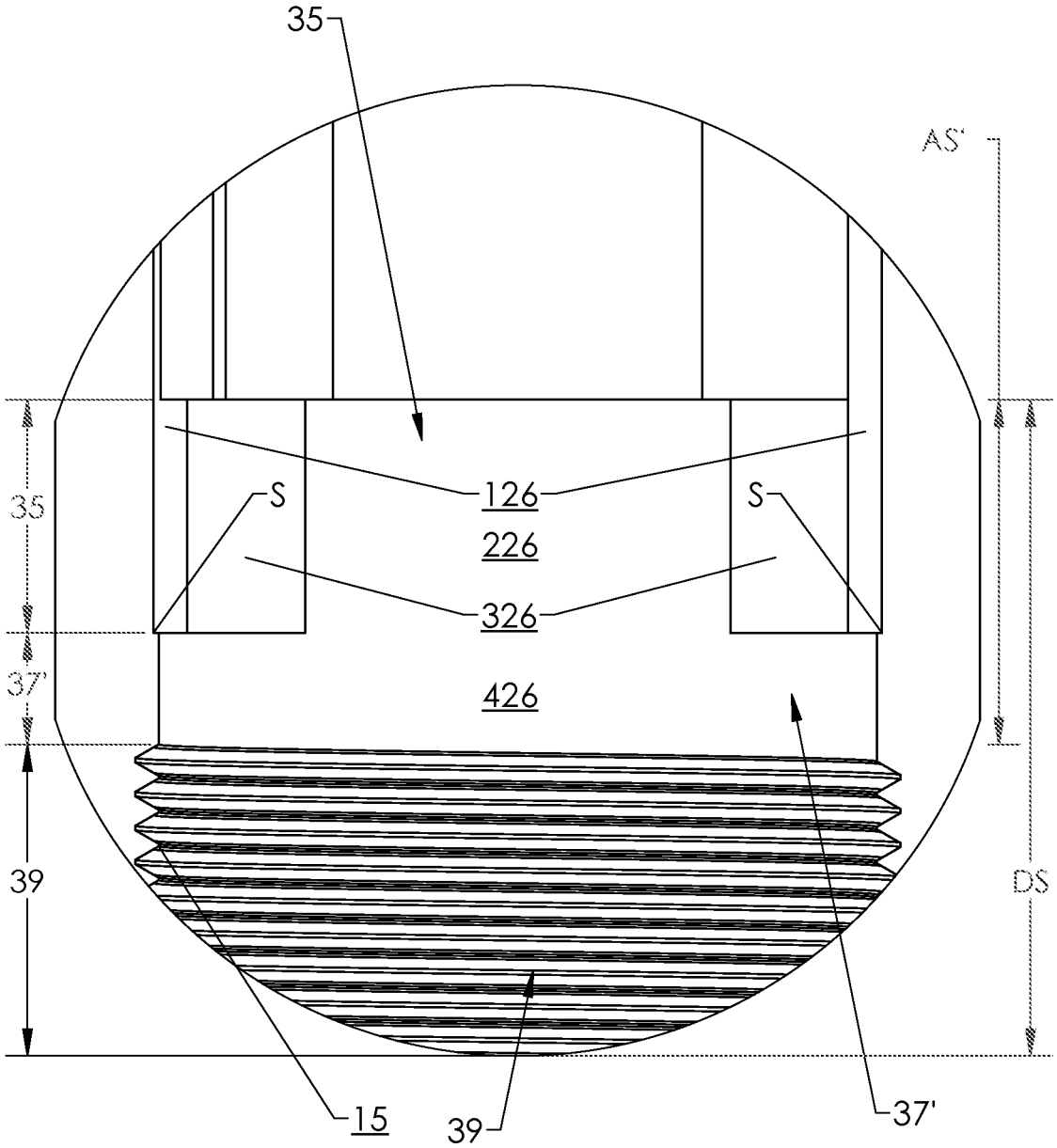
FIG. 25 is an enlarged detail view of the area circled in FIG. 24.
Figure 26:
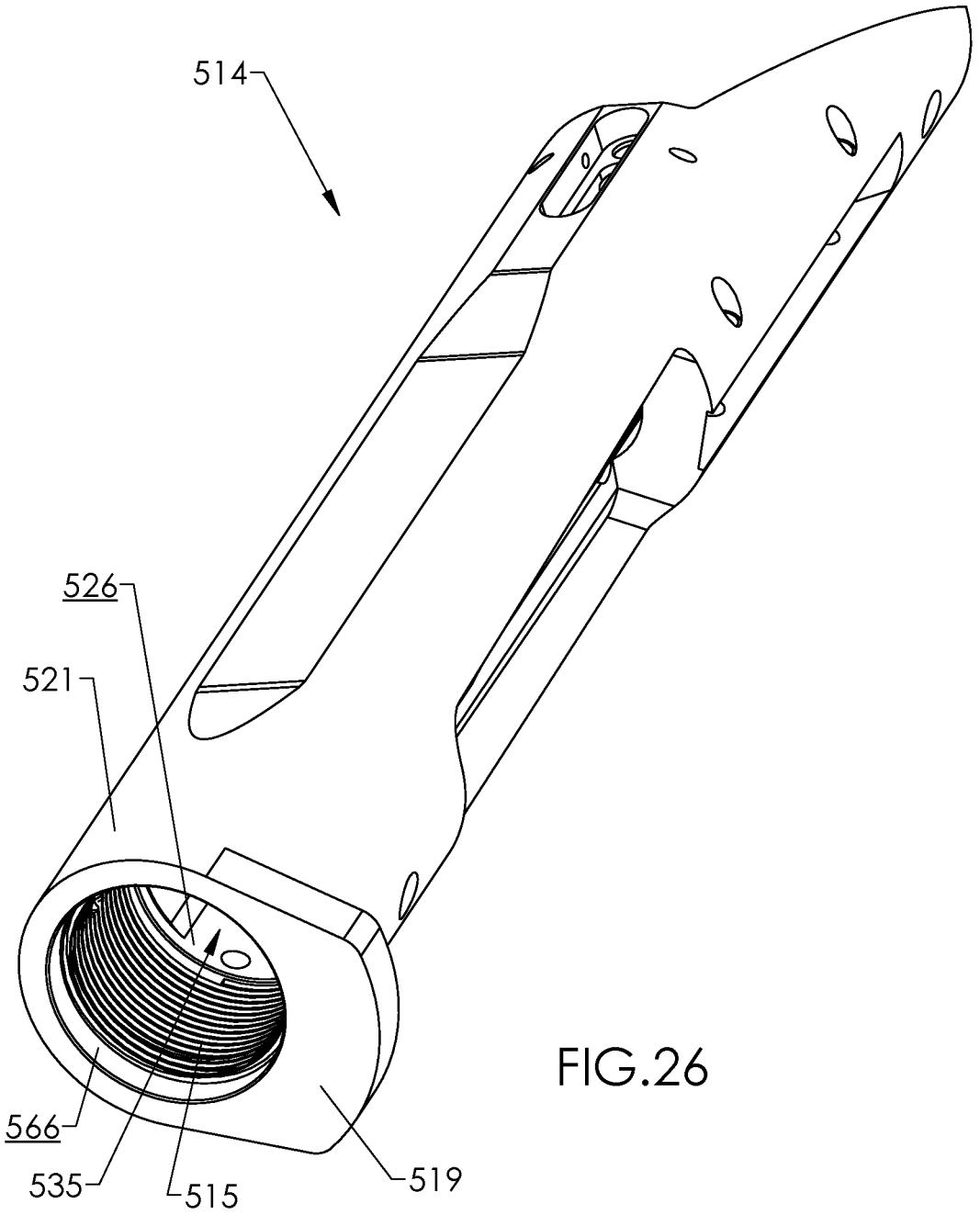
FIG. 26 is a distal end perspective view of an alternative receiver having a threaded barrel connection means and having two axial mating surfaces on its inner surface near the distal end, which are adapted for extremely-tight-tolerance/press-fit axial mating with two axial mating surfaces of a firearm barrel.
Figure 27:
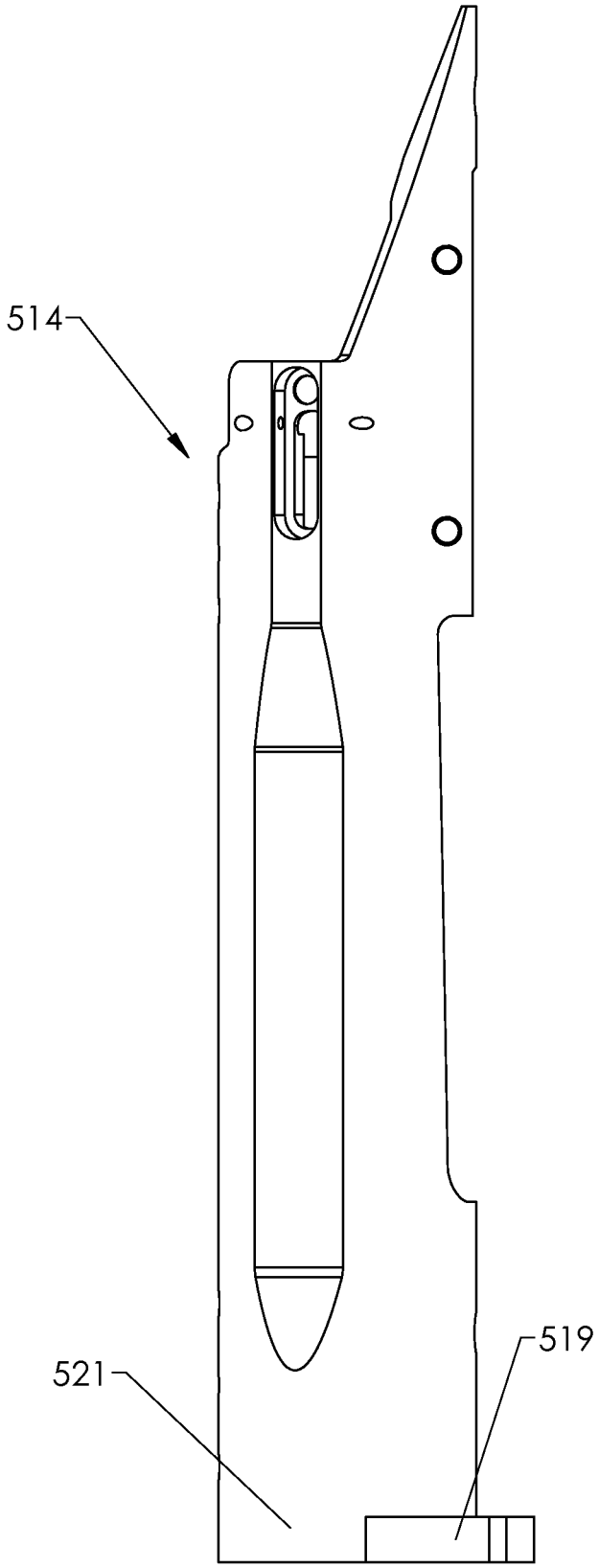
FIG. 27 is a side view of the receiver of FIG. 26.
Figure 28:
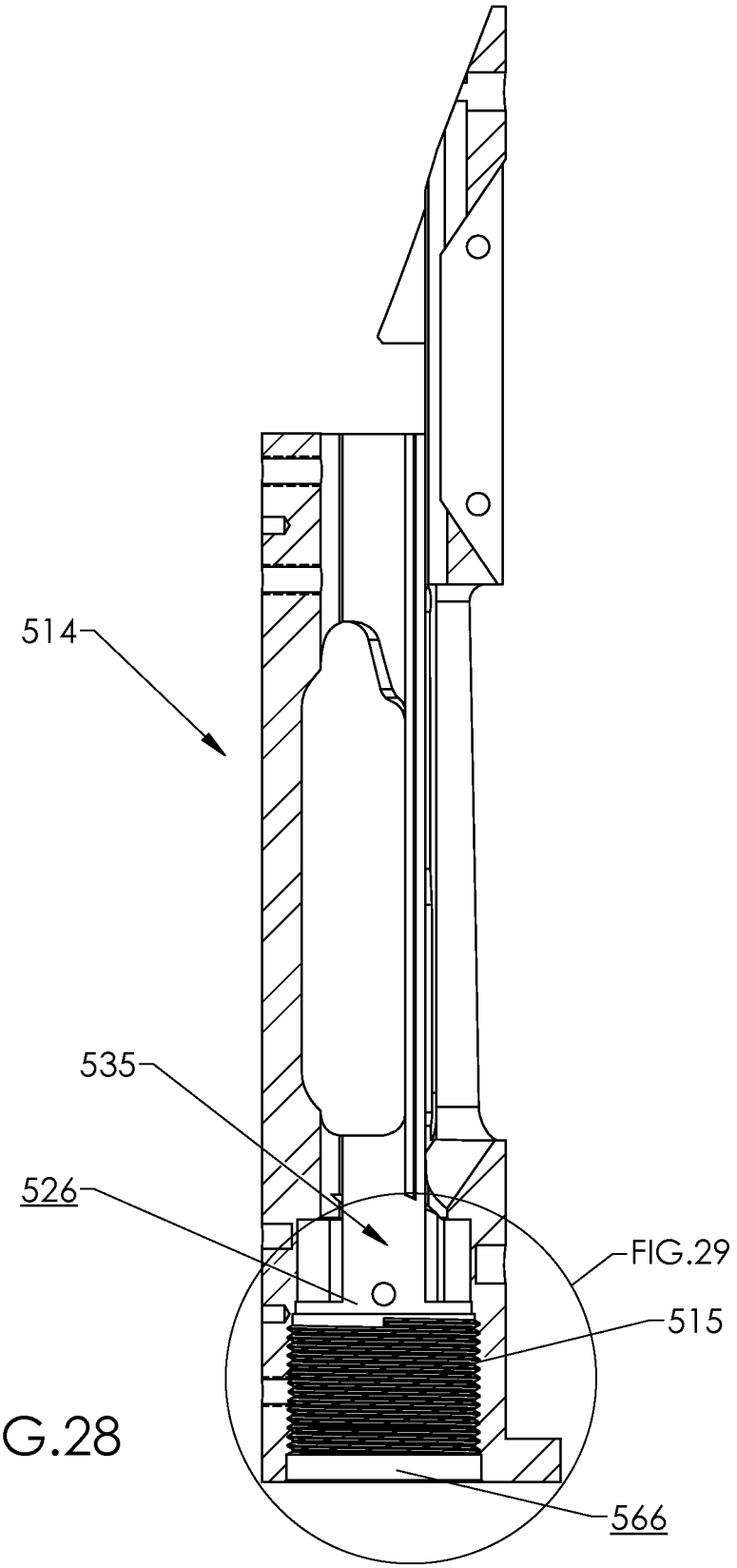
FIG. 28 is an axial cross-sectional view of the receiver of FIGS. 26 and 27.
Figure 29:
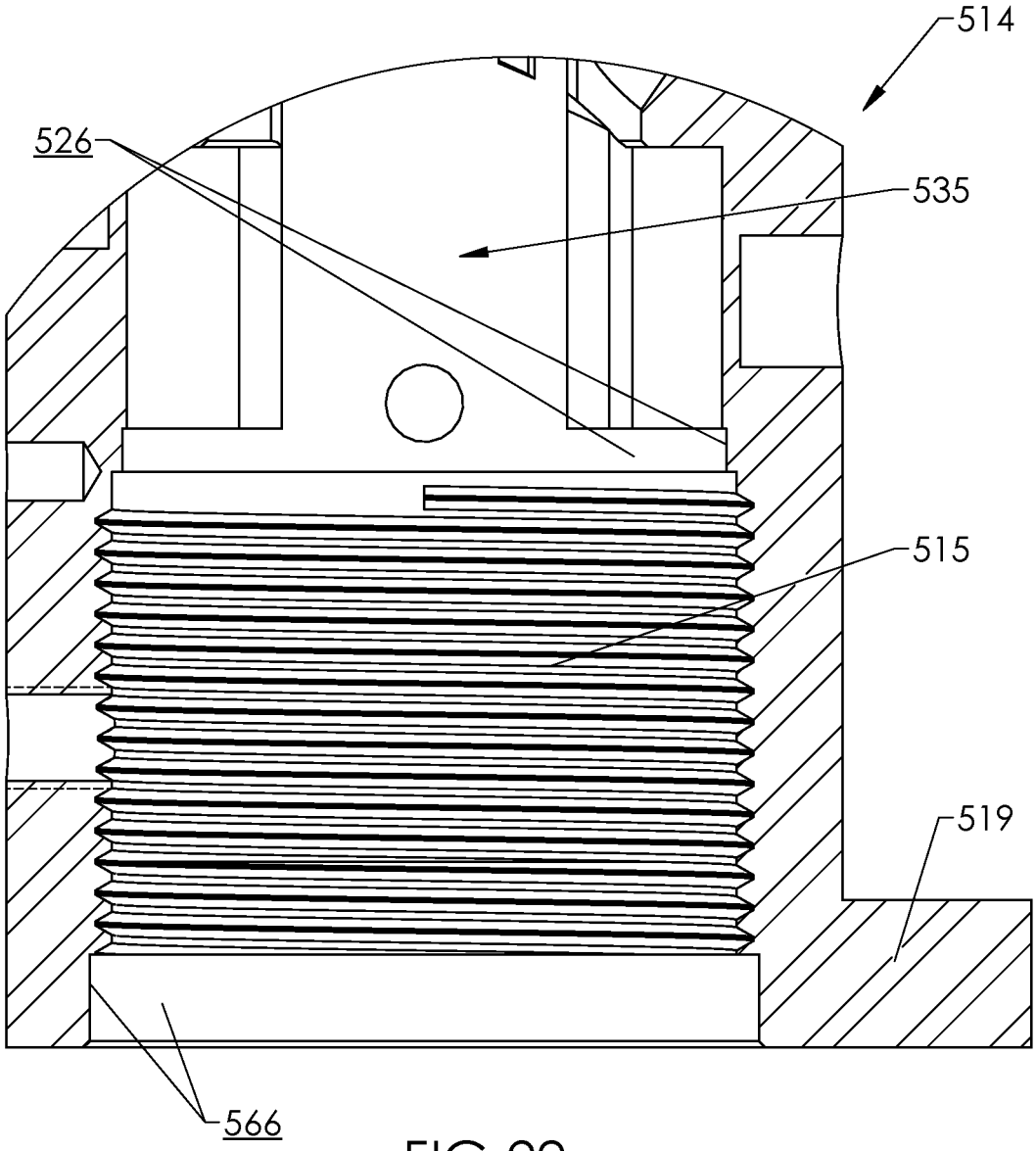
FIG. 29 is an enlarged, detail cross-sectional view of the distal end of the receiver of FIGS. 26-28, that is, the portion circled in FIG. 28.

An assembly is shown in a bolt "loaded and unlocked" condition in FIGS. 1-9. FIGS. 10, 11A and B, and 12 schematically portray movement of the action from said loaded and unlocked condition to a "loaded and locked" condition that is detailed in FIGS. 13-20. FIGS. 21-23 show details of the distal receiver inner surface of the assembly that is non-cylindrical all the way, or substantially all the way, from the lug stops to the receiver threads. FIGS. 24 and 25 show details of an alternative curvature of the distal receiver inner surface, comprising the non-cylindrical surface in the lug rotation space (hereafter "lug space"), as in FIGS. 1-9, 13-20, and 21-23, but transitioning to a cylindrical surface near the receiver threads to define the tenon-receiving space, thus illustrating one example of the tenon-mating space being "another shape" rather than the same shape and "same surface" as the lug mating space.

Portions of one style of a firearm, a manually-operated, right-handed handle-operated bolt action rifle, are portrayed in the Figures, as a platform to describe preferred adaptations for improved accuracy while maintaining field-capability for the weapon. However, other styles of firearms having a bolt with locking lugs, and other styles of receiver, bolt, and barrel, and cartridge, may be used in embodiments of the invention, as will be understood after one of ordinary skill in the art of firearm design and manufacture views this disclosure. For example, a lever action, pump action, automatic action, and semi-automatic action firearm with a locking lug bolt may be used in embodiments of the invention. The adaptations may be made in many or all firearms with a locking lug bolt and the portions of the firearm not drawn herein (stock, forestock, trigger, firing pin, etc.) in the Figures will also be understood and may be conveniently built by those of ordinary skill in the art. For example, drawings of an entire bolt-action rifle are shown in U.S. Pat. No. 7,975,417 Duplessis et al and many other patents in this field, and will be understood by those of skill in this field.

FIGS. 1-9 illustrate an embodiment 10 that is an assembly of cooperating components, namely barrel 12, receiver 14 with threaded surface 15 for connection to the barrel threads, bolt 16, adapted according to preferred methods and structure of the disclosed technology, and a barrel nut 17 (present in some firearm designs) and a recoil lug 19. These components, with a rifle cartridge 18, are unassembled/exploded in FIG. 1. Exploded multiple parts of an example bolt main body are shown prior to welding of the parts together, but locking lug bolts of other construction, with more or fewer separable parts, and for actions other than manual, handle-operated bolt-actions, may be used in alternative embodiments.

Figure 2:
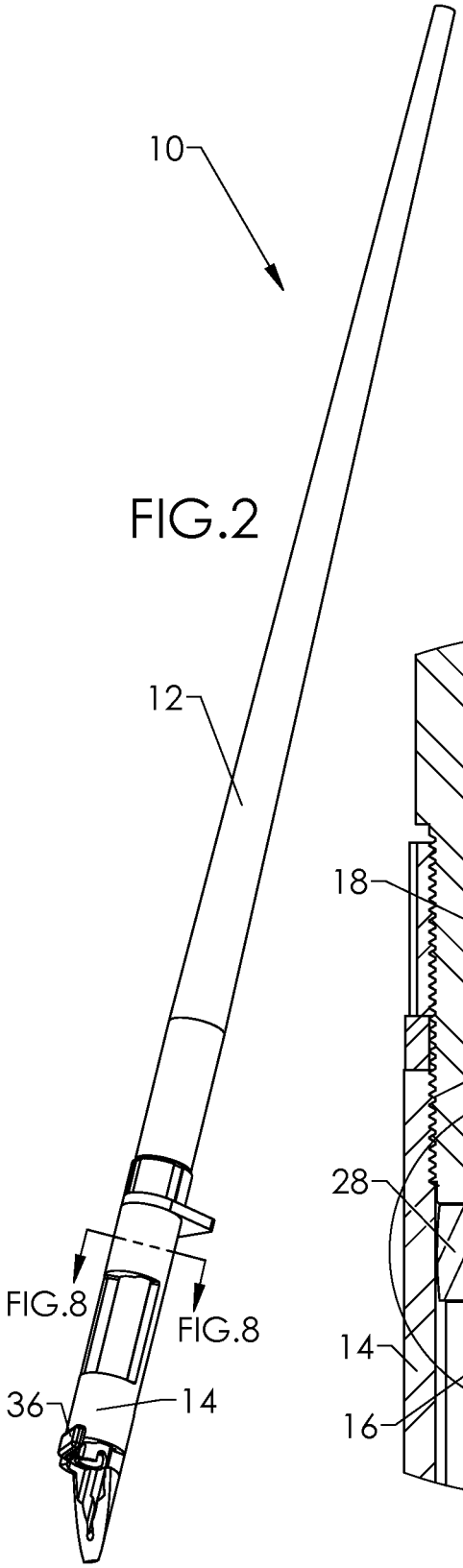
FIG. 2 is a top perspective view of the assembled components of FIG. 1, with the bolt in loaded but unlocked position.
Figure 3:
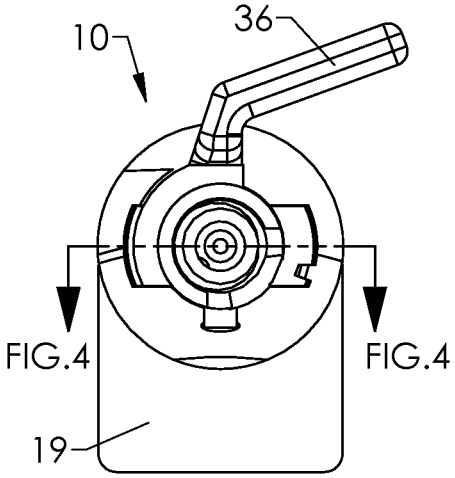
FIG. 3 is a proximal end view of the right-handed bolt action assembly of FIG. 2.
Figure 5:
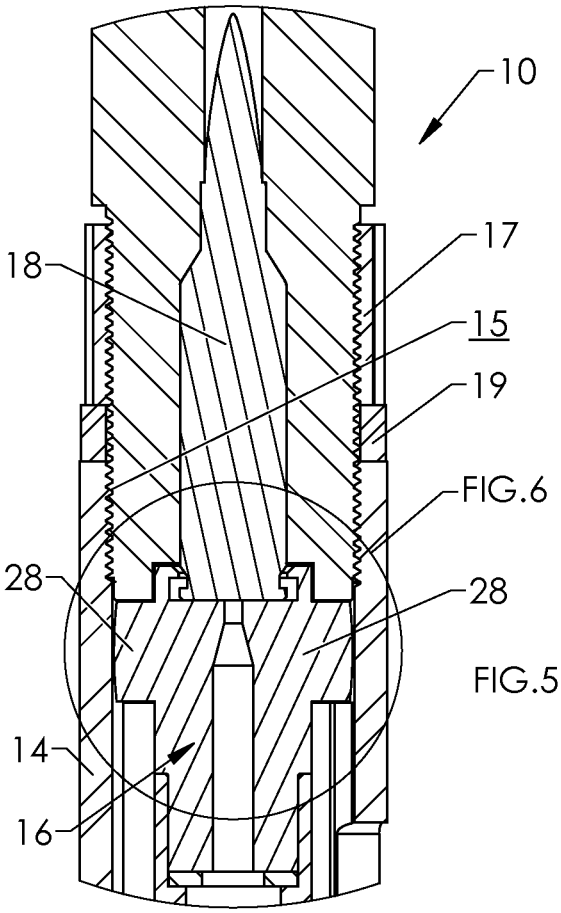
FIG. 5 is an enlarged detail view showing the distal portion of the receiver and bolt, the proximal end of the barrel, and a cartridge of the cross-sectional view of FIG. 4.
Figure 4:
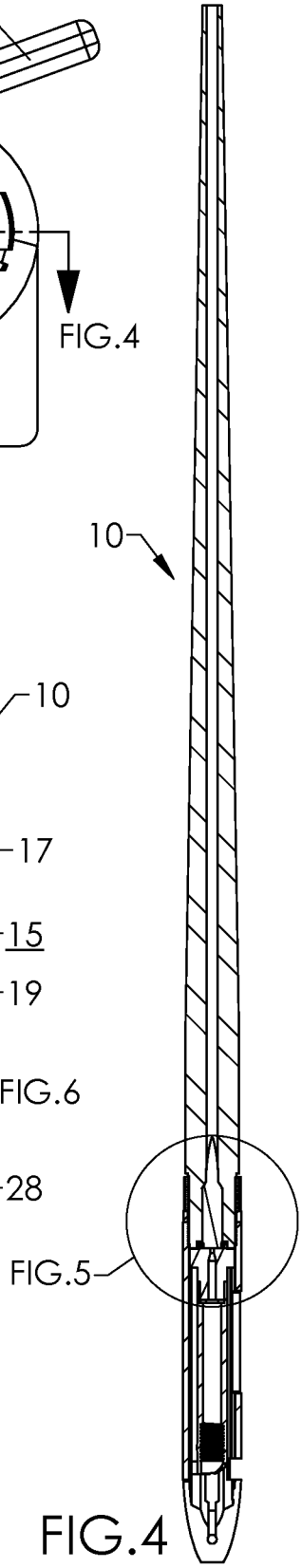
FIG. 4 is a cross-sectional view of the assembly of FIG. 2 viewed along the line 4-4 in FIG. 3.

FIGS. 2-9 show the exemplary assembly 10 with the bolt 16 in the "loaded but not locked" position, meaning that the user has pushed the bolt 16, by its handle, forward in the receiver bore (the "boltway" or "bolt raceway") to a full extent, wherein the bolt lugs 28 have slid through the openings between the lug stops 33 to enter the lug space 35, thus pushing the cartridge into the chamber. See also FIGS. 10 and 21-25 regarding call-out numbers 33 and 35. In FIGS. 2 and 3, the raised position of the bolt handle 36 is easily seen.

Figure 6:
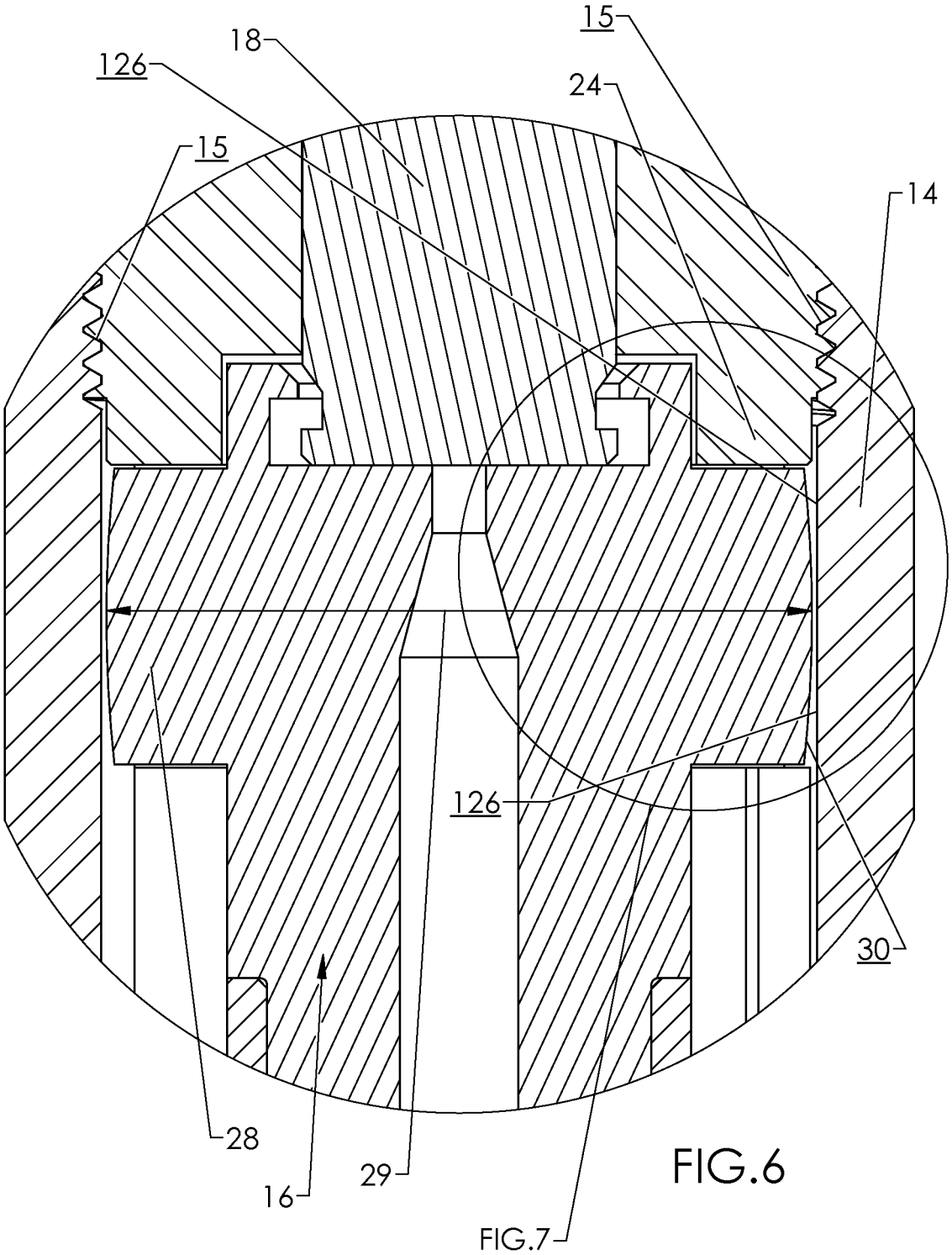
FIG. 6 is a further enlarged detail of the area circled in FIG. 5.
Figure 7:
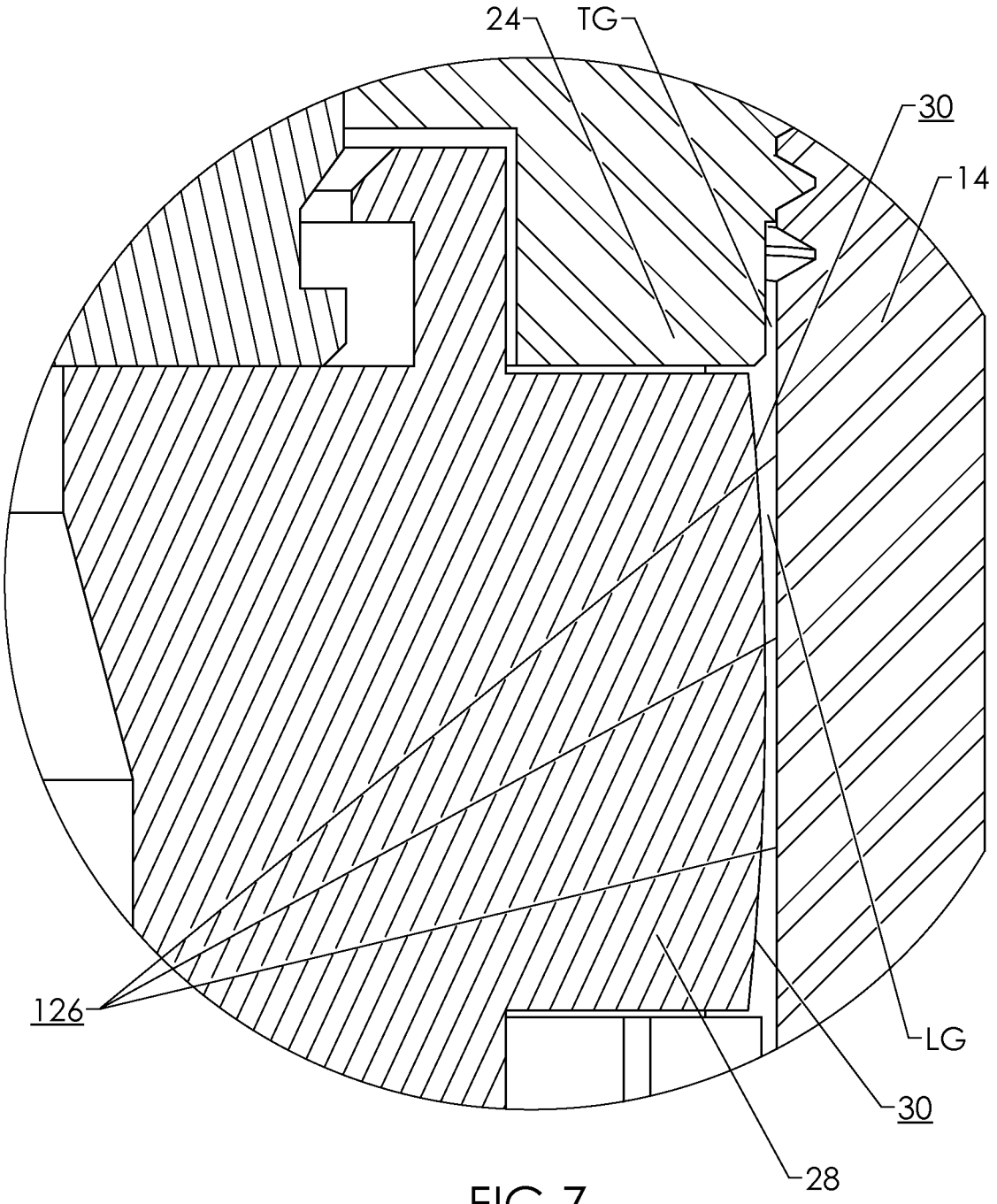
FIG. 7 is an enlarged detail of the area circled in FIG. 6.
Figure 8:
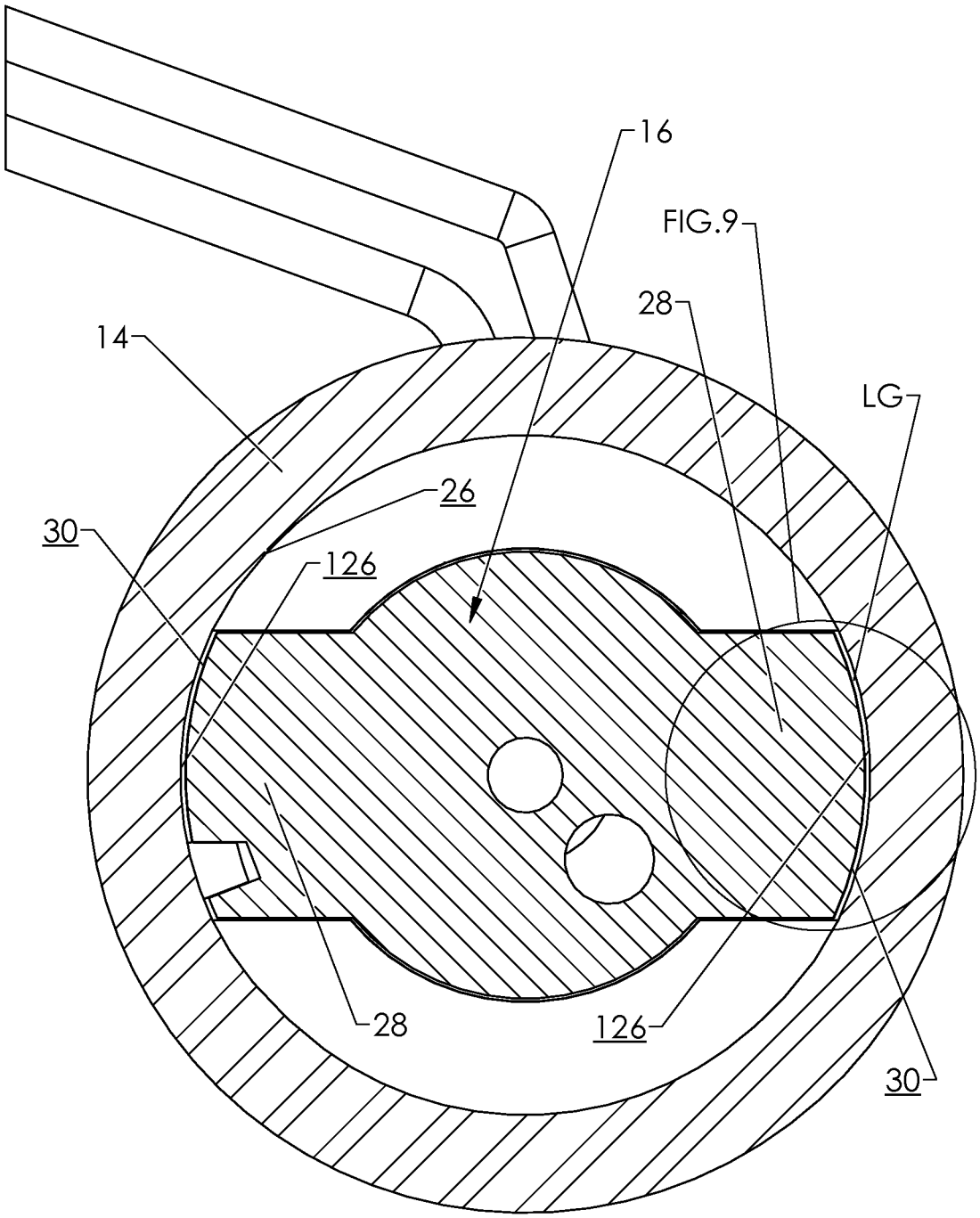
FIG. 8 is a distal end cross-sectional view of the assembly of FIG. 2, viewed along the line 8-8 in FIG. 2.
Figure 9:
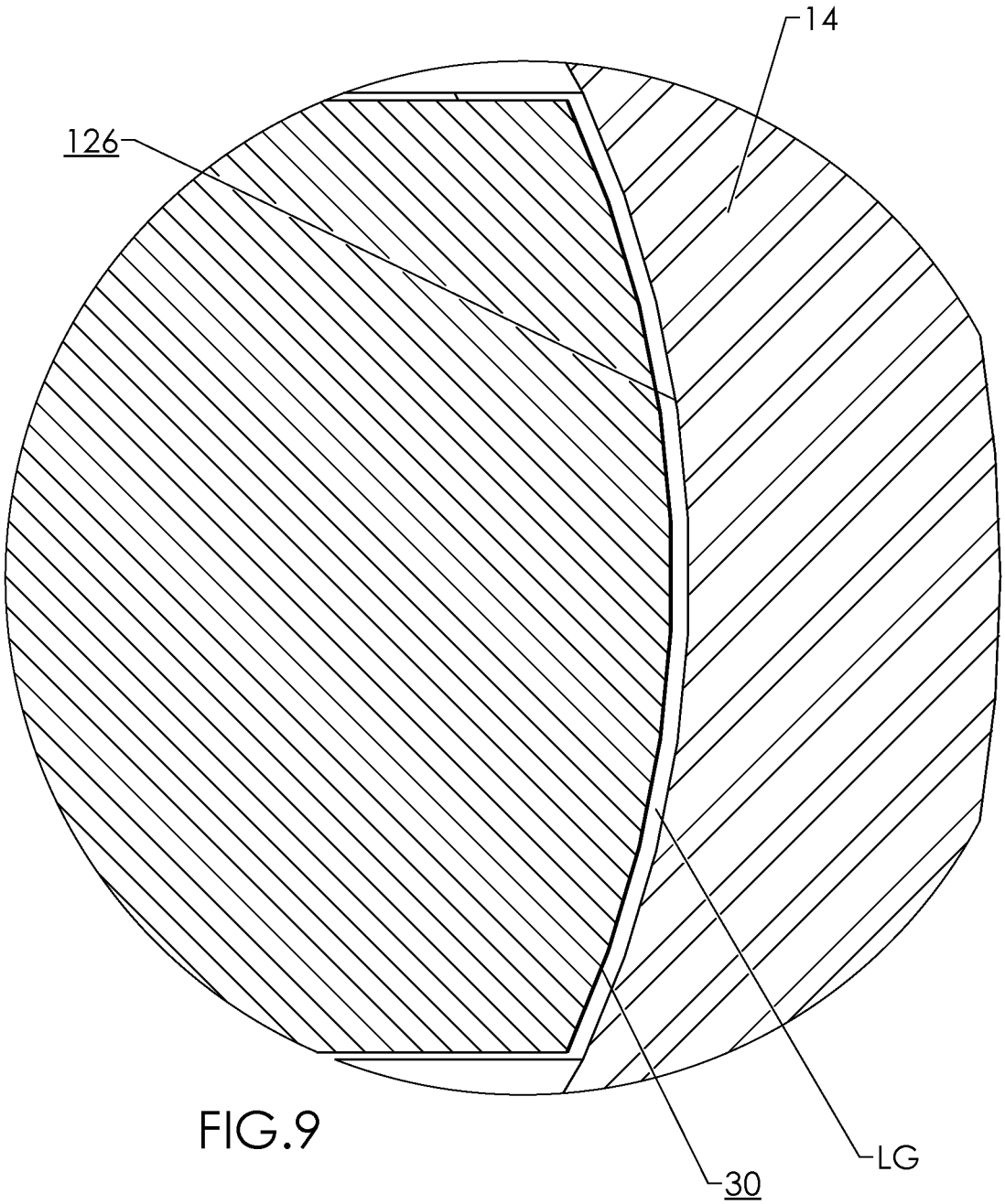
FIG. 9 is an enlarged detail of the area circled in FIG. 8.

FIGS. 4-7 are side cross-sectional views, and FIGS. 8 and 9 are end cross-sectional views, of the distal end of the bolt 16 with the lugs 28 in the unlocked position. The lugs 28 sit inside the lug space 35 encircled and defined by the non-cylindrical receiver inner surface 26, in that it curves to comprise a crest region preferably for each lug, and troughs between the crests, and transition areas extending between the crests and the troughs. In this embodiment, the receiver inner surface 26 non-cylindricality extends all the way to the threaded surface 15.

This unlocked position features a relatively-loose lug-to-receiver-surface relationship, as may be seen from the gap LG (FIGS. 7, 8, and 9) between the trough region 126 of the inner surface 26 of the receiver, and the outermost surface 30 (or "radially-outermost surface" or "radial-extremity surface") of the lugs, all along the axial length of the lugs 28 (shown in FIGS. 4-7), and all along the circumferential width of the lugs 28 (shown FIGS. 8 and 9). As will be further discussed below, the gap LG, and other important features of the receiver, barrel, and lug cooperation, is due to ramping of said receiver inner surface 26 in the lug space 35 (FIG. 23) to make the relationship of the lug outermost surface and the receiver inner surface 26 loose/distant in the trough regions 126 of the ramp, and the relationship of a portion of the lug outermost surface and the receiver inner surface 26 tight/close in the crest region 226 of the ramp. Gradual, slanted transition regions 336 lies between the troughs 126 and the crests 226 to clean/scrape the lugs and to help prevent blockage or binding during lockup.

FIGS. 4-7 also illustrate a preferred adaptation in the outermost surfaces 30 of the lugs 28, wherein the outermost surface 30 of the each of the bolt lugs 28 is curved, or otherwise non-linear, in the axial direction, to create at least one maximum diameter 29 and to reduce the surface area of each outermost surface 30 that comes closest to the receiver inner surface 26. This axial curvature or other axial non-linearity will be further discussed and shown to best advantage later in this document and its importance shown to best advantage in FIGS. 16-20.

FIGS. 8 and 9 show to best advantage the circumferential curvature of the outermost surface 30 of each lug, wherein the curvature is on a radius generally matching the radius of the inner surface 26 trough region 126. The outermost surfaces 30 are not intended to contact the trough regions 126, but are intended to contact the crest surface regions 226 but only at the maximum lug diameter 29. Therefore, the circumferential curvature of the lugs is generally the same as the trough region 126, but is not required to be accurate enough for mating with the trough region 126.

FIGS. 6 and 7 illustrate to best advantage the relationship of the non-threaded tenon 24 of the barrel 12 relative to the trough region 126 of the inner surface 26, in this embodiment wherein the non-cylindrical curvature of the inner surface 26 extends all the way to the threaded surface 15 and so encircles and defines the tenon-receiving space 37. The non-threaded tenon 24 is an example of an axial extension protruding proximally from the threaded portion of the barrel, wherein the tenon 24 is the rearmost (most proximal) portion of the barrel and has an outer surface that is cylindrical, smooth, and continuous. Due to the non-threaded tenon 24 being cylindrical, and the inner surface 26 being ramped/slightly-non-cylindrical through both the lug space 35 and the entire tenon-receiving space 37, FIG. 7 shows the small gap TG between the tenon 24 and the inner surface 26 in this trough region 126 of the receiver inner surface 26. Generally speaking, gap LG between the maximum diameter 29 of the lug 28 and the trough region 126 is about the same size as the gap TG between the tenon 24 and the trough region 126. It should be noted that lug gap LG and tenon gap TG are not instrumental in the centering/coaxial alignment of the bolt in the receiver or the barrel relative to the receiver. As will be explained later in this document, it is the tight tolerance/mating of the lugs and the tenon to the crest regions of the lug space 35 and tenon-receiving space 37, respectively, that are instrumental to this centering/coaxial alignment.

It may be noted that in alternative curvature versions of the receiver inner surface 26 more of the inner surface may mate with the tenon and further contribute to said centering/coaxial alignment of the barrel with the receiver. For example, when the entire surface 426 and resulting tenon-receiving space 37' are cylindrical, as in FIGS. 24 and 25, the entire outer circumference of the tenon will mate/press-fit with the surface 426. Therefore, it may be understood that the receiver inner surface may be shaped/curved so that the tenon-receiving space has the same shape/curvature as the lug space, or the receiver inner surface may change at or near its distal portion to be differently shaped/curved than its proximal portion that defines the lug space. For example, while the proximal portion defining the lug space comprises multiple crests and troughs, the distal portion defining the tenon-receiving space may have that a) same number of crests and troughs, b) a different number of crests and troughs, c) crests and troughs of the same diameters as those in the lug space; d) crests and troughs of different diameters as those in the lug space; or e) zero crests and zero troughs (cylindrical) wherein the resulting cylindrical diameter of the tenon-receiving space is the same as the crests of the lug space (as in FIGS. 24 and 25), or less preferably the same as the troughs of the lug space or a different diameter.

Figure 11B:
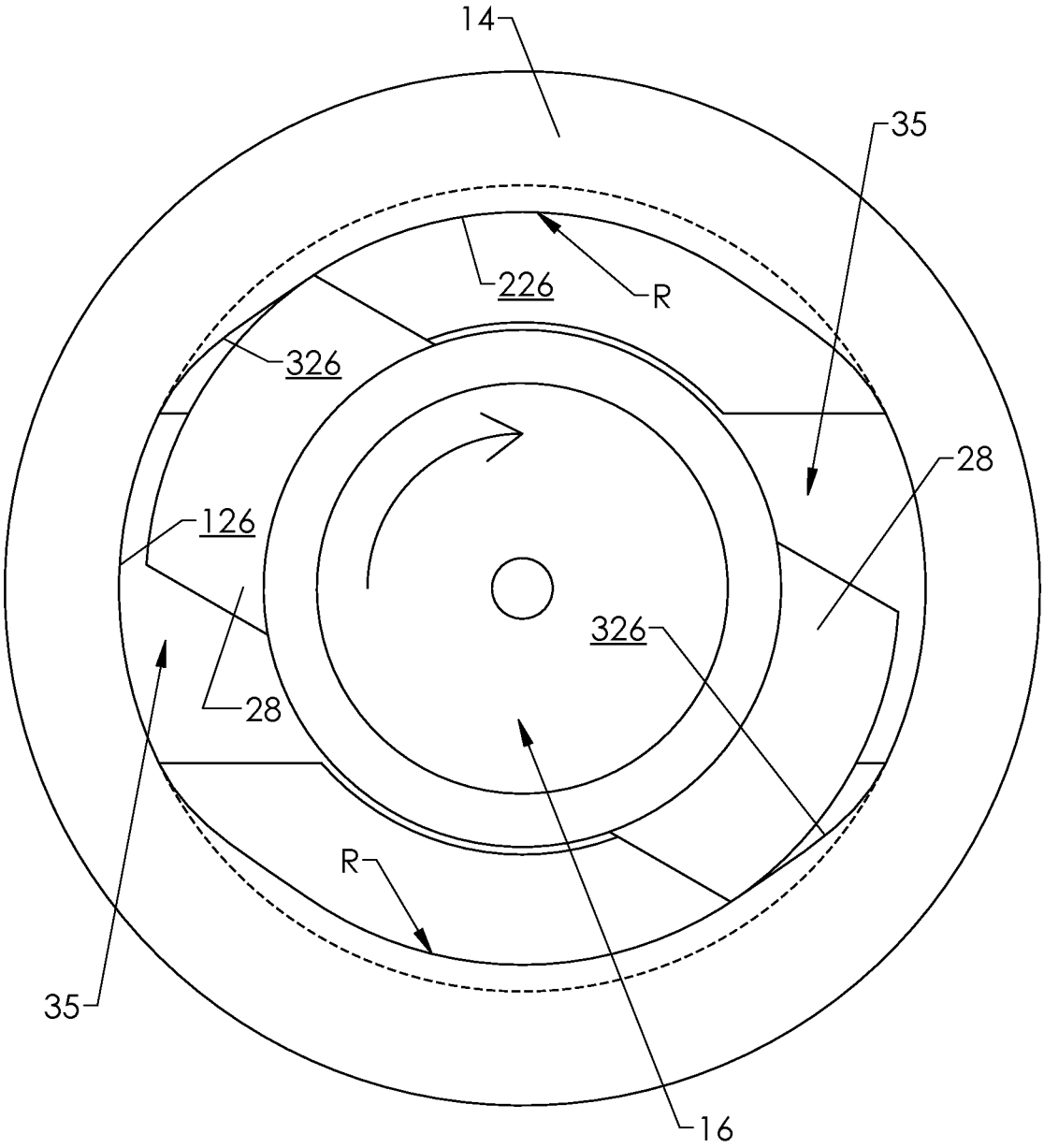
FIG. 11B is a schematic distal end view of the bolt of FIG. 10 being rotated clockwise, as in a left-handed action, wherein the outermost end surfaces of the lugs are beginning to slide along the ramps toward the crests of the ramps (the ramps being exaggerated for illustration).
Figure 12:
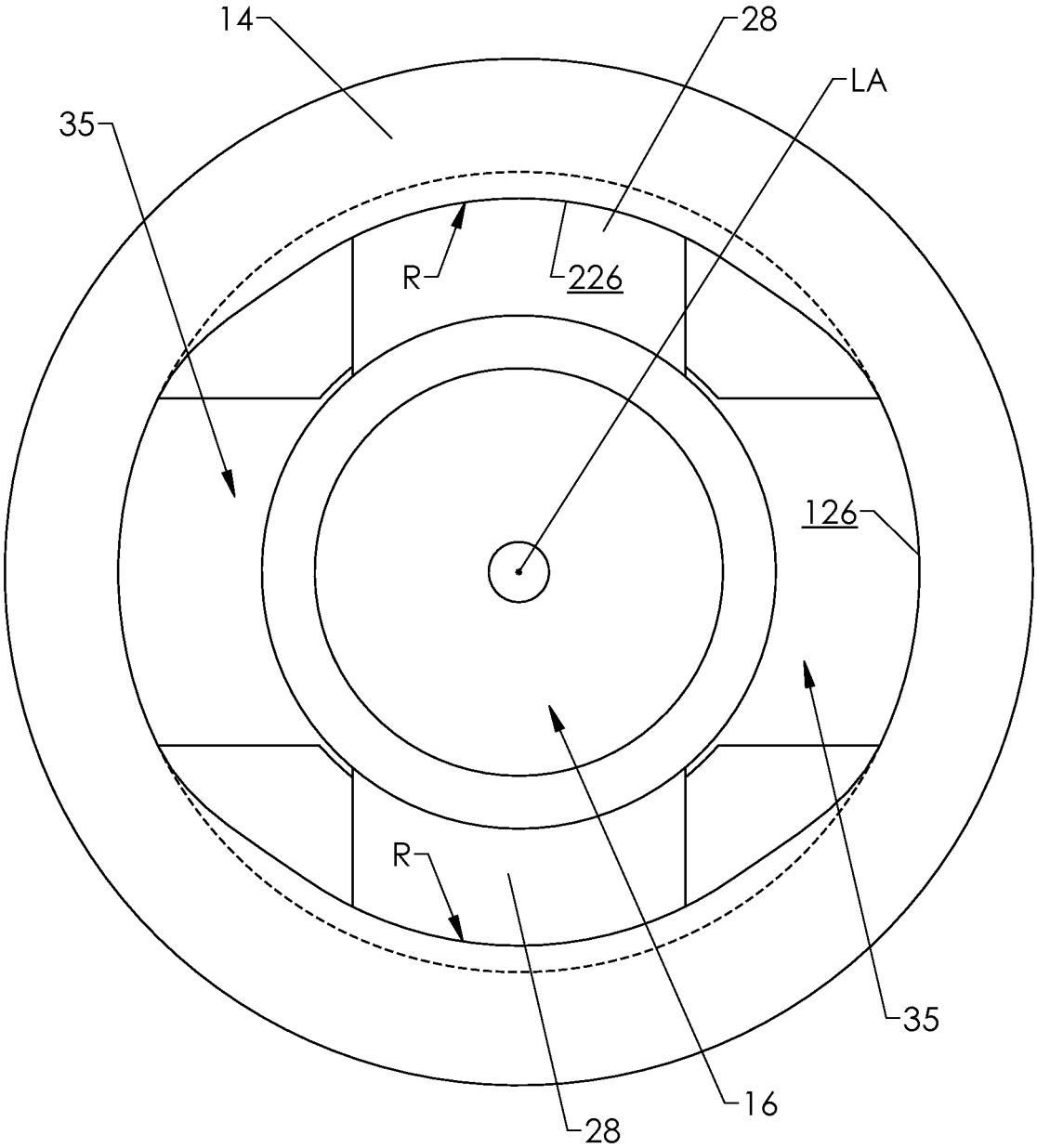
FIG. 12 is a schematic distal end view of the bolt of FIGS. 10 and 11A and B fully rotated clockwise into the loaded and locked position, wherein the outermost surfaces of the lugs are at/against the crests of the ramps, in the tight tolerance condition.
Figure 13:
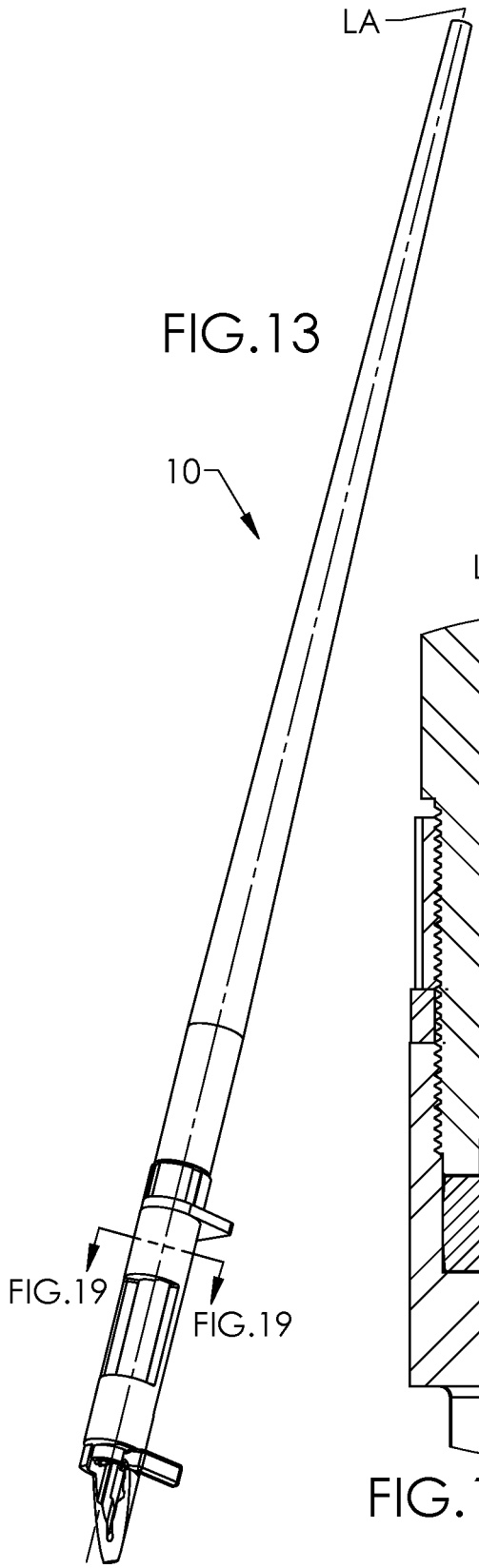
FIG. 13 is a perspective view of the assembly of FIGS. 2-9, but with the bolt rotated into the loaded and locked position.
Figure 14:
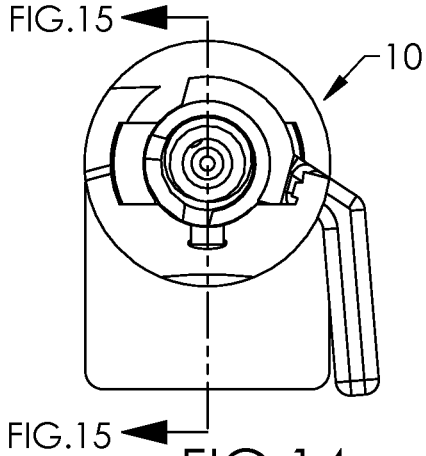
FIG. 14 is a proximal end view of the assembly of FIG. 13.

FIGS. 10-12 schematically portray, by exaggeration, the ramping of the receiver inner surface 26. Thus, FIGS. 10-12 schematically portray the difference in receiver inner surface diameters at different angular locations around the inner circumference of the distal portion of the receiver, in the lug space 35 where the bolt lugs 28 are rotated into and out of the locked condition. The ramps R, forming the slightly-non-cylindrical shape (here, generally oval or ovoid to accommodate two lugs) of the inner surface 26 comprise two troughs 126, and two crests 226, due to the troughs being relatively recessed and the crests being relatively protruding relative to the central axis of the receiver. The perpendicular arrows in FIG. 10 illustrates the trough diameter (maximum diameter, Dmax), and the crest diameter (minimum diameter, Dmin) of the lug space 35. The dashed lines indicate where the inner surface of the receiver would be if Dmax were constant around the receiver, thus, illustrating the "additional material" of the receiver main body 14 that is present, relative to the troughs, to create the crests of the ramps R. Note that the drawings show a two-lug (28) bolt (16), but, for different numbers of lugs, the receiver inner surface in the lug space would have more troughs and crests, for example, three lugs sliding into three troughs in the loaded but unlocked position, and then rotating to three crests in the loaded and locked position.

FIGS. 10-12 also illustrate the operation of the bolt, wherein the lugs 28 enter the lug space at the troughs 126 between the lug stops (FIG. 10), move along/near the ramps at the transition surfaces 326 (the beginning of the ramps between the troughs and the crests) (FIGS. 11A and B), and then reach the fully-rotated, loaded and locked position of mating/tight tolerance at/against the crests 226 (FIG. 12). FIG. 11A portrays counterclockwise rotation in a distal view, which is consistent with the right-handed action drawn in FIGS. 1-9 and which is generally representative of any action that uses this direction of bolt rotation. FIG. 11B portrays clockwise rotation in a distal view, for a left-handed user using a mirror image of the action drawn in FIGS. 1-9, and which is generally representative of any action that uses this direction of bolt rotation. Note that the lug space 35 is distal/forward of the lug stops 33, and, when the bolt rotates, the lugs 28 rotate on the bolt central axis, distal/forward of the lug stops 33. Therefore, it may be understood that the receiver inner surface 26, comprising ramps R with troughs 126 and crests 226, is distal (forward) of the lug stops 33.

FIGS. 13-20 illustrate the components and assembly of FIGS. 1-9, in the loaded and locked position corresponding to the position of schematic FIG. 12. In this locked condition, the receiver, bolt, and barrel are precisely coaxially aligned the longitudinal axis LA, which is called-out in FIGS. 13,15, 16, and 19. The barrel and receiver are precisely coaxially aligned in both the unlocked and locked bolt condition, because of the axial-surface mating of the barrel tenon with the receiver inner surface. The bolt, however, moves from what may be called "roughly" or "generally" coaxially aligned in the unlocked condition (FIGS. 1-9), to precisely coaxially aligned in the locked condition (FIGS. 13-20) when the bolt rotates into the tight tolerance position at the crests, to make the entire receiver, bolt, and barrel combination, and consequently the cartridge, precisely coaxial.

In this locked position, also called the "battery" or "ready for firing" position, the bolt 16 has been rotated to place the lugs 28 directly in front of the lug stops 33. Cartridge 18 is shown to best advantage in FIG. 16 in the loaded position in the rifle chamber, and will be understood from this disclosure to be very effectively centered and aligned with the barrel, receiver, and bolt central axes. The views of FIGS. 13-16 may be compared to FIGS. 2-5, wherein the differences in FIGS. 13-16 are that the bolt 16, including its lugs 28 and handle 36, has been rotated to the locked position from the unlocked position of FIGS. 2-5.

Figure 16:
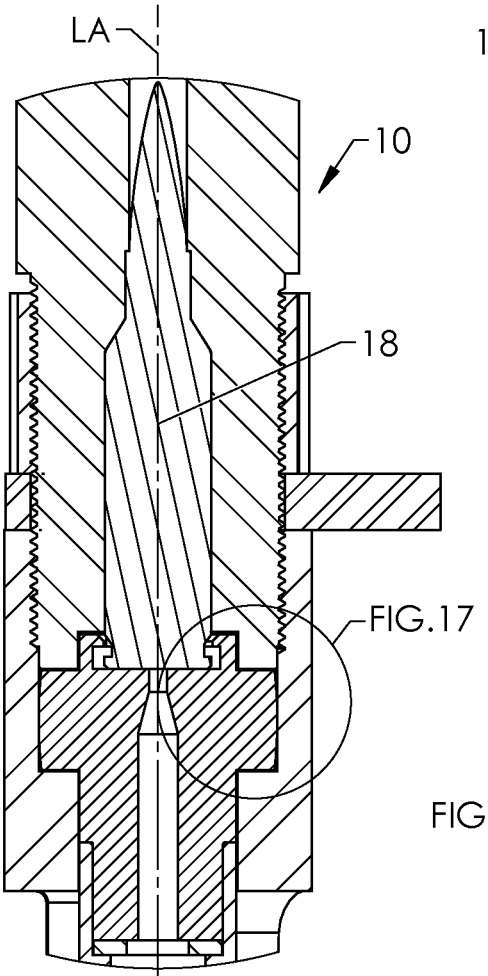
FIG. 16 is an enlarged detail view showing the distal portion of the receiver and bolt, the proximal end of the barrel, and a cartridge of the cross-sectional view of FIG. 15.
Figure 15:
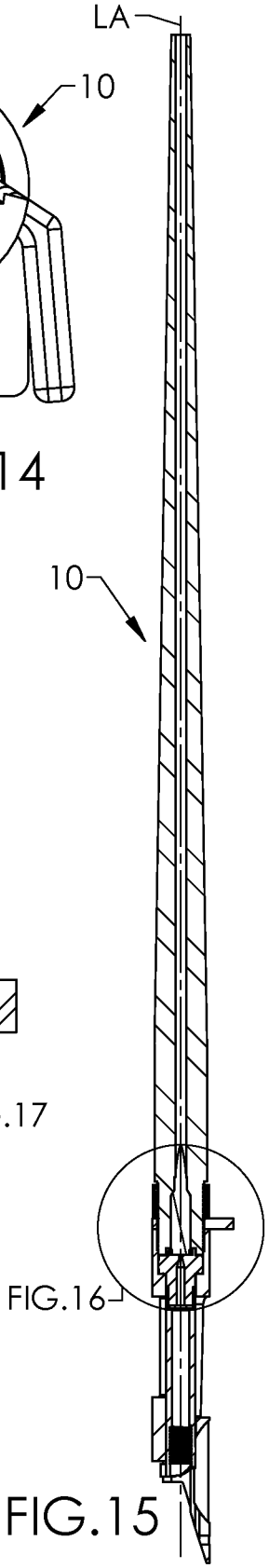
FIG. 15 is a cross-sectional view of the right-handed bolt action assembly of FIG. 13 viewed along the line 15-15 in FIG. 14.
Figure 17:
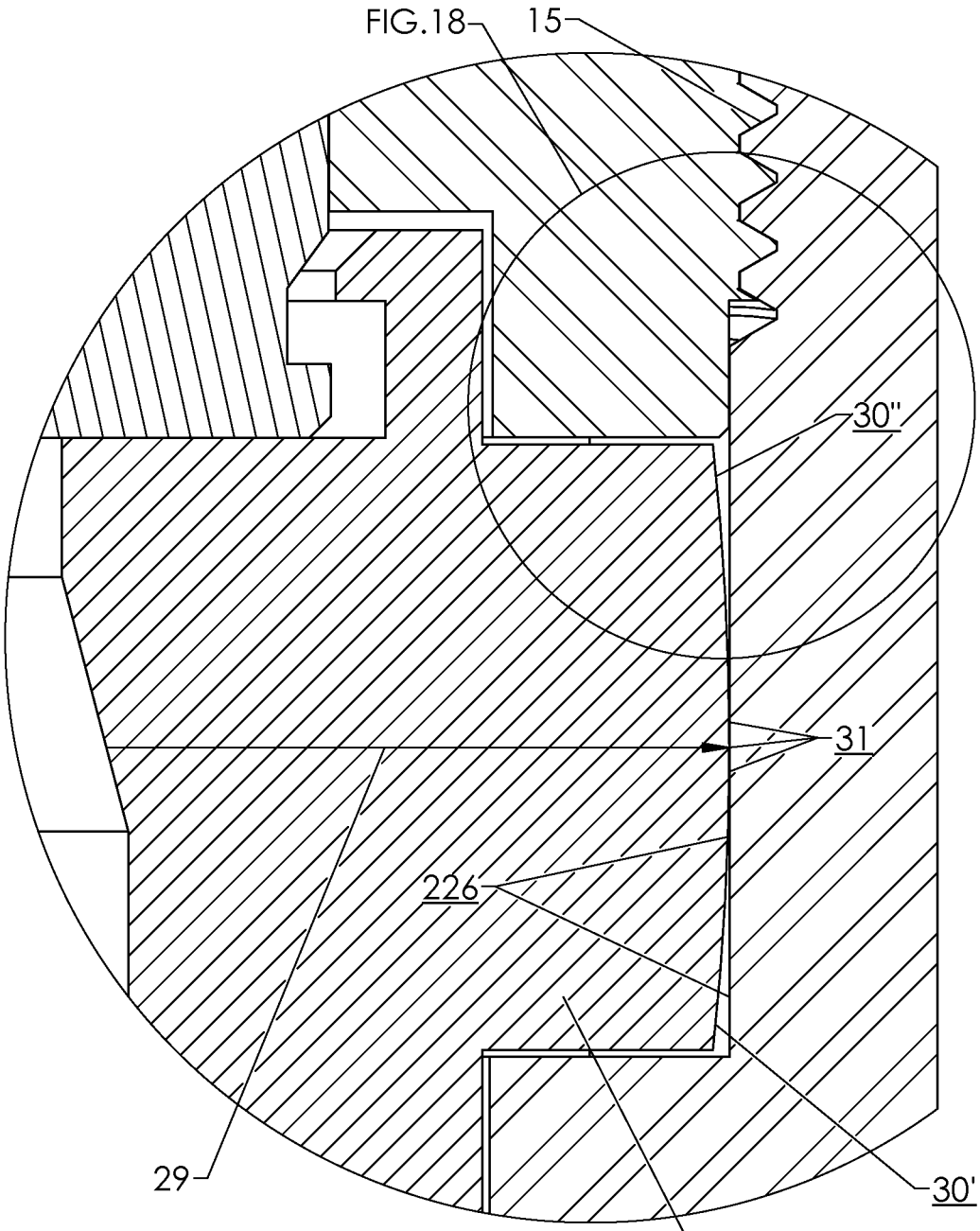
FIG. 17 is a further enlarged detail of the area circled in FIG. 16.
Figure 18:
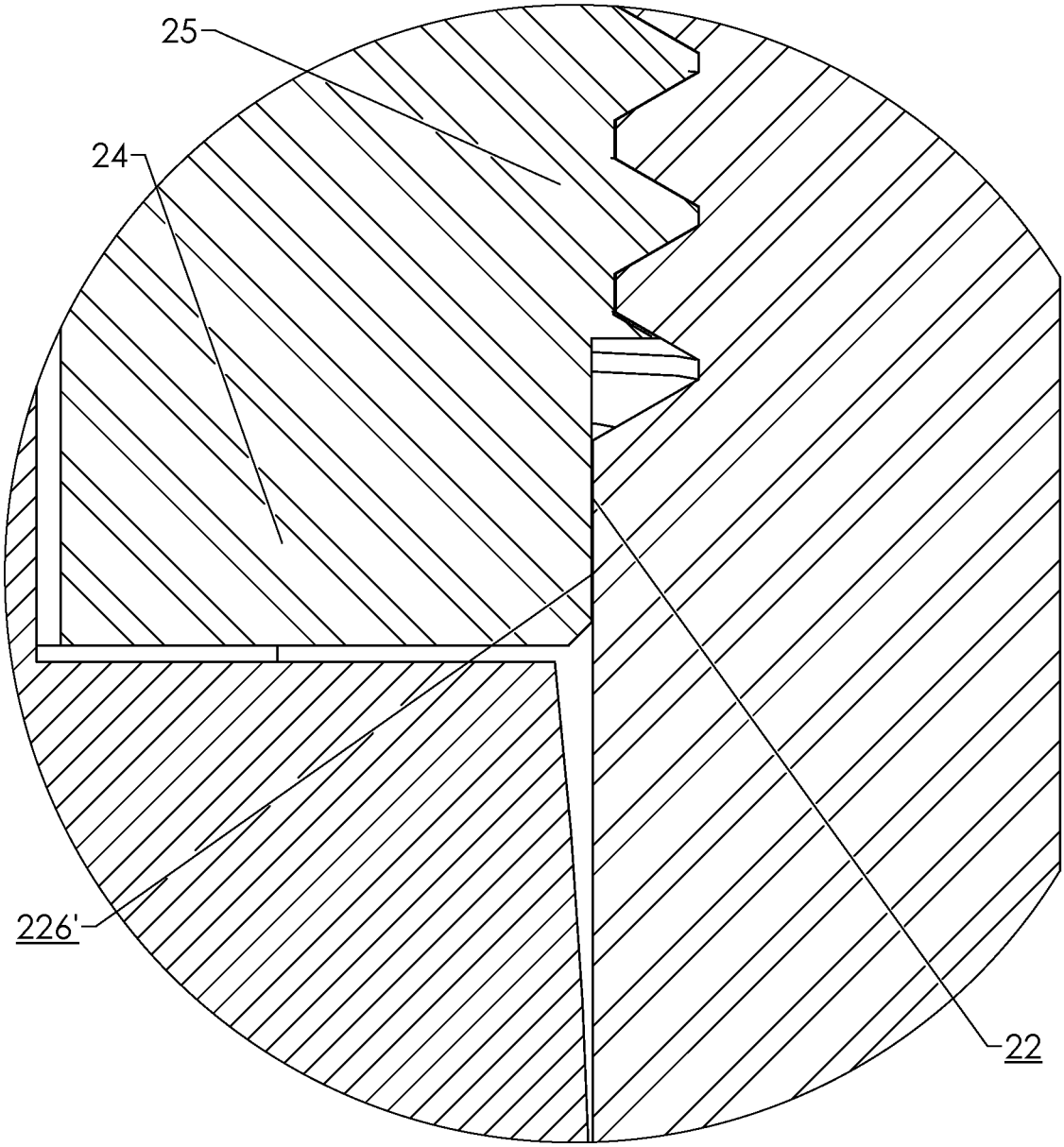
FIG. 18 is a further enlarged detail of the area circled in FIG. 17.

FIGS. 16-18 are side cross-sectional views, showing, in increasing enlargement, detail of the distal end of the bolt 16 with the lugs 28 in the locked position in the lug space. FIG. 17 shows to best advantage one example of axial non-linearity, for example, the axial curvature of the outermost surface 30 of the lug 28, that creates a maximum diameter 29 and a small surface area at that diameter 29 that is closest to the receiver inner surface 26. This way, in the unlocked position, there is substantial room between the bolt lug 28 and the trough region 126 for receiving ice or dirt from the field. Further, even in the locked position, there is room between the bolt lug 28 and the crest surface 226 both distally and proximally of the largest-lug-diameter 29 of the bolt lug 28, but there is a relatively-tight lug-to-receiver-surface relationship between the lug outermost surface 30 and the receiver surface ramp crest 226 in the area of the maximum diameter 29. Thus, the area of very tight tolerance (or even contact) is, in effect, a narrow rectangle or "line" of surface area 31 at the maximum diameter 29, about midway between the proximal and distal edges of the lugs in this example. The proximal edge surface region 30' and the distal edge surface region 30" are slightly further from the crest surface 226 due to the axial curvature of the lugs. The tight tolerance of the surface area 31 of the lug to the crest surface 126 of the receiver is preferably in the range of less than 0.004 inches, from each other. For example, the tight tolerance may be selected from 0.0039, 0.002, 0.001, 0.0008, or most preferably 0.0005-0.0003 inches, or alternatively any number of inches or ranges between these values. The axial curvature of each lug 28 may be one or more radii, for example, selected from the list of less than or equal to 4 inches, 0.5-4 inches, 3-4 inches, 2-3 inches, 1-2 inches, or 0.5-1 inches, or any number in these ranges.

Figure 19:
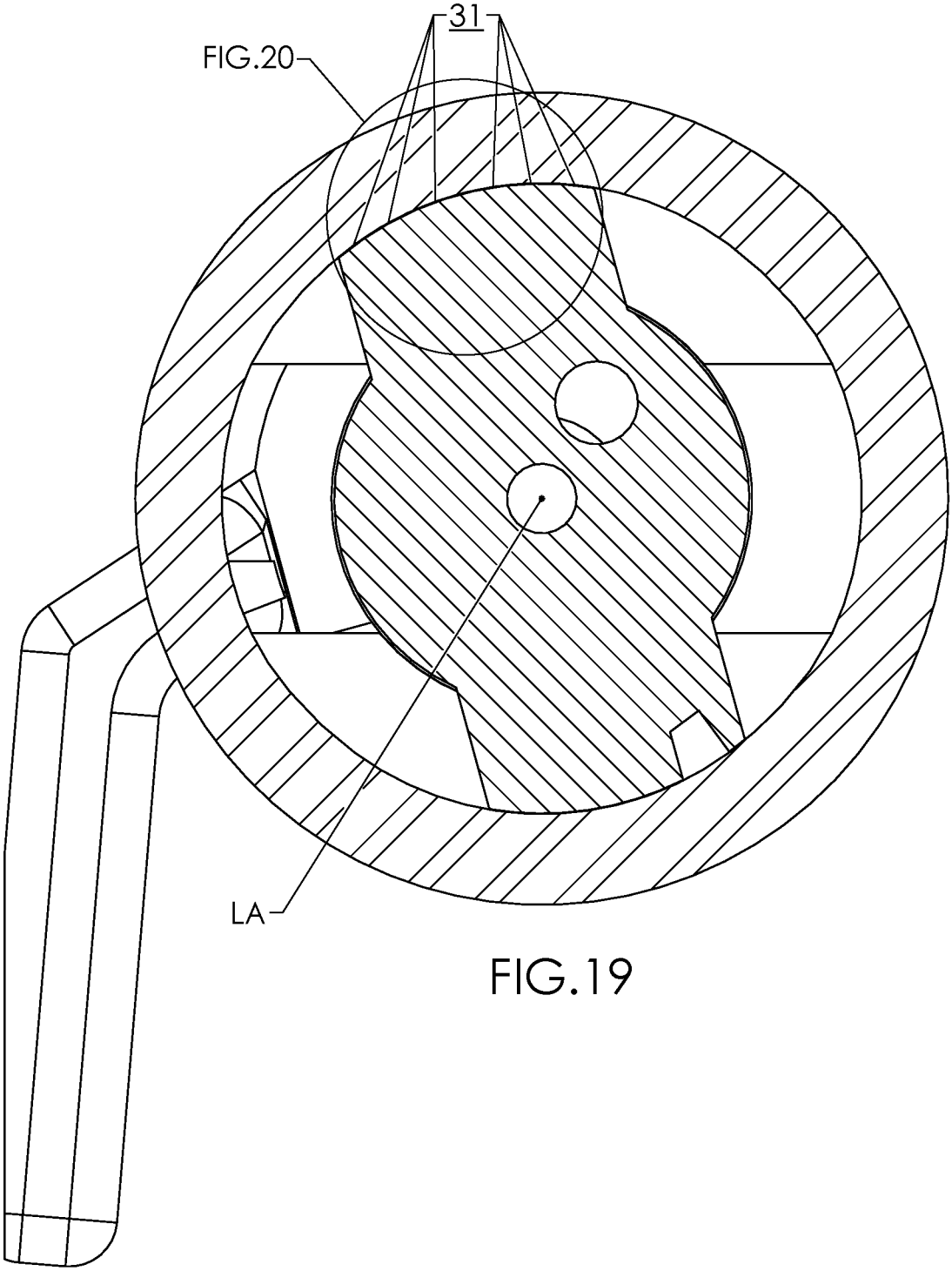
FIG. 19 is a distal end cross-sectional view of the assembly of FIG. 13, viewed along the line 19-19 in FIG. 13.
Figure 20:
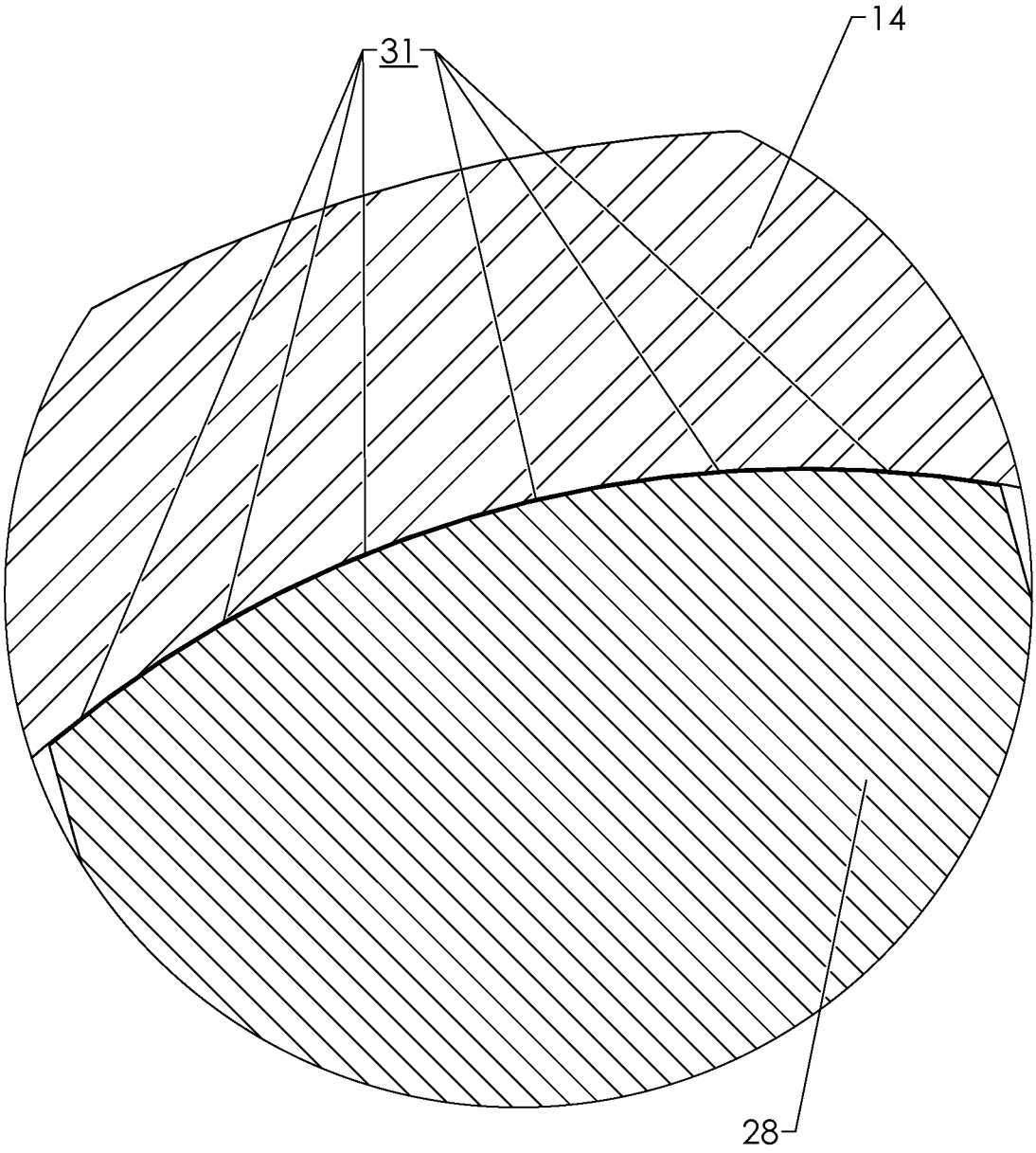
FIG. 20 is an enlarged detail of the area circled in FIG. 19.

FIG. 19 is a cross-sectional end view, and FIG. 20 is an enlarged detail of FIG. 19, wherein the receiver and bolt are cut at the location of the maximum diameter 29 of the lugs, showing how that region (surface area 31) is mated with the crest surface 226 of the receiver. Therefore, as may be understood best from FIGS. 17 and 19, the surface area 31 of mating/tight-tolerance of the lug to the crest 226 has a small axial dimension (FIG. 17), due to the axial curvature that purposely is provided to keep most of the outermost surface 30 away from the receiver surface 26 but has a longer circumferential dimension (FIGS. 18 and 19) due to the radial/circumferential curvature that generally matches the receiver surface 26 curvature.

FIGS. 17 and 18 show to best advantage a portion of the non-threaded tenon 24 of the barrel 12, which tenon 24 protrudes proximally from the threaded portion 25 of the barrel. The outer circumferential surface 22 of the tenon 24 is mated preferably in a press-fit with a distal region of the inner surface 26 of the receiver 14, specifically, a distal region of the crest surface 226. The threaded portion tenon 24 is cylindrical and of the same or almost the same outer diameter as the crest surfaces 226 and therefore opposing sides of surface 22 will mate with the crest surfaces 226. Preferably, said mating of the opposing sides of surface 22 with the crest surfaces 226 means the same tolerance as the lug surface area 31 to surface 226, or preferably less than 0.004 inches, from each other. For example, the mating may be selected from 0.0039, 0.002, 0.001, 0.0008, 0.0005, 0.0004, 0.0003, 0.0002, 0.0001 inches, or less, or alternatively any number of inches or ranges between these values. The sides of surface 22 that are 90 degrees from those mating with surface 226 will be spaced from the trough surfaces 126, as shown by the gap TG between the tenon 24 and the trough surface 126 in FIG. 7. It will be understood from this disclosure that mating of opposing sides of the tenon with the receiver inner surface, while other sides (90 degrees from the areas of mating) are not mating with the receiver inner surface, will result in an excellent coaxial and concentric relationship of the barrel 12 to the receiver 14. Or, in alternative curvature versions of the receiver inner surface that have fewer or no troughs in the region receiving the tenon, the increased amount of receiver surface area that mates with the tenon may further enhance the coaxial and concentric relationship of the barrel 12 to the receiver 14. These axial-mating connections are superior to a threads-only connection, because of the inherent axial-play in the threaded connection and the resulting inaccuracy and canting to off-of-coaxial. Therefore, the axially-mated non-threaded tenon, even if it is along only opposing portions of the tenon, will be significantly more accurate and coaxial than a threaded connection. Note that, if other numbers of lugs 28 are present on the bolt, the areas of mating of the non-threaded tenon to the receiver inner surface may be different in number and location. Also, note that various non-threaded tenon 24 lengths may be used, for example, ones longer relative to the threaded portion 25 than that portrayed in the drawings. For example, certain embodiments may have a non-threaded tenon 24 in the range of ¼-1 inch, or at least ¼ inch, at least ⅓ inch, or at least ½ inch in axial length, for mating with the receiver.

During installation of the barrel in the receiver, the barrel will be rotated into the receiver, by virtue of the threading, and the tenon 24 will become press-fit into the receiver to mate with surface 26 at the crests 226. This is possible because the tenon 24 has an outer diameter the same or slightly less than the minimum diameter of the receiver inner surface 26, so there will be no obstructions to connection of the barrel in this manner. And, because the barrel is mated to the receiver during initial factory assembly, and the barrel is designed not to rotate or otherwise move at this press-fit connection relative to the receiver during operation, the tight tolerance of such a press-fit into the receiver is not susceptible to contaminants experienced in field use.

FIGS. 21-23 are views of the receiver 14, wherein the bolt and barrel have been removed to show the lug space 35 immediately distal of the lug stops 33, the tenon-receiving space 37 immediately distal of the lug space 35, and the threaded space 39 immediately distal of the tenon-receiving space 37 and at the distal extremity of the receiver. Collectively/combined, as represented by the vertical arrows at the sides of FIG. 23, the lug space 35 and the tenon-receiving space 37 are called herein the alignment space AS, as both functions of lug mating and tenon mating in that space AS are important to the coaxial alignment of the components as discussed above. Also, all of said spaces 35, 37, and 39 may collectively/in-combination be called the distal portion or distal space DS of the receiver and receiver bore. Cross-sectional views FIG. 22 and enlarged FIG. 23 illustrate the inner surface 26 that is comprised of trough surfaces 126 and crest surfaces 226 all the way between the lug stops 33 and the receiver threads. In FIG. 23, a dashed line represents an imaginary boundary on the receiver inner surface 26 proximal regions of surface 26 and the distal regions of surface 26, which are shaped the same but which cooperate with different structures, that is, which define the lug space 35 for cooperating with the lugs and the tenon-receiving space 37 for cooperating with the barrel. More specifically, the dashed line separates: 1) a proximal region that receives the lugs, with trough surfaces 126 in the locations wherein the lugs first enter the lug space 35, and crest surfaces 226 with which the lugs mate when the lugs are in locked position, and 2) a distal region that receives the non-threaded barrel tenon surface 22, with crest surface 226' for mating with the tenon surface 22 and trough surface 126' distanced from the tenon surface 22. Transition surfaces 326, 326' are illustrated as regions of transition between the trough and crests, in other words, the beginning of the ramps in the proximal region and the distal region, respectively.

FIGS. 21-23 portray an example of a smooth, ramped receiver inner surface 26 having spaced-apart crests, for mating with each lug and with portions of the barrel tenon. In this curvature version, said ramped surface continuously extends all the way from the lug stops to the barrel-receiving threads, as this continuity has benefits of excellent barrel-to-receiver alignment plus excellent machining efficiency, accuracy, and precision. However, in certain other embodiments, the receiver inner surface may have an alternative curvature, for example, comprising different shapes and/or different diameters in various regions between the lug stops and the receiver threads. For example, the lug space may have ramped surfaces such as are discussed above, but the barrel tenon-receiving space may have different numbers of ramps, or may be exactly-cylindrical in order to have full contact/tight tolerance all the way around the non-threaded tenon of the barrel.

One example of an alternative curvature is shown in FIGS. 24 and 25, wherein receiver inner surface 26' surrounds and defines the alignment space AS' but has different proximal and distal portions. In FIGS. 24 and 25, the portion of the receiver inner surface 26' defining the lug space 35 is ramped as discussed above, and so comprises troughs 126, crests 226, and transitions 336 as described above. The portion of receiver inner surface 26' (surface 426) that surrounds and defines the tenon-receiving space 37', however, is different from that of the lug space, in that it is not ramped and instead is a cylindrical surface of the same diameter as the crests 226 of the lug space. In other words, the receiver inner surface portion 426 defining the tenon-receiving space 37' is "all crest" and "no trough". Note that there is a line shown in FIG. 25 between surface 426 and the surfaces of both the troughs 126 and transitions 326, but there is no line in FIG. 25 between the surface of the crest 226 and the surface of the tenon-receiving space 37', as surfaces 226 and 426 are different portions of the same surface, and are the same diameter.

One may see, at shoulder S in FIG. 25, the difference in, and transition from, the diameter of surface 426 compared to the relatively larger diameter of the troughs 126. FIG. 25 is drawn to-scale, as are FIGS. 1-9, and 13-24, for an exemplary standard handheld hunting or combat rifle, and so the shoulder S is fairly small, but it will understood from the above disclosure that a small difference in the diameters of the troughs vs the crests in the alignment space AS, AS' can provide a large benefit in coaxial alignment and resulting shooting accuracy. To emphasize the difference in diameters, for easier viewing, schematic FIGS. 10, 11A and B, and 12 are provided but are not drawn-to-scale for most firearms actions.

Especially-Preferred Embodiments for Barrel and Receiver Alignment

FIGS. 26-31 illustrate especially-preferred receiver and barrel adaptations, for providing excellent axial alignment of the barrel with the receiver for reasons such as discussed earlier in this document, including excellent shooting accuracy including but not necessarily limited to excellent shooting accuracy while maintaining field/outdoor capability. For example, the illustrated receiver may include one or more, or all, the features discussed above and/or in Non-Provisional application Ser. No. 15/047,569, filed Feb. 18, 2016, and may optionally cooperate with bolts and bolt lugs including one or more, or all, of the features discussed above and in Non-Provisional application Ser. No. 15/047,569. For example, in the Summary of the Invention above, throughout the Detailed Description of the Invention, and in the accompanying drawings, reference is made to particular features (including method steps) of certain embodiments of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally.

While the receiver and barrel illustrated in FIGS. 26-31 are designed for a bolt-handle action firearm, the specially-adapted one or more axial mating surfaces for coaxial alignment of a barrel connected to a receiver may apply to various actions, for example, bolt-handle action, lever action, pump action, automatic action, semi-automatic action, and/or break action. While the receiver and barrel illustrated in FIGS. 26-31 are designed for threaded connection, said specially-adapted axial mating surface(s) may be used in combination with various connection means other than threads, as discussed below regarding FIGS. 32 and 33.

FIGS. 26-29 illustrate, without any bolt shown, receiver 514 that includes an integral recoil lug 519, with a distalmost extremity 519' that in this embodiment serves/forms the distalmost extremity of distal end 521. Receiver 514 has internal threads 515, and a receiver axial mating surface 526 between the internal threads 515 and the bolt lug rotation space 535. In other words, this receiver axial mating surface 526 is proximal of the threads of the receiver, or alternatively may be described as proximal of any barrel connection means on the receiver. This proximal receiver axial mating surface 526 is in the distal end of the receiver a significant distance inside the receiver as measured from the distalmost end of the receiver. For example, axial mating surface 526 may be, in certain embodiments, in the distal end at least an inch from the distalmost end of the receiver.

As will be understood from the discussion of the receivers of FIGS. 1-25, receiver axial mating surface 526 may be cylindrical, non-cylindrical, ramped, oval, ovoid, or other shapes that allow extremely-tight-tolerance/press-fit mating with all, or one or more portions, of the axial mating surface 622 of the proximal tenon 624 of the barrel 612. The portions of surface 526 and surface 622 that mate in said extremely-tight-tolerance/press-fit condition preferably extending exactly axially and parallel to the longitudinal centerline axis of the receiver and barrel, respectively; for example, "exactly axially" in this context may mean precisely axially according to the best standards of high quality machining. As will be understood from the above discussion of the barrel of FIGS. 1-25, the proximally-protruding tenon 624 is proximal of the barrel threads 615, or alternatively may be described as proximal of any barrel connection means on the barrel 612.

A second set of cooperating axial mating surfaces is provided on the receiver 514 and barrel 612. Distal of the internal threads 515 of the receiver, is another receiver axial mating surface 566, which is adapted for extremely-tight-tolerance/press-fit mating with all, or one or more portions, of the additional, more-distal, axial mating surface 682 of the barrel 612. This distal receiver axial mating surface 566 is in the distal end of the receiver but is at or near the distalmost extremity of the receiver and the distalmost extremity of the receiver inner surface. For example, axial mating surface 566 may extend from the distalmost extremity of the receiver inward into the receiver distal end a distance in the range of ⅛ inch to 0.99 inch, ⅛ inch to ½ inch, or more preferably ¼ to ½ inch, from the distal extremity of the receiver. See, for example, recoil lug distal surface 519' that in the portrayed receiver may be described as the distalmost extremity/end/transverse-plane end/surface.

Figure 30:
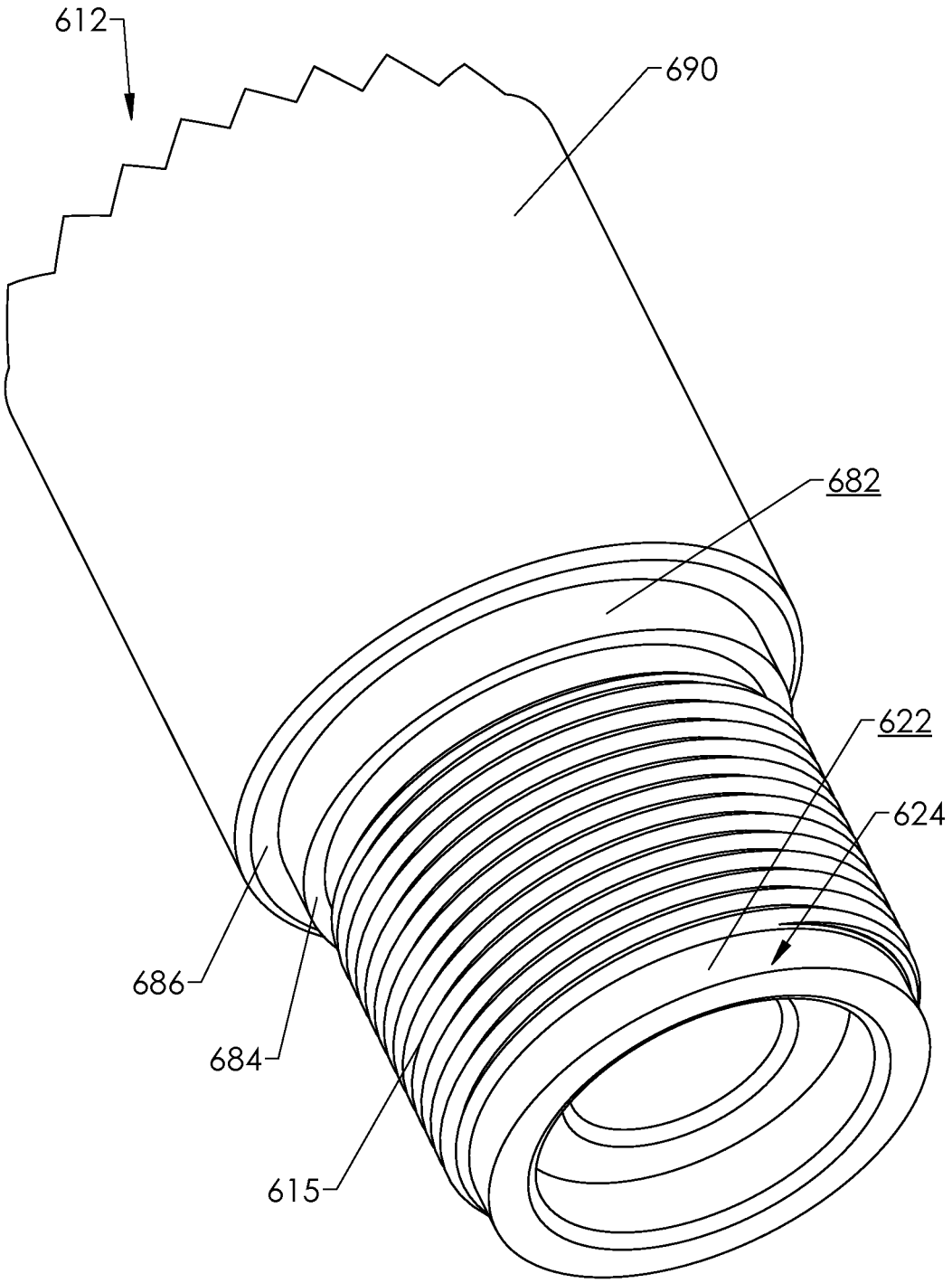
FIG. 30 is a perspective view of the proximal end of a barrel that has multiple outer axial mating surfaces adapted for extremely-tight-tolerance/press-it with the receiver of FIGS. 26-29.

Each of the mating surfaces 566 and 682 is preferably cylindrical and extending exactly axially and parallel to the longitudinal centerline axis of the receiver and barrel, respectively; for example, "exactly axially" in this context may mean precisely axially according to the best standards of high quality machining. Mating surface 682 is larger in diameter than the maximum diameter of the threaded region (615), and is smaller in diameter than the main body 690 of the barrel. Therefore, mating surface 682 is formed between a first shoulder 684 and a second shoulder 686, wherein the surface 682, first and second shoulders 684, 686, and the main body 690 are preferably all non-threaded, as illustrated in FIG. 30.

Figure 31:
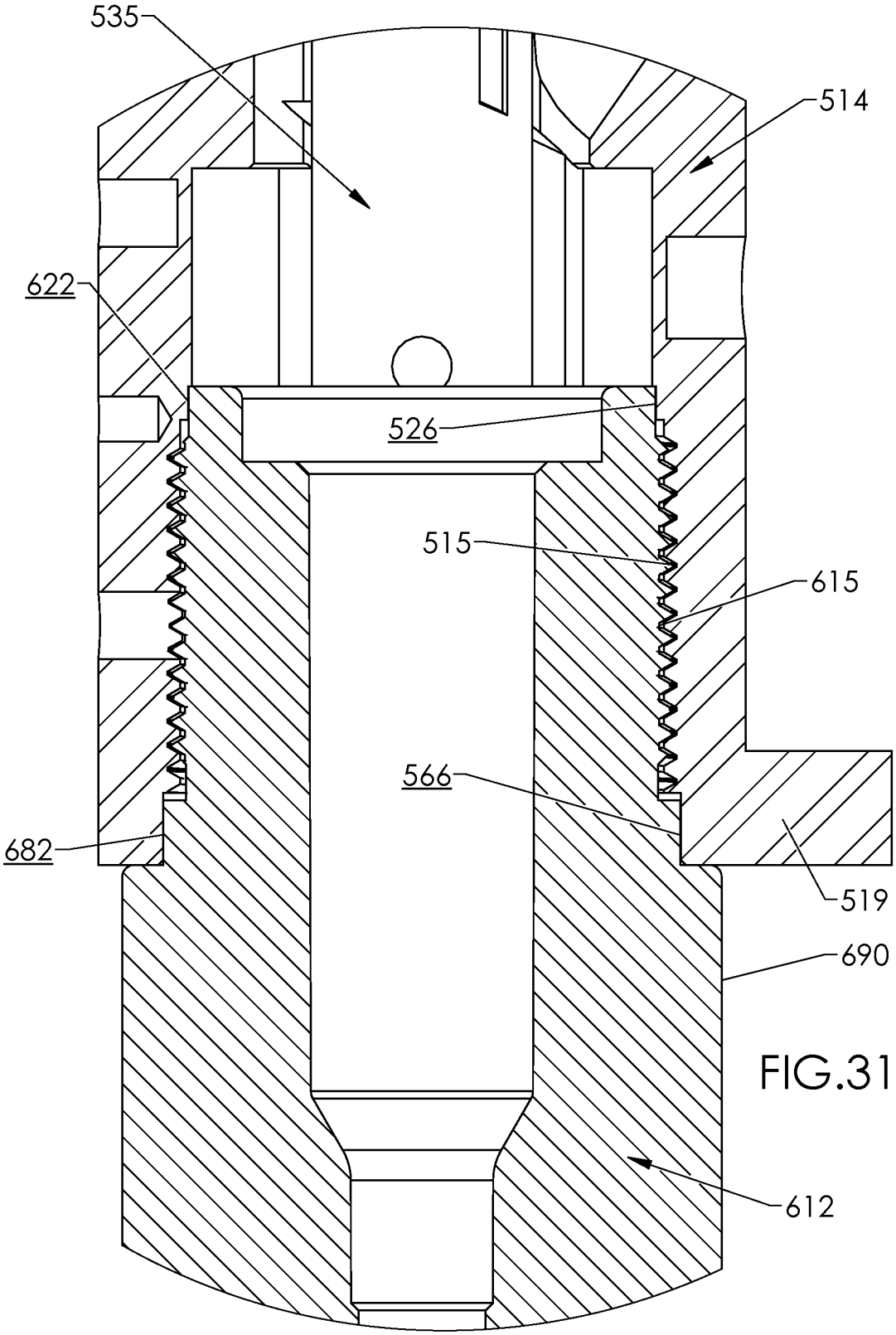
FIG. 31 is an detail axial cross-sectional view of the receiver of FIGS. 26-29 connected to the barrel of FIG. 30 by means of the threaded barrel connection means, wherein one may see the axial mating surfaces both proximal of the threads and distal of the threads in extremely-tight-tolerance/press-fit cooperation.

One may see to best advantage in FIGS. 31, how the relative diameters of mating surface 682, first shoulder 684, a second shoulder 686, and the main body 690 adapt the barrel to cooperate be insertable and rotatable into the receiver 514, to accomplish the threaded connection and also the mating of two sets of mating surfaces. While the threaded connection holds the barrel on the receiver, said mating of the sets of axial creates the highly accurate, coaxial alignment of the barrel 612 with the receiver 514 that persists even during firing, to resist the harmonic vibrations that tend to cause barrel whip, for example.

Preferably, the proximal tenon mating surface 622 mates with the receiver surface 526 or portions of the surface 526, and this mating may occur whether surface 526 is cylindrical, ramped/crested, or other shapes, as discussed above. Preferably, proximal mating receiver surface 526 will be a ramped/crest surface (an extension of the receiver's lug mating surface), and proximal mating tenon surface 622 will be cylindrical, as discussed elsewhere in this document. Preferably, the distal barrel mating surface 682 mates with receiver surface 566 or portions of the surface 566, and this mating may occur whether surface 566 is cylindrical, ramped/crested, or other shapes. Preferred embodiments of both surface 566 and surface 682 will be cylindrical, as ramping (such as preferred in the bolt lug rotation space 535, for mating with the lugs and for extending to have a portion that is surface 526) is not typically required in the barrel alignment space of the receiver.

While FIGS. 26-31 portray two sets of axial mating surfaces, one may understand from this discussion and the figures that one or more sets of axial mating surfaces may be used in certain embodiments, for example, 1, 2, 3 or more. Also, the set(s) of axial mating surfaces may be located in various locations, for example, proximal, distal, or both proximal and distal of the barrel-to-receiver connectors/connection-means, or even between portions of the connectors/connection-means.

While FIGS. 1-25 include example(s) of a proximal, axial, "tenon" structure that is inserted/rotated, given the threaded barrel connection means, into a receiver for tight-tolerance/pres s-fit mating with an axial surface of the receiver, FIGS. 26-31 include example(s) of the proximal tenon structure supplemented by a distal, axial "tenon" structure that is also inserted/rotated into the same receiver for tight-tolerance/press-fit mating with another/different axial surface of the receiver. The system of FIGS. 26-31 may be described as an example of a "multiple-tenon" system, for example, one in which two axial tenon surfaces are provided, one being of a larger diameter than the other. FIGS. 26-31 are an example of multiple tenons being provided, spaced apart from each other longitudinally/axially, with other structure between them. The other structure may be a connection means and/or other structure that does not interfere with both tenons being installed and mated with their respective mating structure in the receiver. During installation into the threaded receiver, the smaller diameter tenon surface extend/move into the receiver first, followed by the larger, distal one, with both mating with their respective axial surfaces upon full installation of the barrel.

The extremely tight-tolerance/press-fit mating of the sets of cooperating axial mating surfaces may be like the tolerances discussed above in this document, so that, when mated, the cooperating mating surfaces are preferably less than 0.004 inches from each other. For example, the distances between the cooperating mating surfaces may be selected from 0.0039, 0.002, 0.001, 0.0008, 0.0005, 0.0004, 0.0003, 0.0002, 0.0001 inches, or less, or alternatively any number of inches or ranges between these values. When any of the mating surfaces are ramped/crested, there may be larger spaces/distances between the receiver and barrel surfaces in the trough regions, as will be understood from FIGS. 1-25. Still, with troughs and crests present, the extremely tight-tolerance/press-fit mating with the crest portions will result in an excellent coaxial and concentric relationship of the barrel to the receiver as long as the crests are symmetrically-spaced around the circumference of the surface in which the troughs are crests are formed.

Figure 32:
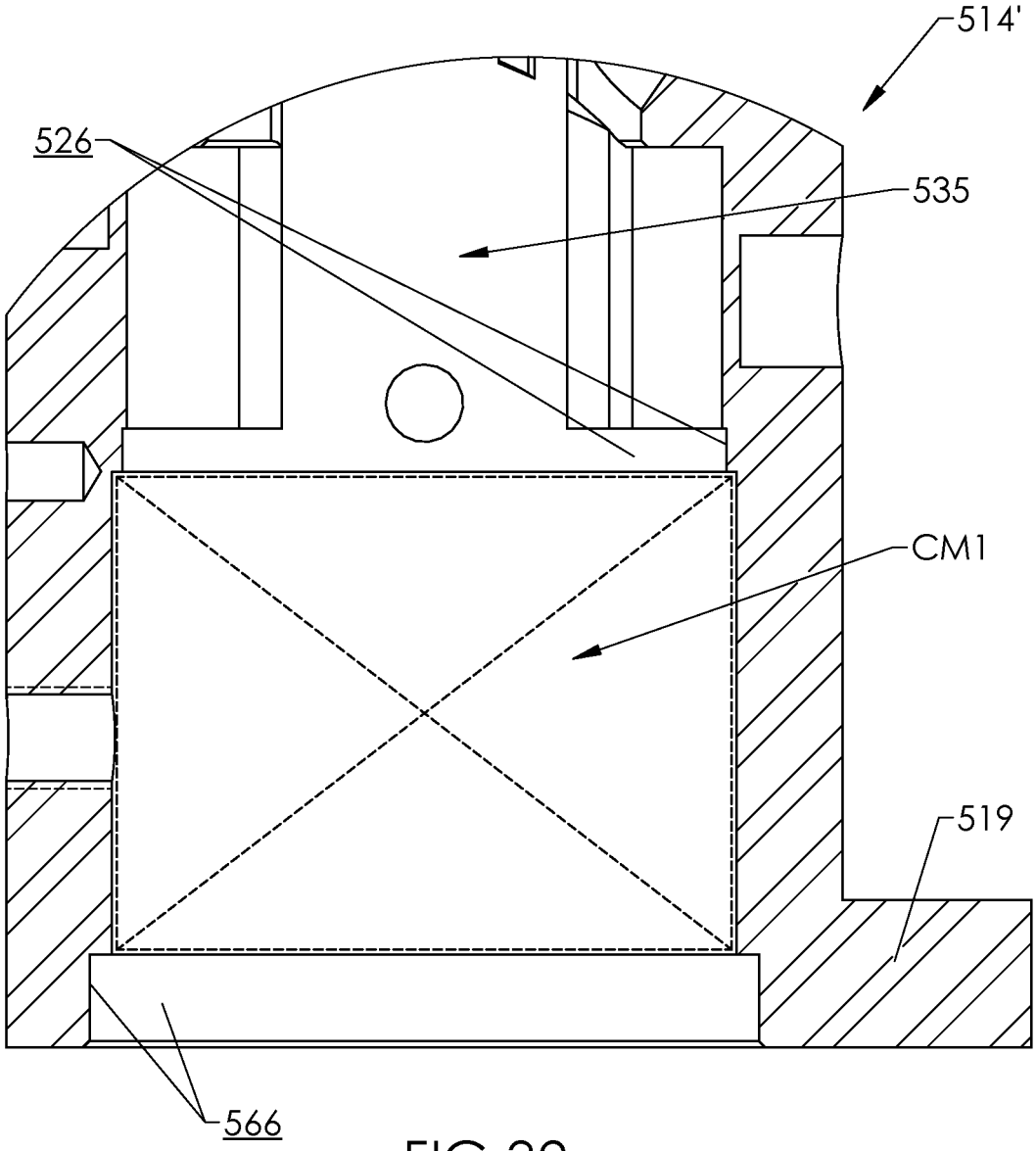
FIG. 32 is a cross-sectional view of a receiver such as that in FIGS. 26-29, but schematically illustrating that alternative connection means could use used in place of, or in addition to, threads.
Figure 33:
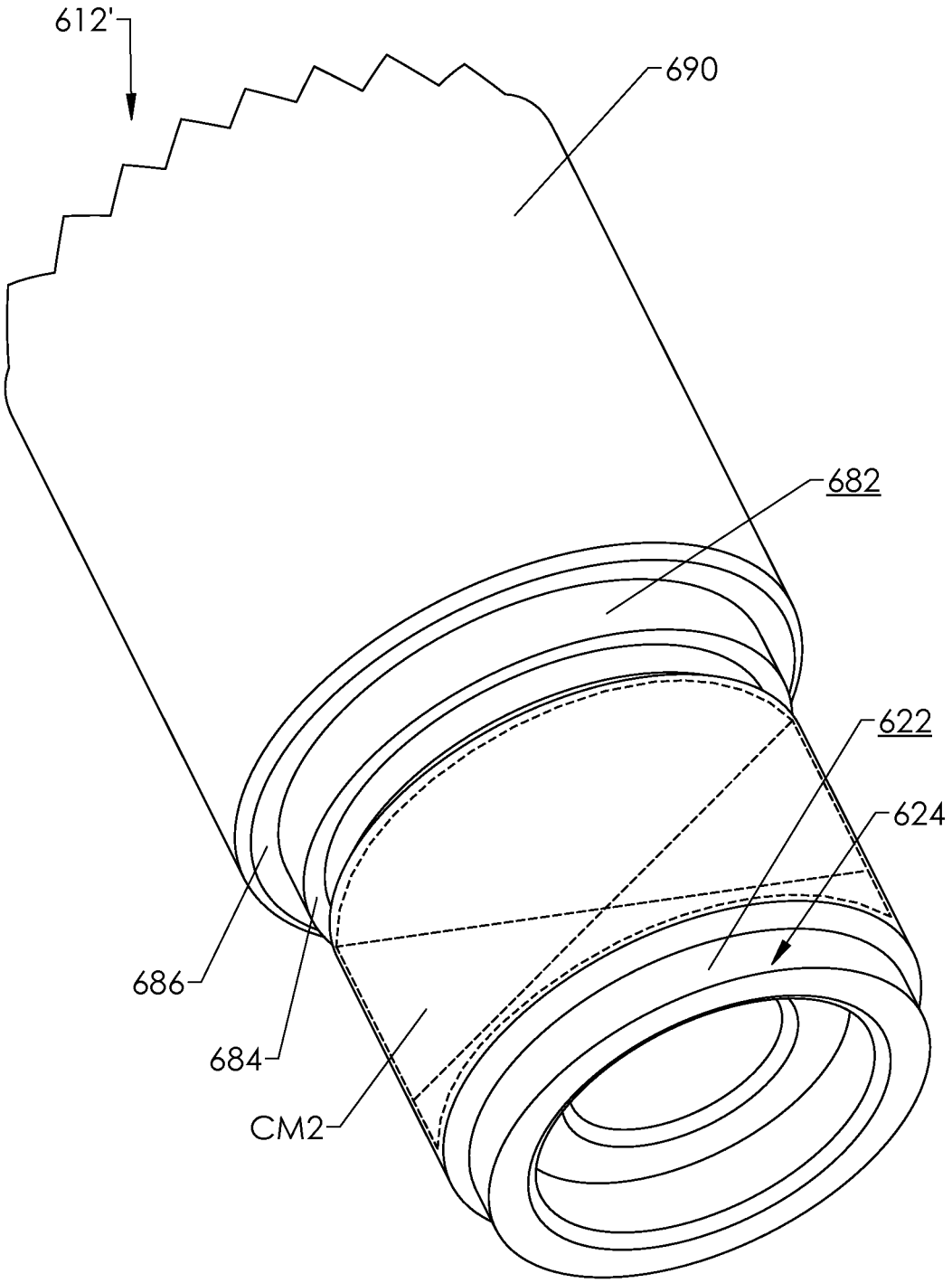
FIG. 33 is a perspective proximal end view of a barrel such as that in FIGS. 30 and 31, but illustrating schematically that alternative connection means could use used in place of, or in addition to, threads, for cooperation with the receiver of FIG. 32.

FIGS. 32 and 33 illustrate schematically that other barrel connectors/connection-means CM1, CM2 may be used in place of, or to supplement, threaded regions, for the barrel and receiver styles and firearms shown in the figures, but also for other barrels, receivers, and firearms. The receiver 514' and the barrel 612' in FIGS. 32 and 33 use generally the same reference numbers as FIGS. 26-31, illustrating that same or similar structures may be used with various connection means CM1, CM2 replacing threaded portions 515, 615. Conventional barrel connection means may be, for example, continuous threads such as shown in FIGS. 1-31, interrupted threads, bayonet(s), ramp(s) or cam lug(s), threaded or clamping collars/nuts in and/or around receiver and barrel portions, and/or other detachable or permanent connectors/fasteners, and combinations thereof.

FIGS. 32 and 33 also include example(s) of the proximal tenon structure supplemented by a distal, axial "tenon" structure. The distal, axial tenon structure is also installed as part of the barrel, for example, by insertion, rotation, clamping, twisting or other installation motions depending on what type of connection means is used, into the same receiver as is the proximal tenon, for tight-tolerance/press-fit mating with another/different axial surface of the receiver. The system of FIGS. 32 and 33 may be described as an example of a "multiple-tenon" system, for example, one in which two axial tenon surfaces are provided, one being of a larger diameter than the other. FIGS. 32 and 33 are an example of multiple tenons being provided, spaced apart from each other longitudinally/axially, with other structure between them. The other structure may be a connection means and/or other structure that does not interfere with both tenons being installed and mated with their respective mating structure in the receiver. During installation, the smaller diameter tenon surface extend/move into the receiver first, followed by the larger, distal one, with both mating with their respective axial surfaces upon full installation of the barrel.

Figure 34:
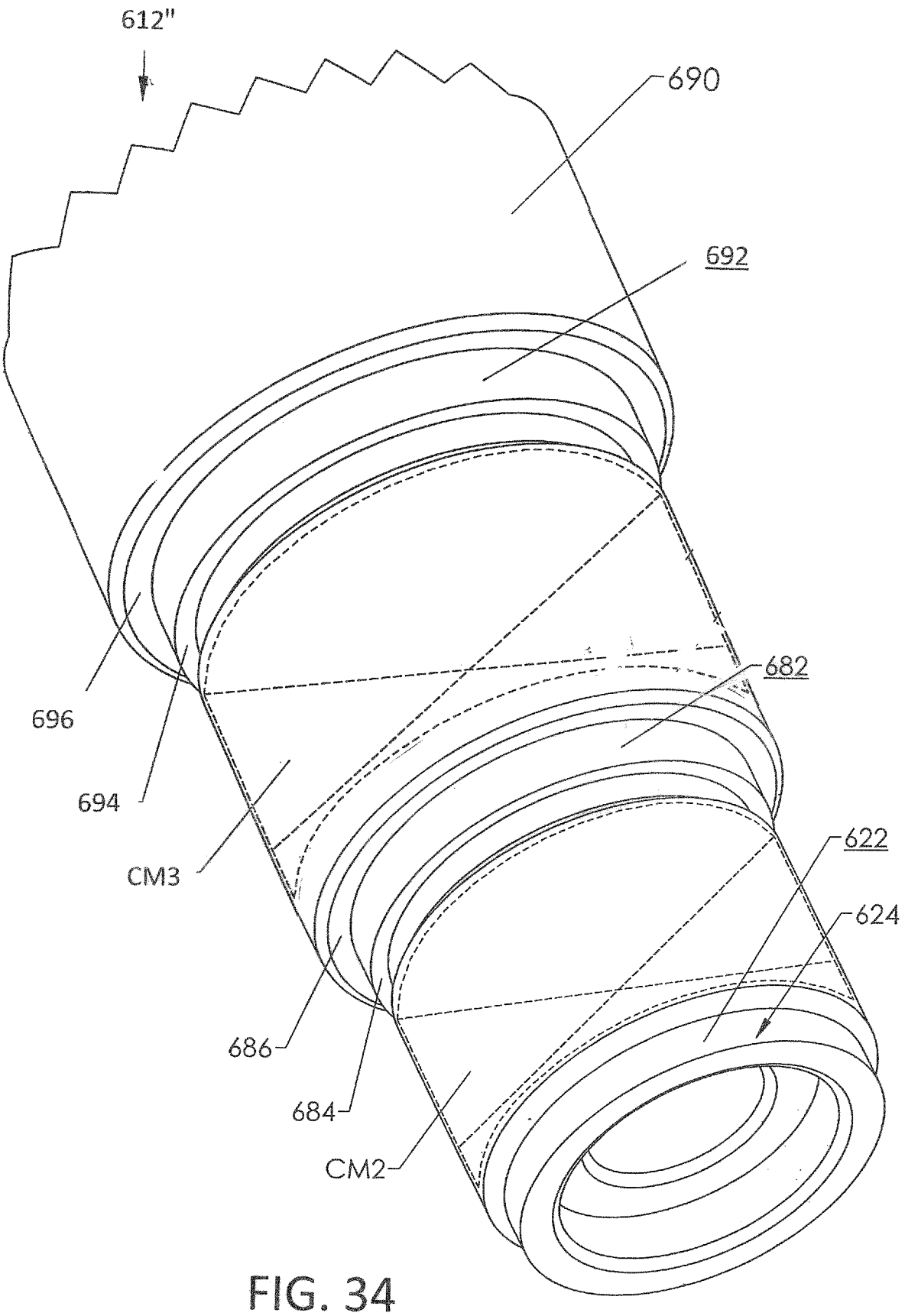
FIG. 34 is a perspective proximal end view of an alternative barrel that is like those in FIGS. 30-32 but illustrating schematically that multiple connection means or portions of connection means may be provided along the length of the barrel, with outer axial mating surfaces at each end of each connection means/portion, and/or with an outer axial mating surface in-between two of the connection means/portions of connection means.
Figure 38:
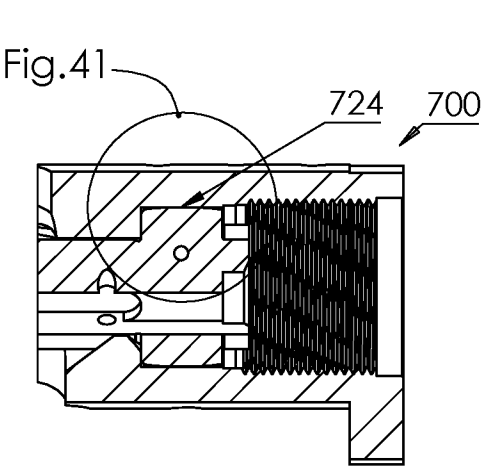
FIG. 38 is a cross-sectional view of the distal portion of the receiver and bolt along the line 38-38 in FIG. 36.
Figure 39:
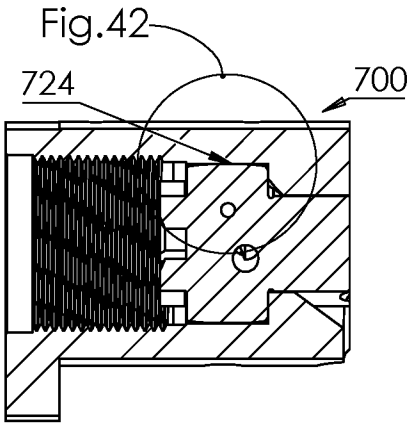
FIG. 39 is a cross-sectional view of the distal portion of the receiver and bolt along the line 39-39 in FIG. 36.
Figure 37:
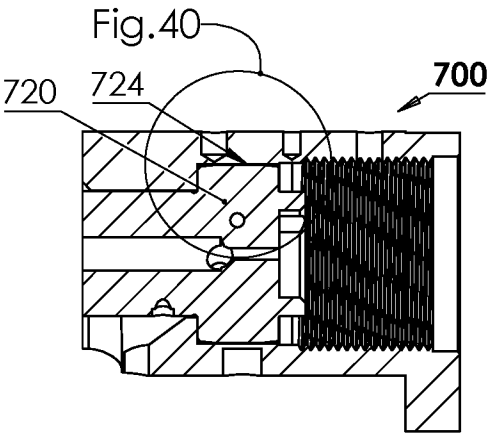
FIG. 37 is a cross-sectional view of the distal portion of the receiver and bolt along the line 37-37 in FIG. 36.
Figure 35:
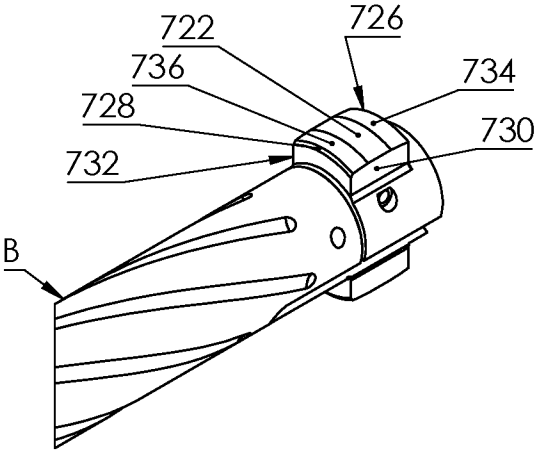
FIG. 35 is an isometric view of the distal portion of a bolt having bolt lugs adapted to have an axially non-linear outermost surface that is one embodiment of an axially-convex surface.
Figure 36:
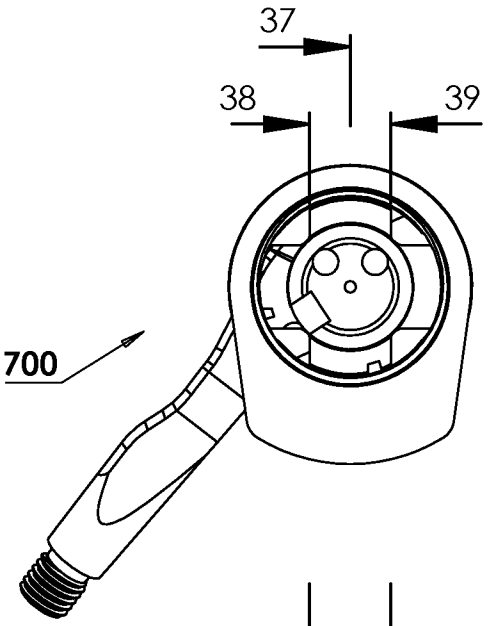
FIG. 36 is a distal end view of an assembled receiver and the bolt of FIG. 35, adapted according to certain embodiments of the invention, wherein the axial-non-linearity creates space, when the bolt is in the distal, loaded position, between smaller-diameter regions of the outermost surface of the lug and the axial receiver inner surface, to hold/accommodate debris/elements that have entered the receiver from the environment and prevent debris/elements from interfering with bolt rotation or mating/alignment in the receiver.
Figure 36:
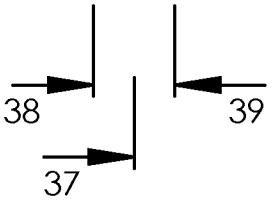
Figure 40:
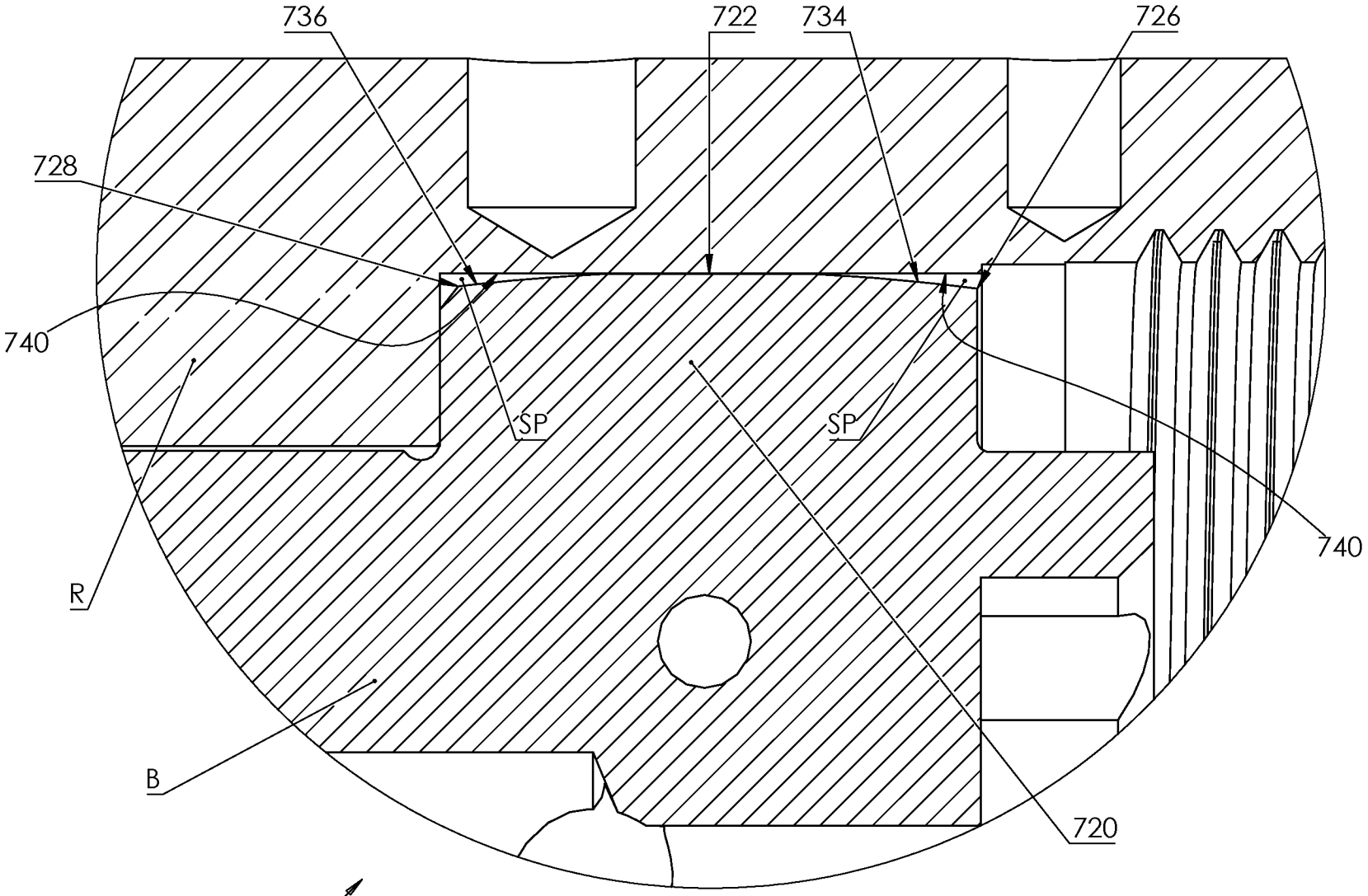
FIG. 40 is an enlargement of the area circled in FIG. 37.
Figure 41:
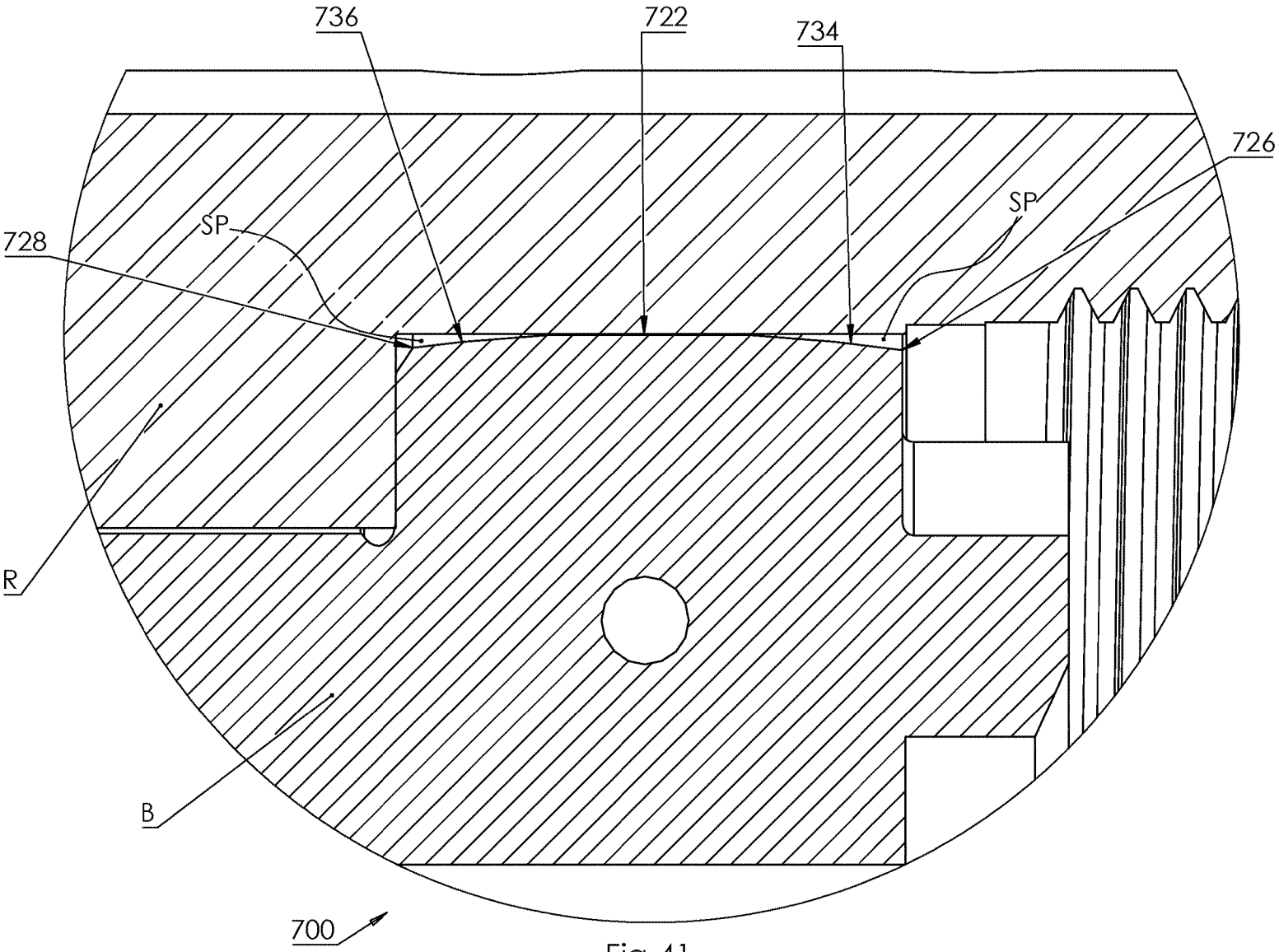
FIG. 41 is an enlargement of the area circled in FIG. 38.
Figure 42:
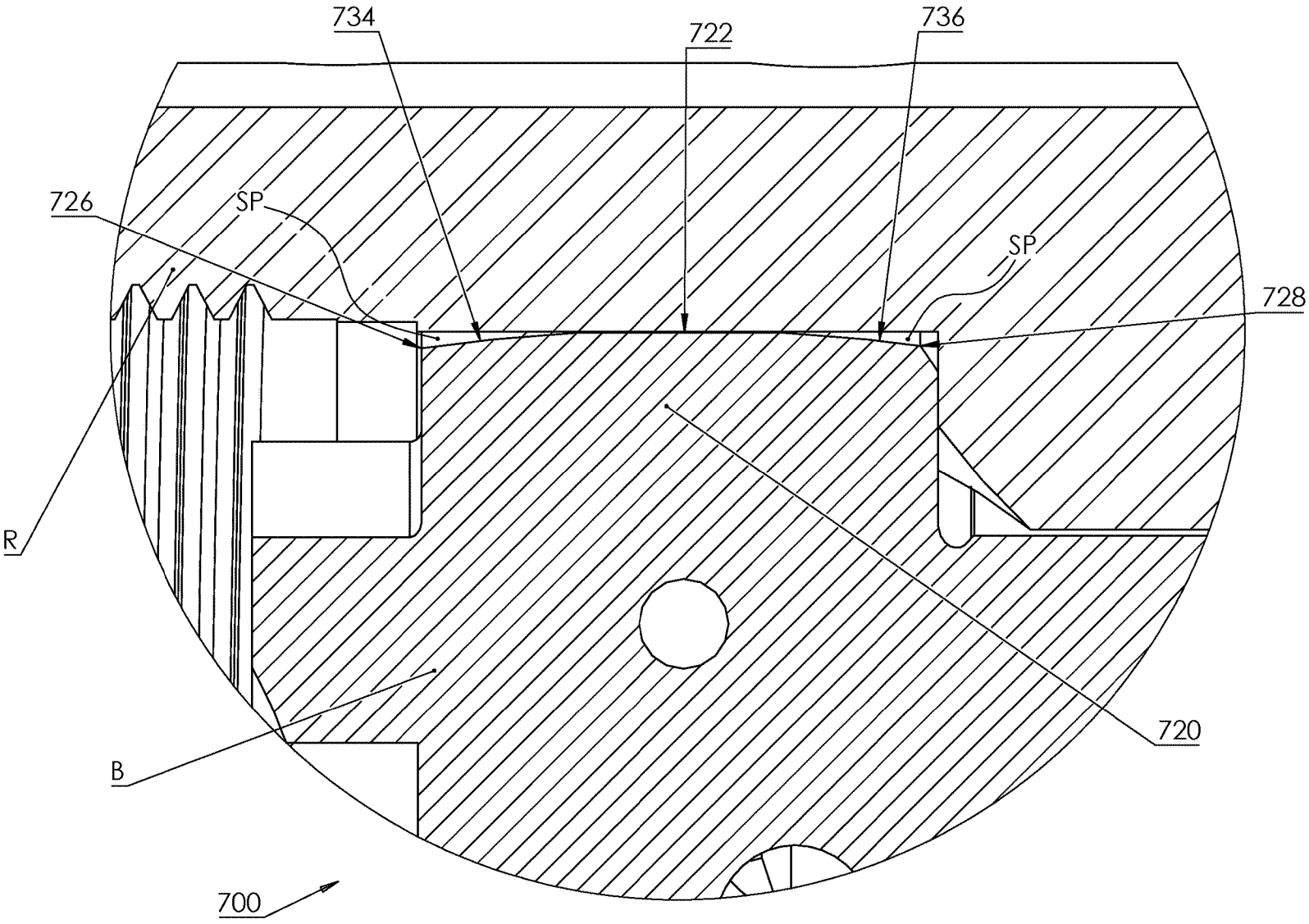
FIG. 42 is an enlargement of the area circled in FIG. 39.
Figure 46:
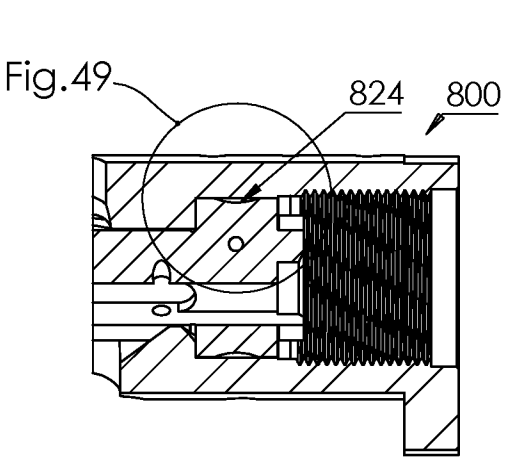
FIG. 46 is a cross-sectional view of the distal portion of the receiver and bolt along the line 46-46 in FIG. 44.
Figure 47:
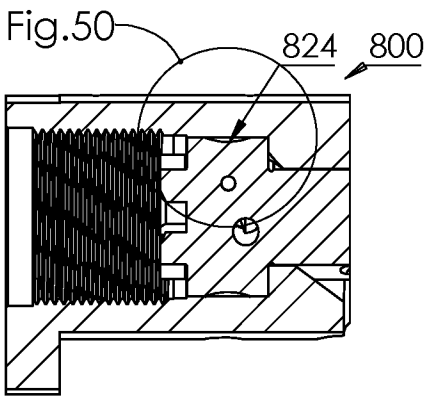
FIG. 47 is a cross-sectional view of the distal portion of the receiver and bolt along the line 47-47 in FIG. 44.
Figure 45:
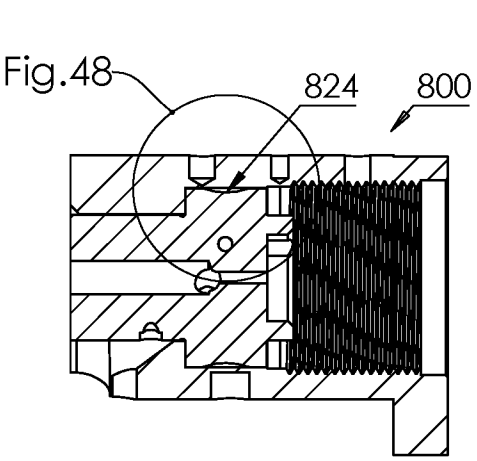
FIG. 45 is a cross-sectional view of the distal portion of the receiver and bolt along the line 45-45 in FIG. 44.
Figure 43:
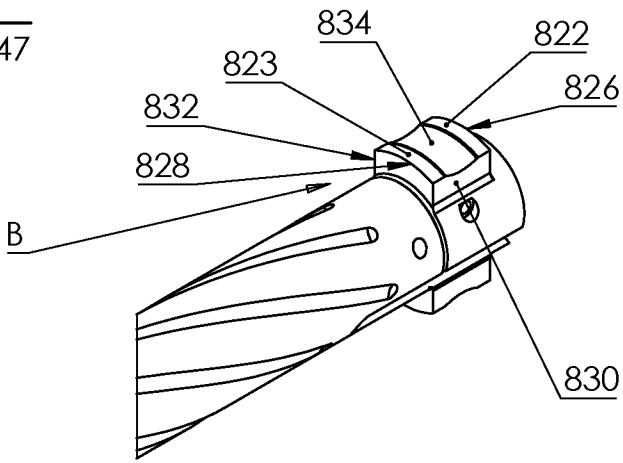
FIG. 43 is an isometric view of the distal portion of a bolt having bolt lugs adapted to have an axially-non-linear outermost surface that is one embodiment of an axially-concave surface.
Figure 44:
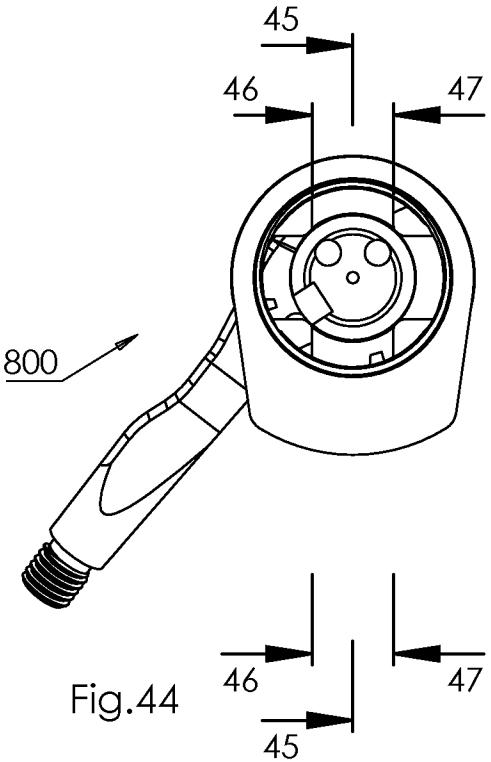
FIG. 44 is a distal end view of an assembled receiver and the bolt of FIG. 43, adapted according to certain embodiments of the invention, wherein the axial-non-linearity creates space, when the bolt is in the distal, loaded position, between a smaller-diameter region of the outermost surface of the lug and the axial receiver inner surface, to hold/accommodate debris/elements that have entered the receiver from the environment and prevent debris/elements from interfering with bolt rotation or mating/alignment in the receiver.
Figure 48:
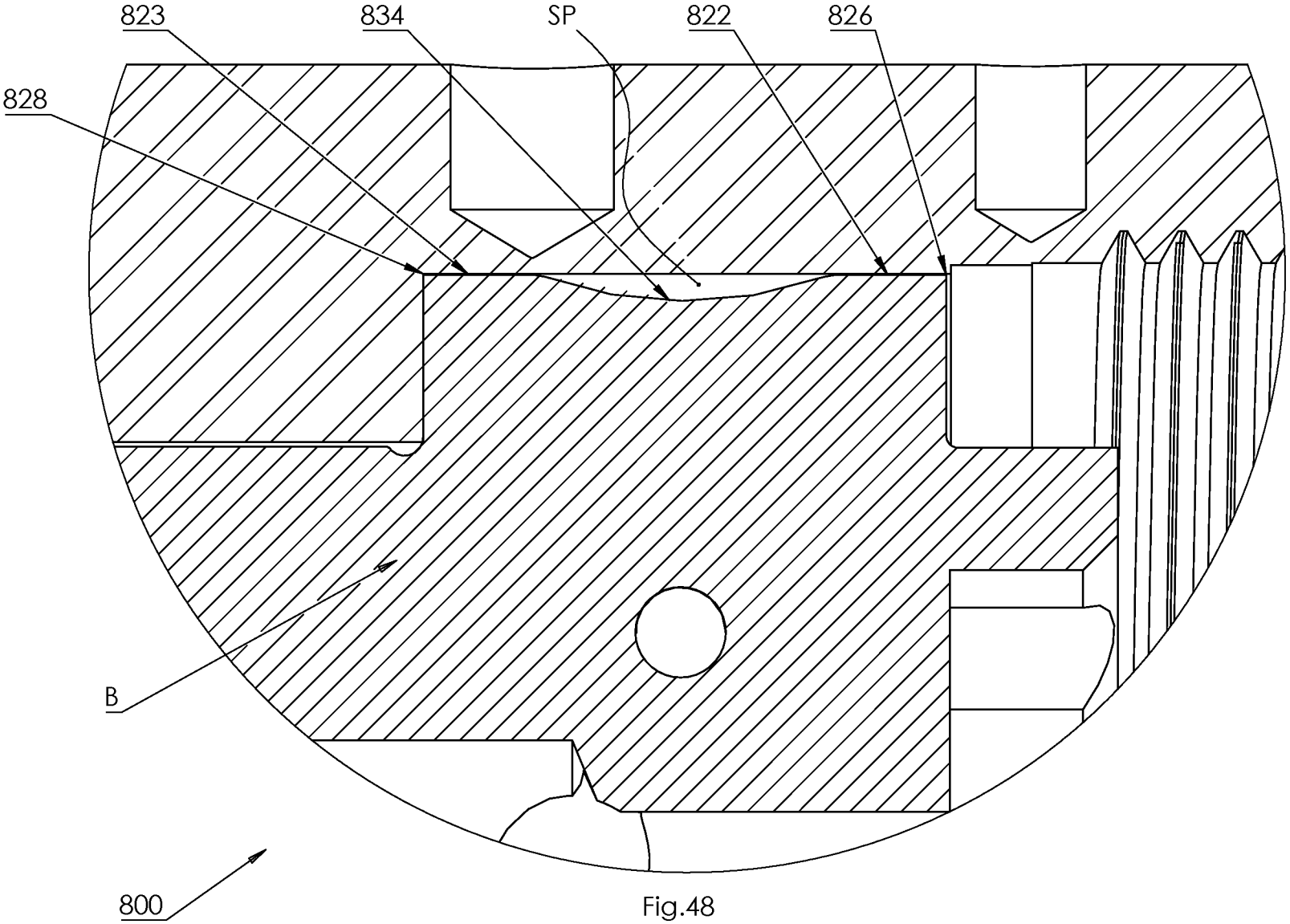
FIG. 48 is an enlargement of the area circled in FIG. 45.
Figure 49:
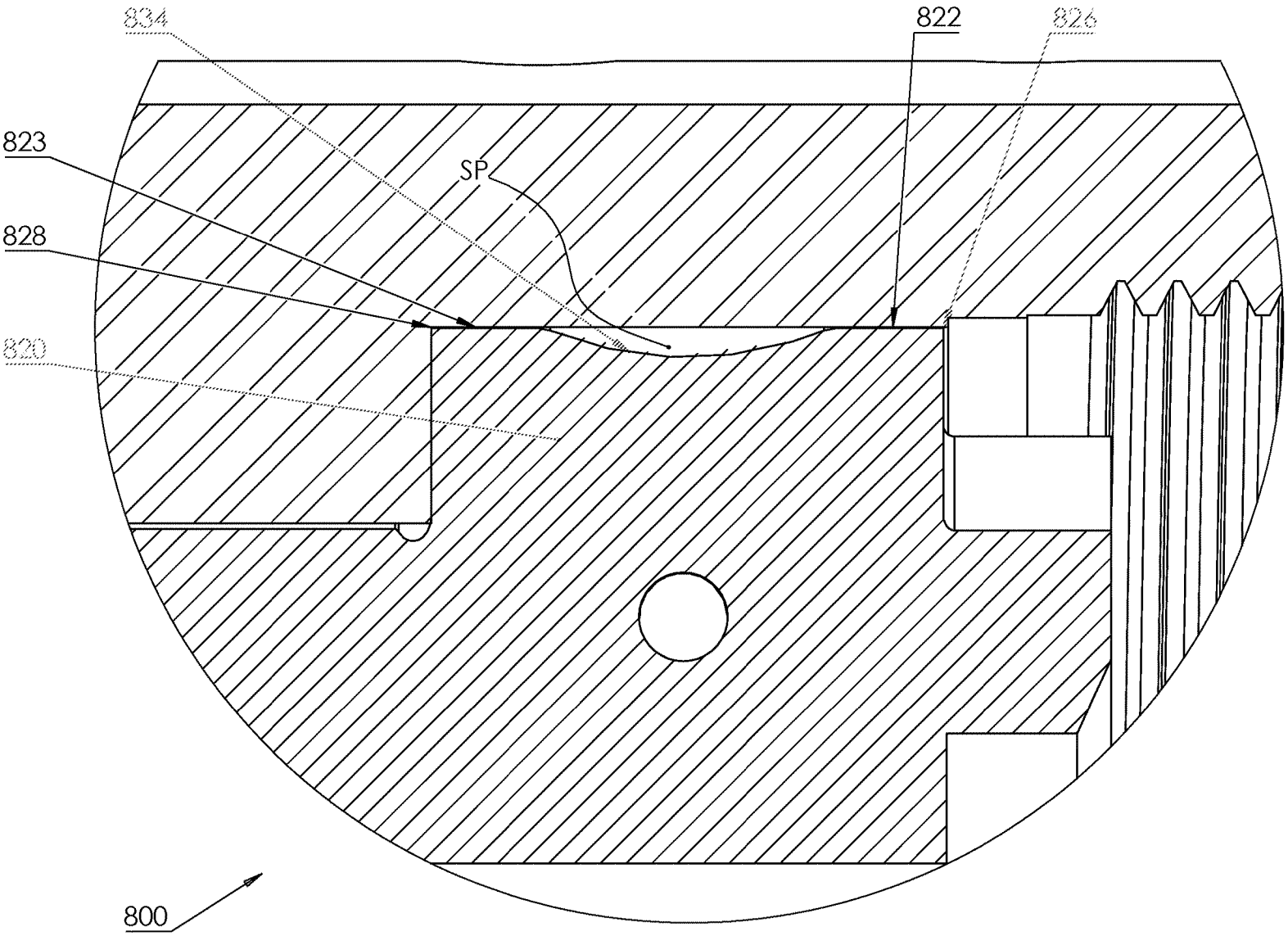
FIG. 49 is an enlargement of the area circled in FIG. 46.
Figure 50:
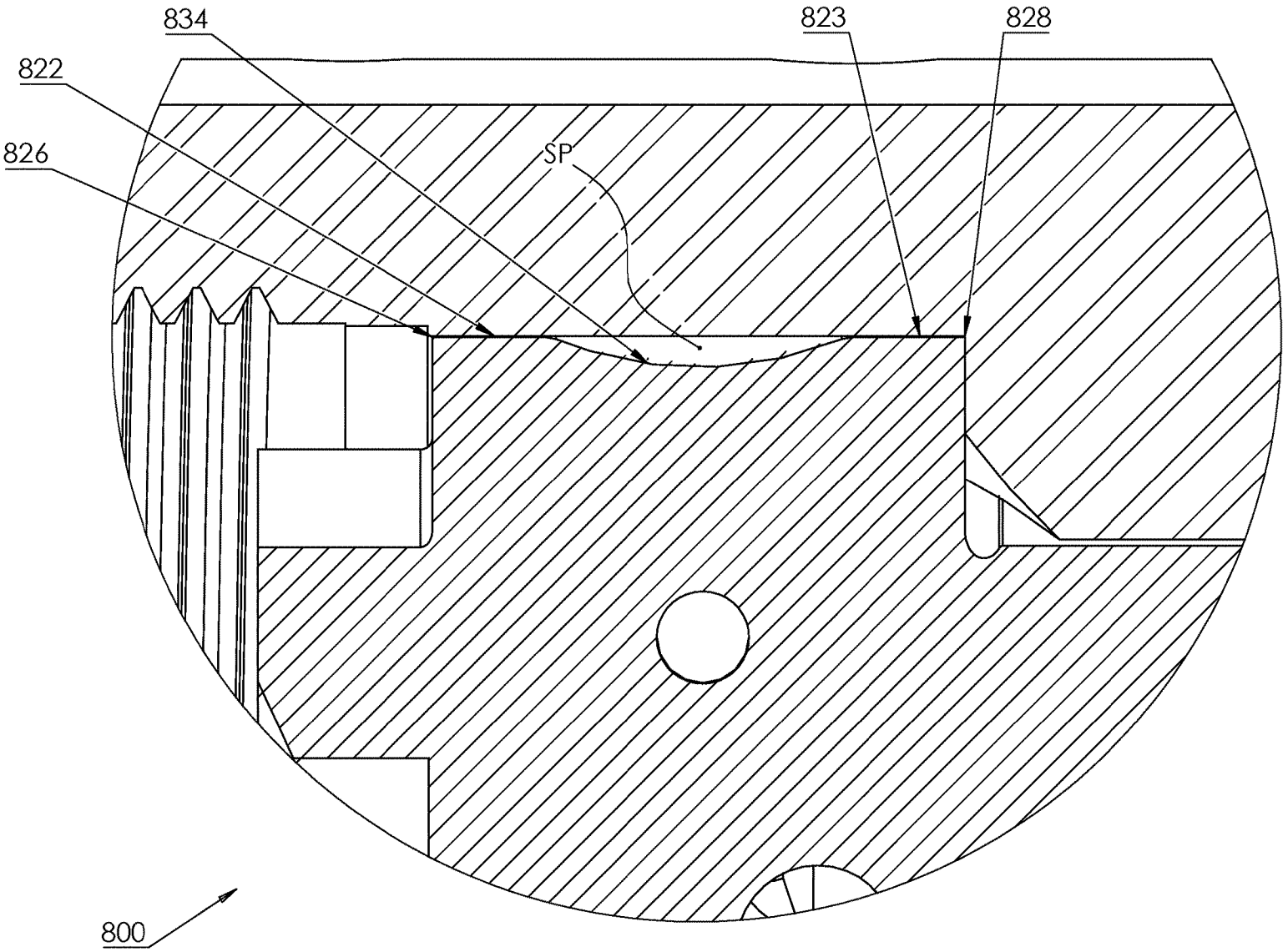
FIG. 50 is an enlargement of the area circled in FIG. 47.
Figure 56:
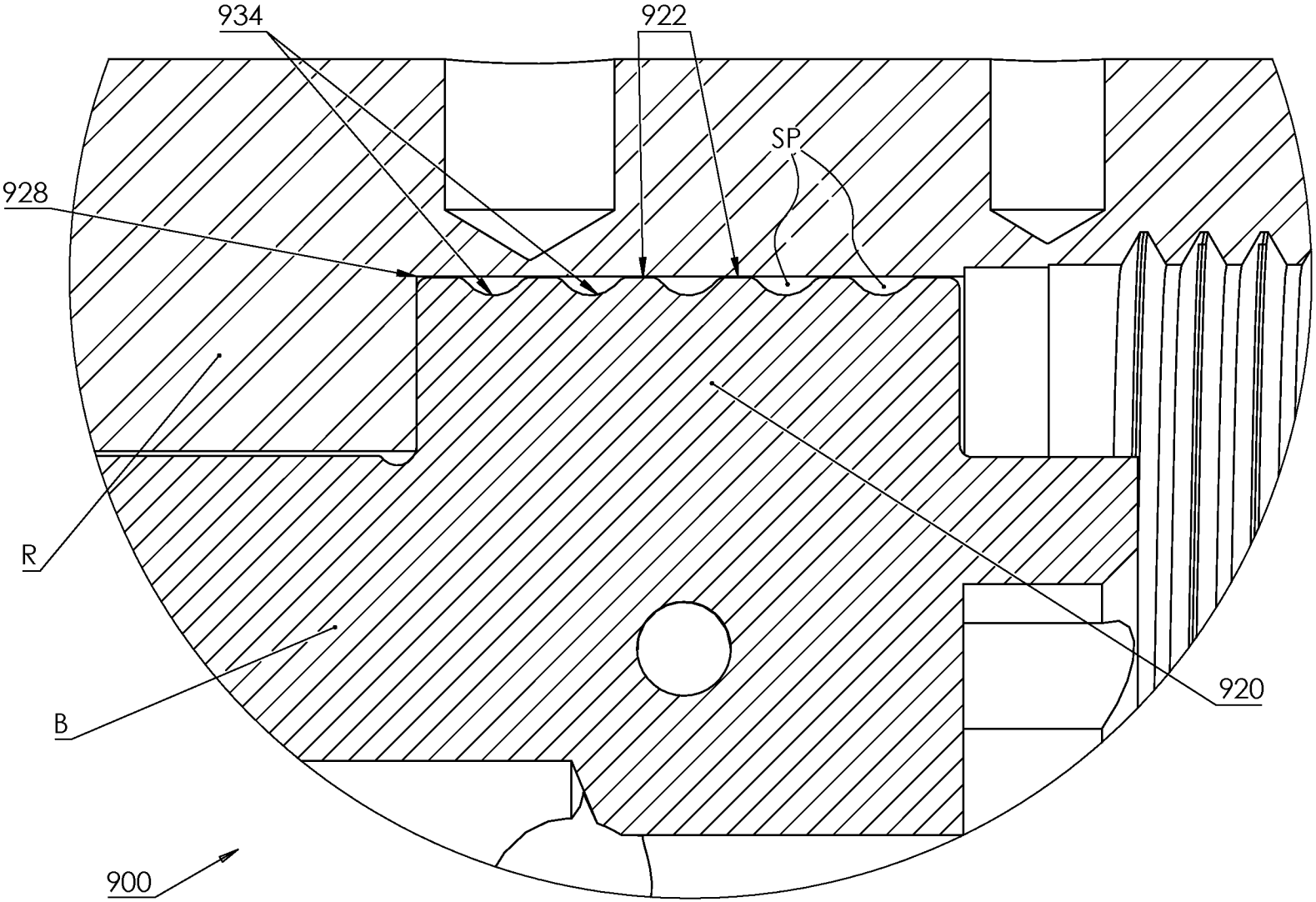
FIG. 56 is an enlargement of the area circled in FIG. 53.
Figure 57:
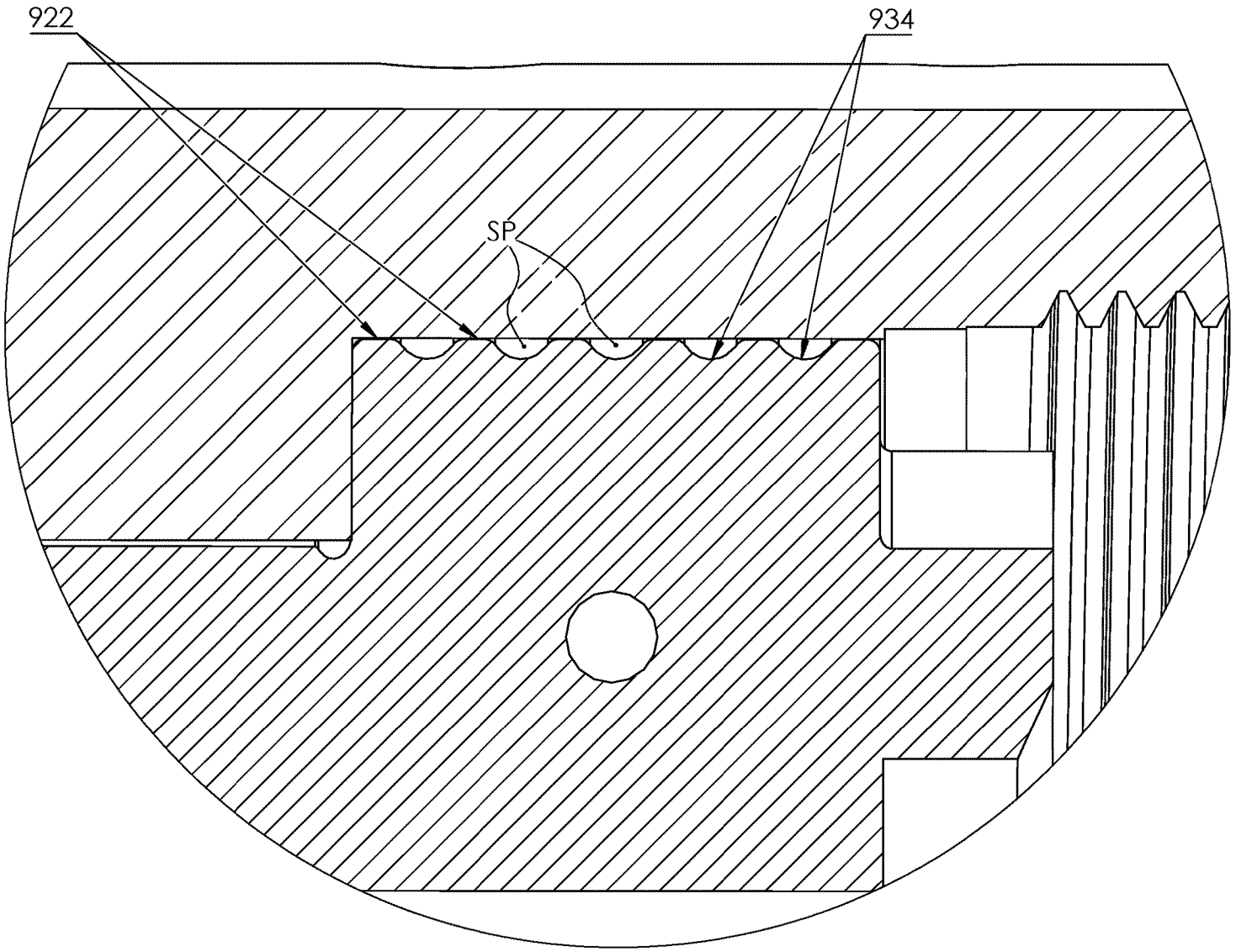
FIG. 57 is an enlargement of the area circled in FIG. 54.
Figure 58:
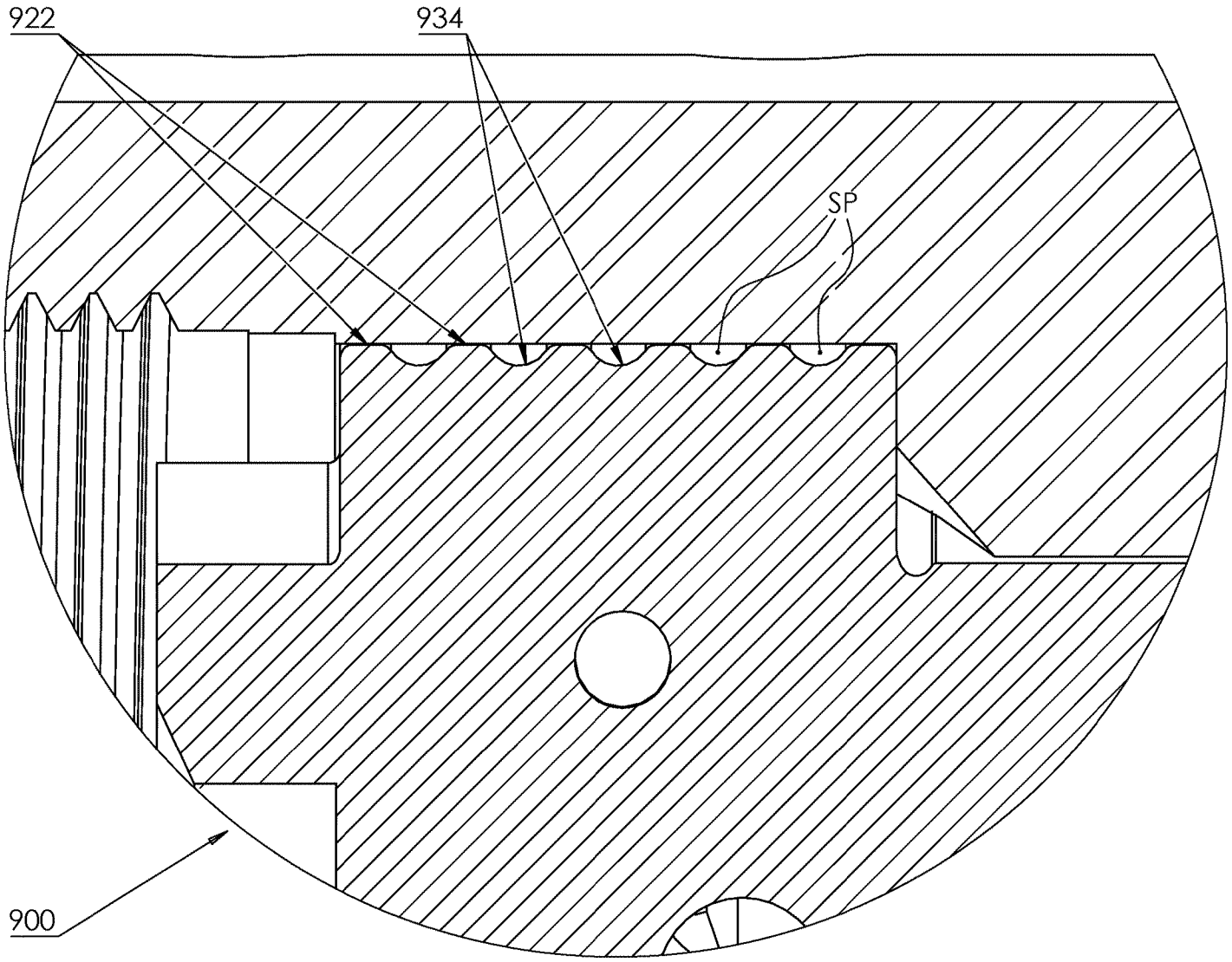
FIG. 58 is an enlargement of the area circled in FIG. 55.
Figure 62:
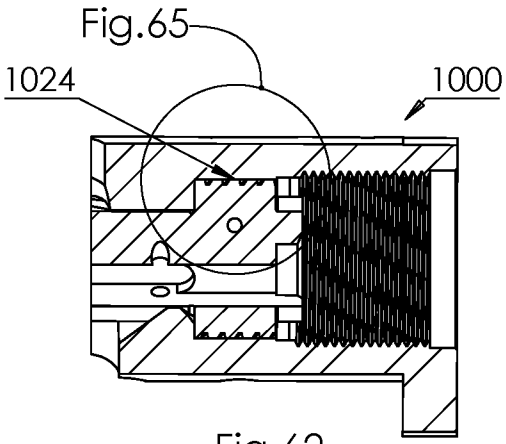
FIG. 62 is a cross-sectional view of the distal portion of the receiver and bolt along the line 62-62 in FIG. 60.
Figure 63:
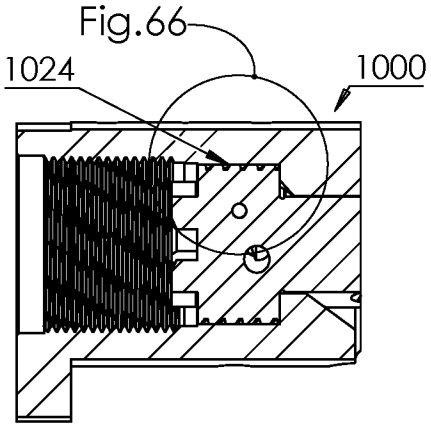
FIG. 63 is a cross-sectional view of the distal portion of the receiver and bolt along the line 63-63 in FIG. 60.
Figure 61:
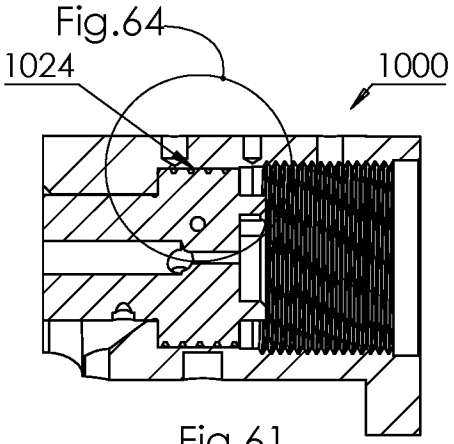
FIG. 61 is a cross-sectional view of the distal portion of the receiver and bolt along the line 61-61 in FIG. 60.
Figure 59:
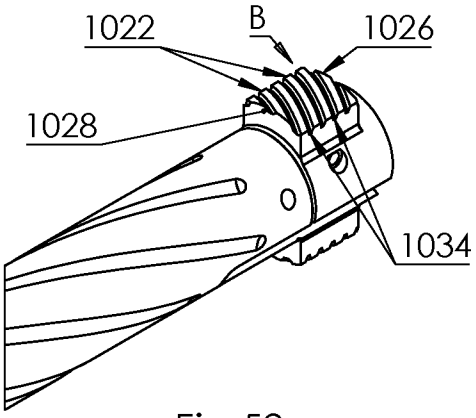
FIG. 59 is an isometric view of the distal portion of a bolt having bolt lugs adapted to have an axially non-linear outermost surface that is another embodiment having multiple ridges and multiple recesses between the ridges, wherein the ridges and recesses extend at an angle in the range of 65-80 degrees relative to the longitudinal axis of the bolt.
Figure 60:
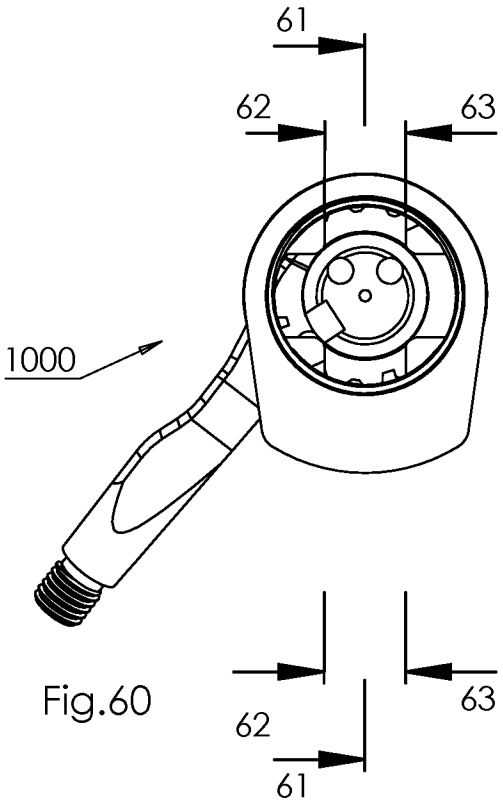
FIG. 60 is a distal end view of an assembled receiver and the bolt of FIG. 59, adapted according to certain embodiments of the invention, wherein the axial-non-linearity creates space, when the bolt is in the distal, loaded position, between a smaller-diameter region of the outermost surface of the lug and the axial receiver inner surface, to hold/accommodate debris/elements that have entered the receiver from the environment and prevent debris/elements from interfering with bolt rotation or mating/alignment in the receiver.
Figure 64:
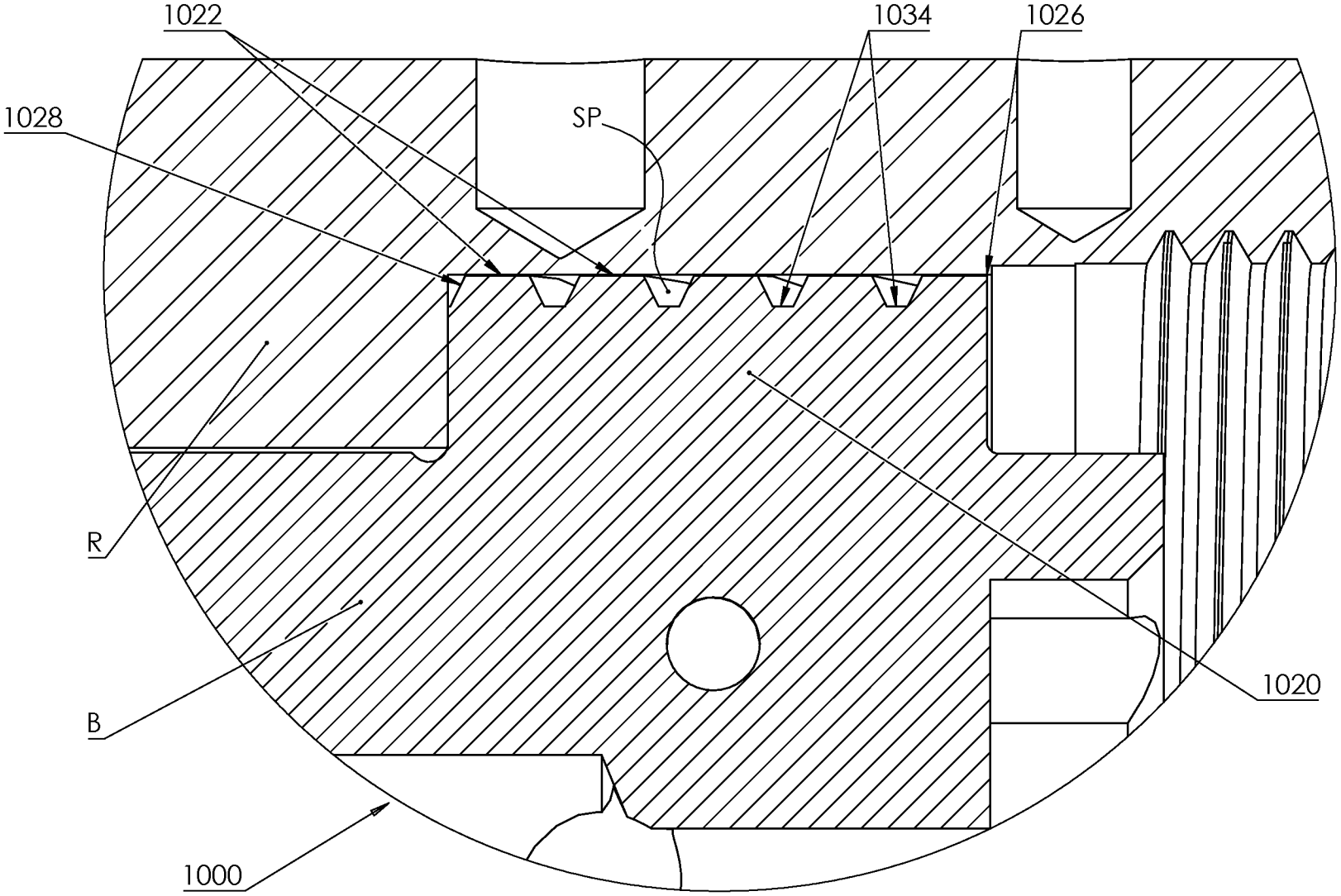
FIG. 64 is an enlargement of the area circled in FIG. 61.
Figure 65:
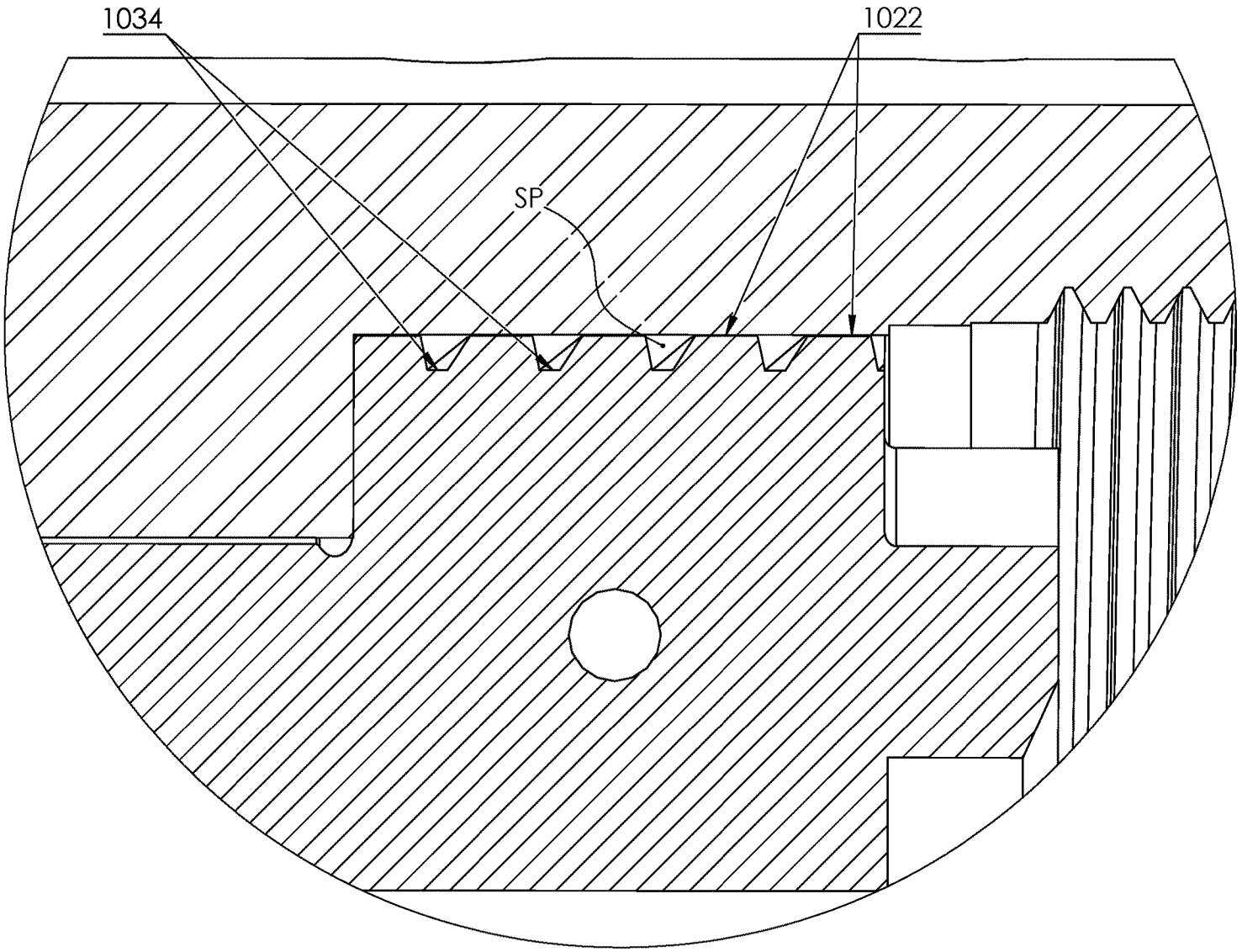
FIG. 65 is an enlargement of the area circled in FIG. 62.
Figure 66:
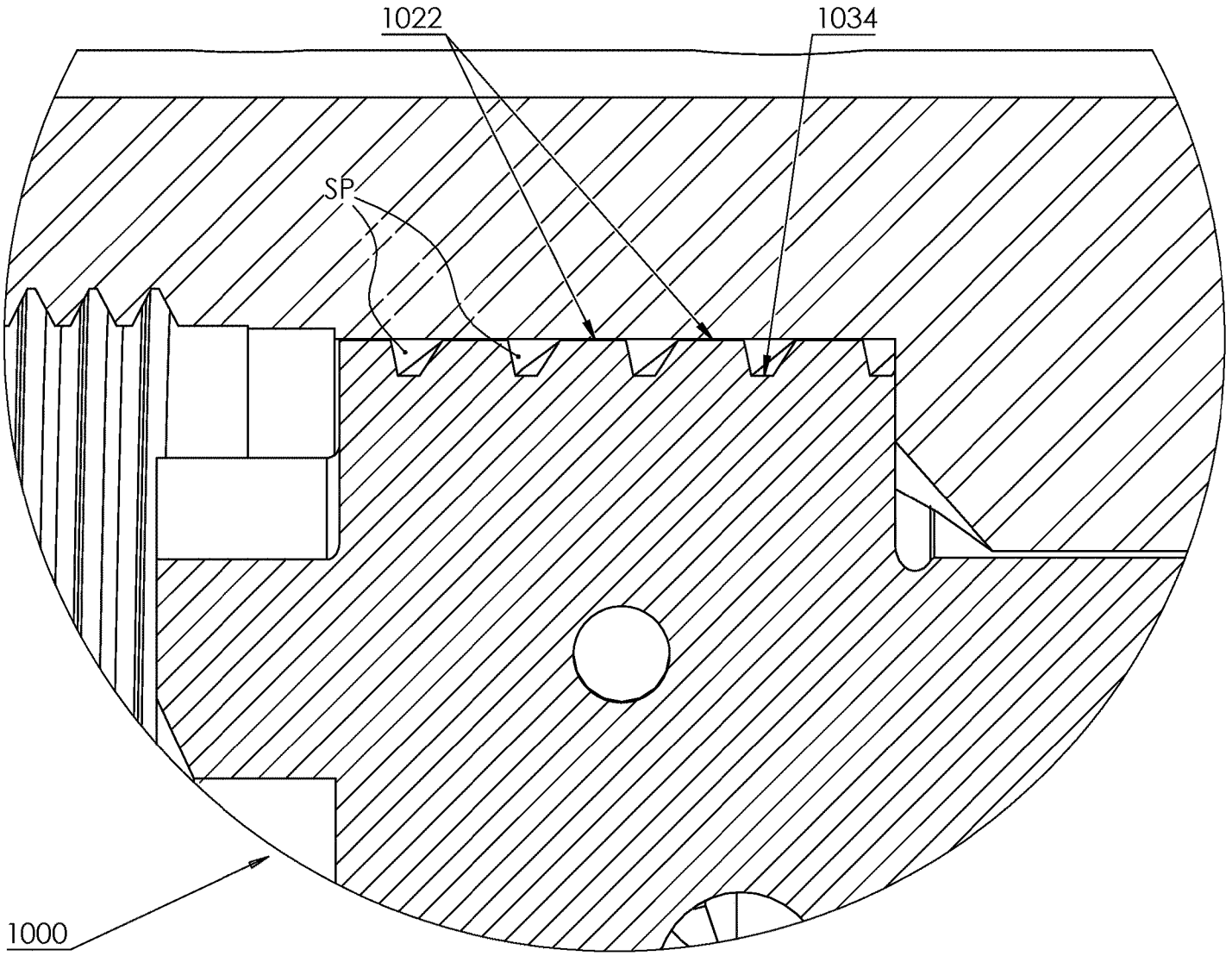
FIG. 66 is an enlargement of the area circled in FIG. 63.
Figure 70:
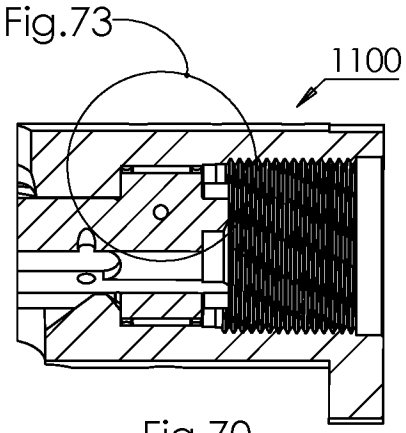
FIG. 70 is a cross-sectional view of the distal portion of the receiver and bolt along the line 70-70 in FIG. 68.
Figure 71:
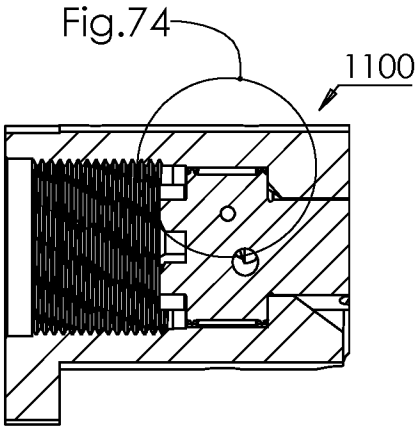
FIG. 71 is a cross-sectional view of the distal portion of the receiver and bolt along the line 71-71 in FIG. 68.
Figure 69:
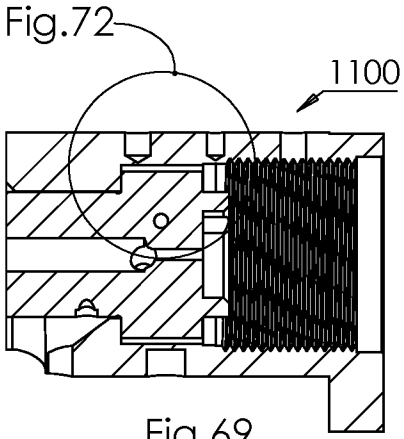
FIG. 69 is a cross-sectional view of the distal portion of the receiver and bolt along the line 69-69 in FIG. 68.
Figure 67:
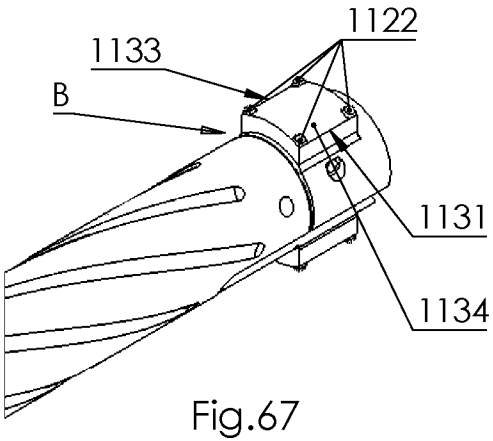
FIG. 67 is an isometric view of the distal portion of a bolt having bolt lugs adapted to have an axially non-linear outermost surface that is an embodiment having protrusions at the four corners of the outermost surface.
Figure 68:
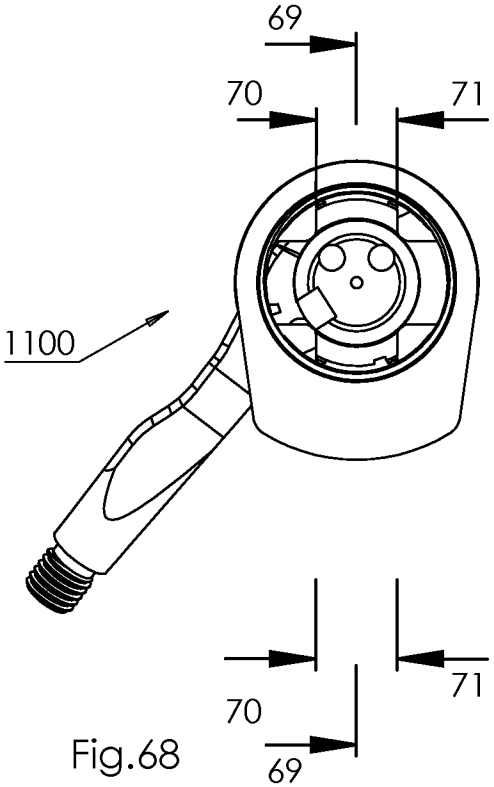
FIG. 68 is a distal end view of an assembled receiver and the bolt of FIG. 67, adapted according to certain embodiments of the invention, wherein the axial-non-linearity creates space, when the bolt is in the distal, loaded position, between a smaller-diameter region of the outermost surface of the lug and the axial receiver inner surface, to hold/accommodate debris/elements that have entered the receiver from the environment and prevent debris/elements from interfering with bolt rotation or alignment in the receiver.
Figure 72:
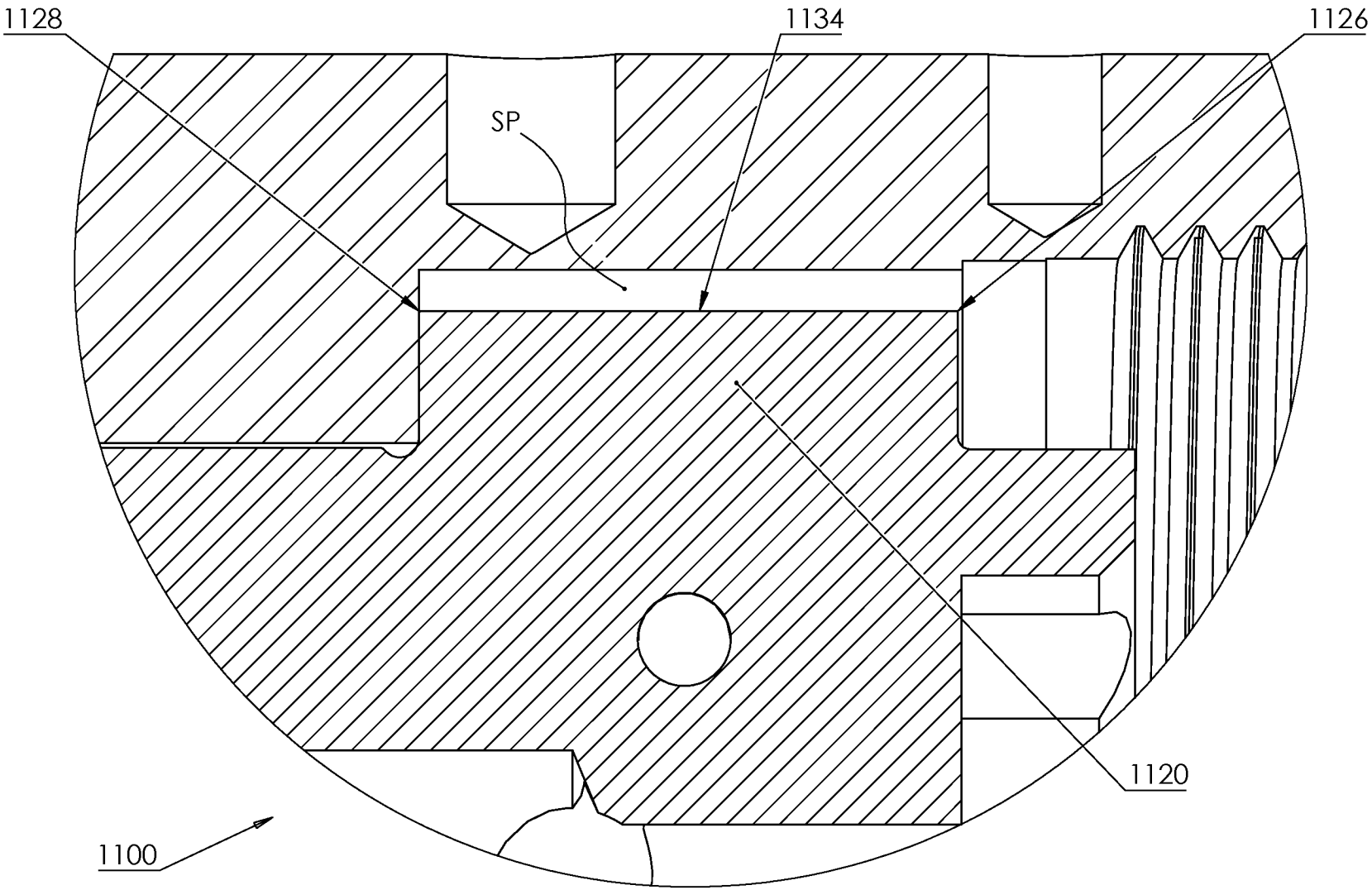
FIG. 72 is an enlargement of the area circled in FIG. 69.
Figure 73:
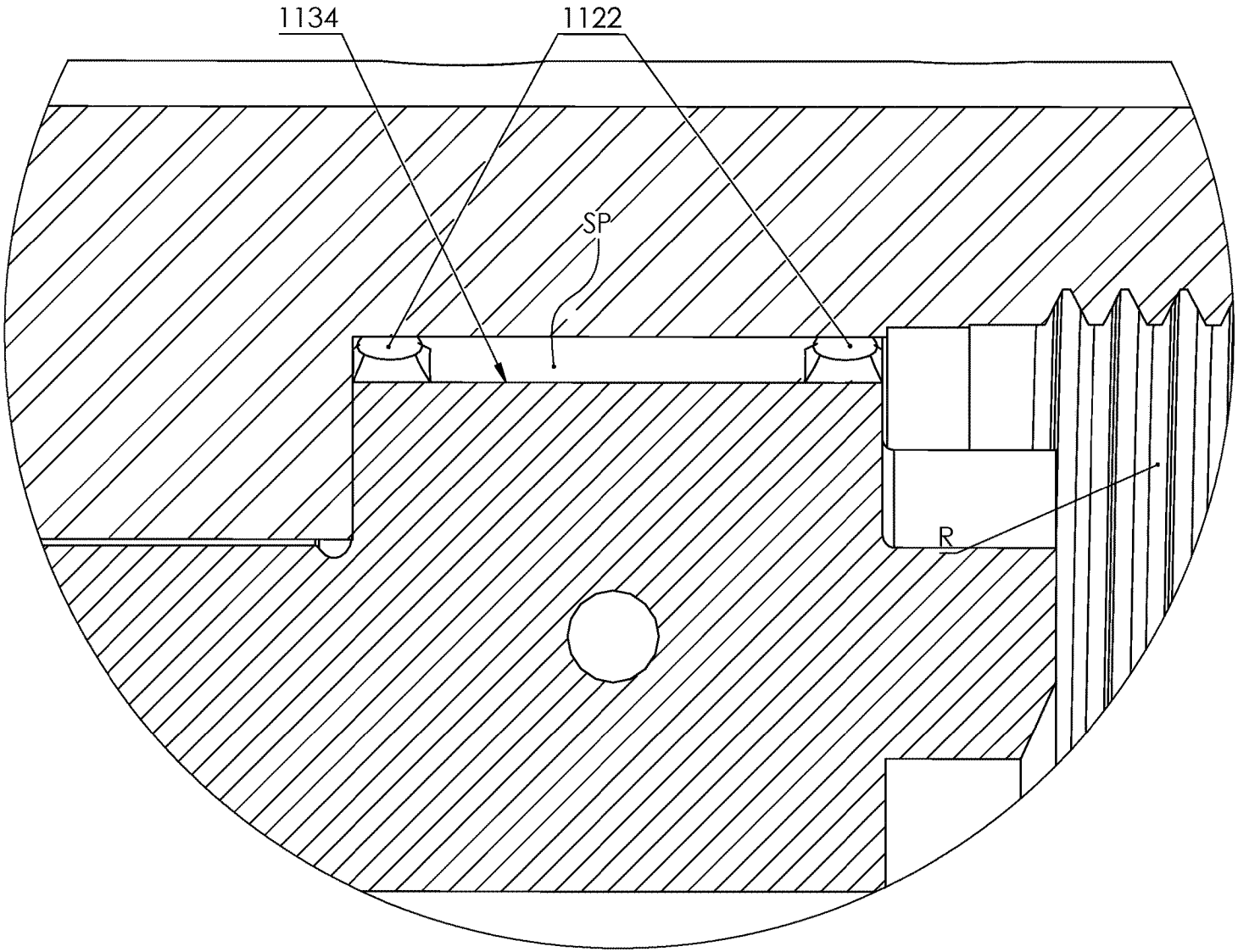
FIG. 73 is an enlargement of the area circled in FIG. 70.
Figure 74:
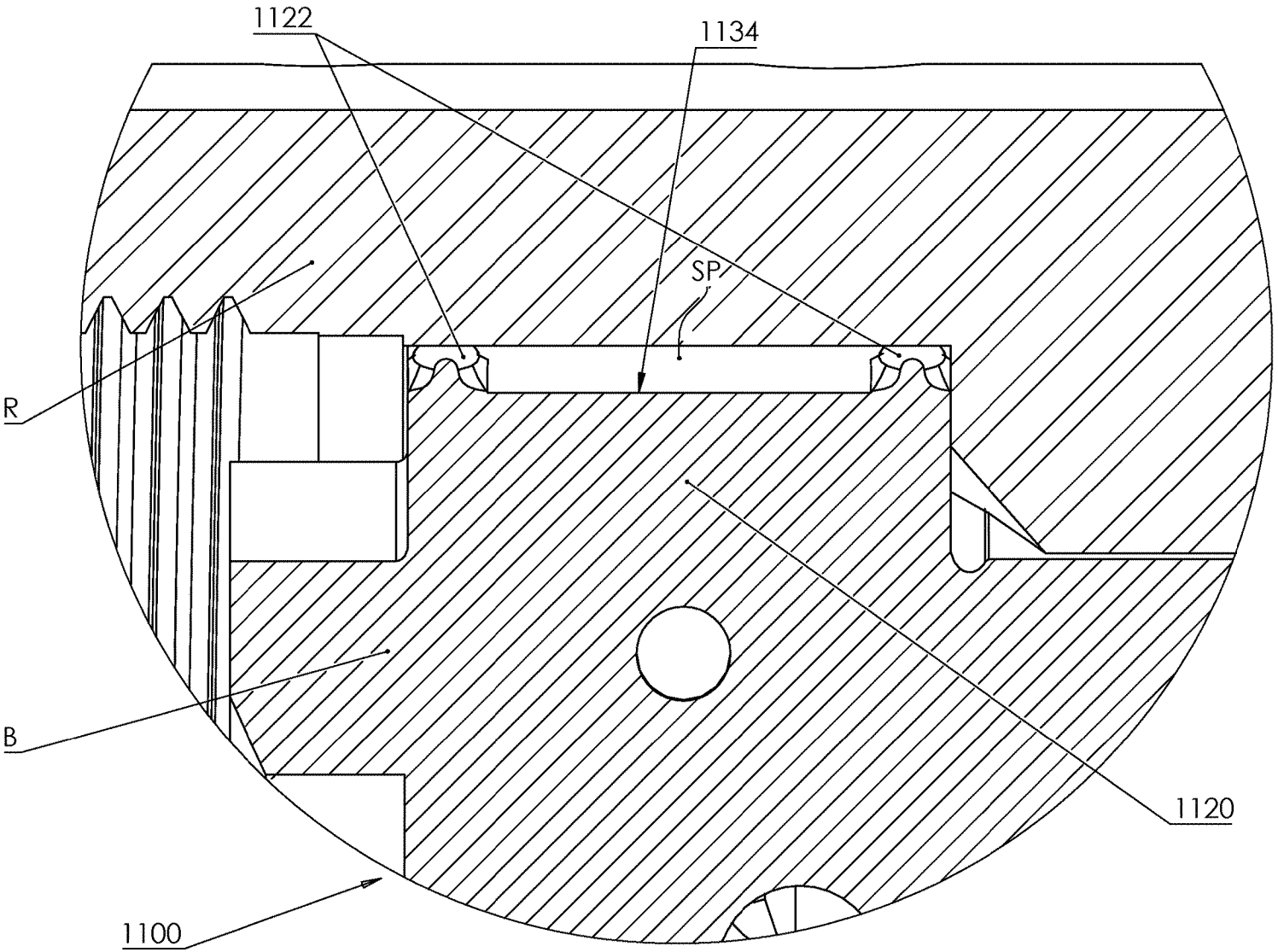
FIG. 74 is an enlargement of the area circled in FIG. 71.

FIG. 34 schematically illustrates that multiple barrel connectors/connection-means, or portions of said connectors/connection-means may be placed along the length of the barrel, for example, spaced along the length of the barrel. Conventional barrel connection means may be used for CM2 and CM3, for example, continuous threads, interrupted threads, bayonet(s), ramp(s) or cam lug(s), threaded or clamping collars/nuts in and/or around receiver and barrel portions, and/or other detachable or permanent connectors/fasteners, and combinations thereof.

Barrel 612" schematically illustrates a multiple-tenon system having three tenons providing outer axial mating surfaces for extremely-tight-tolerance/press-fit mating with cooperating (typically three) axial mating surfaces of a receiver. The receiver that would cooperate and mate with barrel 612" is not shown, but will be understood in view of this disclosure and the drawings. Barrel 612" includes proximal tenon surface 624 intermediate tenon surface 682, and distal tenon surface 692. The intermediate tenon may be described as being of a larger diameter than the proximal tenon, and the distal tenon as being larger in diameter than the intermediate tenon. These three tenon surfaces will be installed in the receiver, for example, by insertion, rotation, clamping, twisting or other installation motions depending on what type of connection means is used. However, the connection means in such an embodiment should not interfere with all the tenons being installed and mated with their respective mating structures in the receiver, as it is preferably or even required in certain embodiments that all three tenons be inserted/installed in the receiver. The system of FIG. 34 may be described as an example of a multiple-tenon system with three axial tenon surfaces, wherein two tenon surfaces 622 and 682 may be described as on each end of a connection means CM2, or two tenon surfaces 682 and 692 may be described as on each end of a connection means CM3.

While being effective for retaining the barrel on the receiver even during firing, conventional barrel connection means are not effective, especially during firing, for maintaining exact or even highly-accurate coaxial alignment of the barrel with the receiver. In threaded connections and other conventional barrel-receiver connection means, there is inherent axial-play (moving out of coaxial-alignment) and the resulting inaccuracy and canting to off-of-coaxial. Therefore, the extremely-tight-tolerance/press-fit mating, of the disclosed one or more set(s) of axial mating surfaces, is needed as a supplement to conventional connection means, to maintain exact or highly accurate coaxial alignment of the barrel with the receiver, especially during firing of the firearm.

Especially Preferred Embodiments of Bolt Lugs, for Enhanced Bolt Rotation, Receiver Mating, and Smooth Bolt Cycling FIGS. 35 through 74 portray embodiments of bolt lugs and their cooperation with receivers that are particularly well adapted for accurate shooting and trouble-free use of firearms in outdoor or other non-controlled/non-clean environments. As understood by those of skill in the field, bolt lugs typically are radially (circumferentially) curved to generally match, and allow rotation of the bolt and its lugs in, the typically cylindrical receiver inner surface at the distal end of the receiver. As discussed above in the Summary, and in the Detailed Description particularly regarding FIGS. 4-7 and 16-18, the adaptation of the bolt lugs outermost surfaces (that is, outermost in the radial direction, farthest out from the longitudinal axis of the bold) preferably also comprises axial curvature, and/or other axial non-linearity, for reducing the surface area of said outermost surfaces that mates with the receiver inner surface in the locked position. Thus, the preferred lugs of this disclosure are curved (non-linear) in the radial direction across the radially-outermost surface of the lug, and also curved or otherwise non-linear in the axial direction along said radially-outermost surface of the lug. For example, this reduction of the mating surface area reduces the surface area of each outermost surface 30 that comes closest to the receiver inner surface 26, whereby the smaller-diameter/recessed region(s) of the outermost surface 30 receive and prevent ice, dirt, or other debris/elements from the field from interfering with proper bolt operation and alignment in the receiver.

The axial non-linearity of the preferred embodiments shown in FIGS. 35-74 may be categorized in the following groups: axially convex (FIGS. 35-42, similar to that shown and discussed in this document regarding FIGS. 4-7 and 16-18); axially concave (FIGS. 43-50); ridges and recesses running transverse to the longitudinal axis of the bolt (FIGS. 51-58); ridges and recesses running substantially transverse to the longitudinal axis of the bolt, that is, closer to transverse than parallel to the longitudinal axis (FIGS. 59-66); and protrusions spaced apart on the outermost surface, for example, protrusions on four corners of the outermost surface (FIGS. 67-74).

In the bolt B and receiver R combination 700 in FIGS. 35-42, the bolt lug 720 maximum diameter region 722 is centrally located along the axial length of the outermost surface 724, that is, half way between the distal end edge 726 and proximal end edge 728. This maximum diameter region 722 extends "circumferentially", all the way side-to-side across the outermost surface from lug right side surface 730 to left side surface 732, as shown by the enlarged cross-sections shown in FIGS. 40, 41, and 42. The distal and proximal end regions 734, 736 are smaller/reduced in diameter than the maximum diameter region 722. The maximum diameter region 722 of each lug will mate (come in contact with or be in tight tolerance with) the bolt lug rotation space of the receiver inner surface (for example, the respective crest of a receiver inner surface having troughs and crests as discussed in this document for many embodiments of the preferred firearm). The reduced diameter distal and proximal regions 734, 736 of each lug 720 will not contact the receiver surface in the lug rotation space, thus leaving space SP between the lug outermost surface 724 at those reduced diameter regions and the receiver inner surface 740, even when the bolt is in the loaded and locked condition (for example, in receivers with the herein-disclosed troughs and crests, even when the maximum diameter region is mated with the crests). Due to the movement of the bolt B relative to the receiver R, both axially and rotationally on the bolt longitudinal axis during use of the firearm, ice, dirt, debris, or other elements from the field that have entered the receiver tend to be pushed or scraped into said space SP, by the bolt lugs and the maximum diameter region of the lug outermost surface. Thus received in said space SP, the elements will be unlikely to interfere with, or jam, bolt operation and alignment even if/when said bolt operation and alignment rely on very tight tolerances and mating of other portions of the lugs with portions of the receiver inner surface.

In the following paragraphs and FIGS. 43-74, not all the same elements as in FIGS. 35-42 are given reference numbers, but, as the structures and figures are similar to FIGS. 35-42, the reader will understand the elements when discussed below and when drawn in the figures.

In the bolt B and receiver R combination 800 in FIGS. 43-50, two maximum diameter regions 822, 823 are located at the distal end edge 826 and proximal end edge 828 of the lug 820 outermost surface 824, separated by a reduced diameter region 834. The two maximum diameter regions 822, 823, and the reduced diameter region 834 each extend "circumferentially", side-to-side across the outermost surface all the way from the from lug right side surface 830 to left side surface 832. The maximum diameter regions 822, 823 may also be called "lobes" that are distal and proximal of the center of the bolt lug. The lobes are the part of the outside lug surface that is in tightest tolerance with the bolt lug rotation space. The center part between the lobes is a smaller diameter radially than the outside of the lobes. The two maximum diameter regions or "lobes" of each lug will mate (be in contact with or in tight tolerance) with the receiver inner surface (for example, the respective crest of a receiver inner surface in the lug rotation space for many embodiments of the preferred firearm). The outer surfaces of lobes are the only part of the bolt lugs that come into contact with the bolt lug rotation space, or are in tight tolerance with the bolt lug rotation space; the reduced diameter central region of each lug, between the lobes, does not come into contact with the receiver inner surface in the bolt lug rotation space. The reduced diameter central region leaves space SP between the lug outermost surface at that reduced diameter region and the receiver inner surface, even when the bolt is in the loaded and locked condition (for example, in receivers with the herein-disclosed troughs and crests, even when the maximum diameter regions are mated with the crests). As discussed above, the movement of the bolt will tend to push or scrape the elements into said space SP, and thus-received in said space, the elements will be unlikely to interfere with, or jam, bolt operation and alignment even if/when said bolt operation and alignment rely on very tight tolerances and mating of other portions of the bolt/lugs with portions of the receiver inner surface.

In the bolt B and receiver combination 900 of FIGS. 51-58, multiple enlarged diameter regions or "ridges" 922, for example which may all be of the same diameter and may all be maximum diameter regions, are spaced along the length of the lug 920 outermost surface 924 from distal end edge 926 to proximal end edge 928, separated by reduced diameter regions of "recesses" or "channels" (herein, for simplicity recesses 934). The ridges, and the recesses each extend "circumferentially", side-to-side across the outermost surface all the way between the lug right and left side surfaces, transversely to the longitudinal axis of the bolt. This way, the ridges 922 of each lug will mate (be in contact with or in tight tolerance) with the receiver inner surface (for example, the respective crest of a receiver inner surface in the lug rotation space for many embodiments of the preferred firearm). The recesses 934 of each lug will not contact the receiver inner surface lug rotation space, and instead provide space SP between the lug outermost surface at the recesses and the receiver inner surface, even when the bolt is in the loaded and locked condition (for example, in receivers with the herein-disclosed troughs and crests, even when the ridges are mated with the crests). As discussed above for FIGS. 35-50, elements from the environment will tend to be pushed or scraped into the spaces SP, for smooth operation of the bolt in the field even if other portions of the bolt and receiver are adapted to mate tightly for accurate bolt alignment and accurate shooting.

In the bolt B and receiver R combination 1000 in FIGS. 59-66, multiple enlarged diameter regions or "ridges" 1022, for example which may all be of the same diameter and may all be maximum diameter regions, are spaced along the length of the outermost surface from the distal end edge 1026 to the proximal end edge 1028, separated by reduced diameter regions of "recesses" or "channels" (hereafter, for simplicity "recesses" 1034). The ridges, and the recesses each extend "generally circumferentially", side-to-side across the lug 1020 outermost surface 1024 from the right side surface to the left side surface, but at an angle relative to those in FIGS. 51-58, for example, at about 10-25 degrees to the ridges in FIGS. 51-58, which translates to about 80-65 degrees from transverse to the longitudinal axis of the bolt. The ridges of each lug will mate (be in contact with or in tight tolerance) with the receiver inner surface (for example, the respective crest of a receiver inner surface in the lug rotation space for many embodiments of the preferred firearm). The recesses of each lug will not contact the receiver inner surface lug rotation space, and instead provide space SP between the lug outermost surface at the recesses and the receiver inner surface, even when the bolt is in the loaded and locked condition (for example, in receivers with the herein-disclosed troughs and crests, even when the ridges are mated with the crests). As discussed above for FIGS. 35-58, elements will tend to be pushed or scraped into the spaces SP, for smooth operation of the bolt in the field even if other portions of the bolt and receiver are adapted to mate tightly for accurate bolt alignment and accurate shooting.

Preferably, as shown in all of FIGS. 51-66, ridges and recesses will extend circumferentially or generally circumferentially across the outermost surface of the lug in orientations that may be described as "transverse" or "substantially transverse" to the longitudinal axis of the bolt. The term "transverse" in this context means at 90 degrees to the longitudinal axis, and the term "substantially transverse" in this context means more transverse than parallel to the longitudinal axis, in other words, in a range from 46 degrees up to and including 90 degrees. Therefore, the ridges and recesses in FIGS. 51-66 may all be called "substantially transverse" as they are all within the range of 46-90 degrees to the longitudinal axis, that is, the ridges and recesses in FIGS. 51-58 are at 90 degrees, and the ridges and recesses in FIGS. 59-62 are in the range of 10-20 degrees, to the longitudinal axis. This "substantially transverse" or "more transverse than parallel" orientation is important in many ridge and recess embodiments, and in many other embodiments (such as the convex and concave embodiments described herein), because, during the rotational motion of the bolt, the enlarged/maximum diameter region(s) will tend to push rain, water, freezing water, snow, ice, dirt, vegetation, and/or other elements entering the firearm in a field environment out of the way of the enlarged/maximum diameter regions, into the spaces provided by the recesses, rather than pushing the debris/elements in the same direction as the rotating lugs, and will thus reduce resistance and interference with the bolt movement and bolt-receiver mating.

In the bolt B and receiver R combination 1100 of FIGS. 67-74, multiple enlarged diameter regions of the lug 1120 are provided in the form of protrusions 1122 that extend radially outward from the lug outermost surface. The protrusions 1122 may all protrude radially out the same distance from the longitudinal axis, in order to be (in the "enlarged/maximum diameter" terminology used for other axial non-linearity embodiments herein) all be of the same diameter and may all be the lug's maximum diameter regions. The protrusions are spaced to be in the four corners of the outermost surface, that is, two at or near the distal end edge 1126 but spaced apart to be at or near the right and left side edges 1131, 1133, and two at or near the proximal end edge 1128 but spaced apart to be at said edges 1131, 1133. The space between the protrusions 1122 is considered reduced diameter region 1134 and will not contact the receiver inner surface. The protrusions of each lug preferably will mate (be in contact with or in tight tolerance) with the receiver inner surface (for example, the respective crest of a receiver inner surface in the lug rotation space for many embodiments of the preferred firearm). The reduced diameter region 1134 of each lug will not contact the receiver inner surface lug rotation space, and instead provide space SP between the lug outermost surface at the reduced diameter regions, and the receiver inner surface, even when the bolt is in the loaded and locked condition (for example, in receivers with the herein-disclosed troughs and crests, even when the ridges are mated with the crests). In the embodiment of FIGS. 67-74, one may describe the reduced diameter region 1134 as covering a substantial amount of the lug outermost surface, wherein said reduced diameter region extends circumferentially all across the outermost surface of the lug between the two distal protrusions and the two proximal protrusions, and axially all along the outermost surface between the right two protrusions and the left two protrusions. As the protrusions are small in size, they will tend not to push any significant amount of said elements in the direction of the rotating bolt, and instead the elements will tend to slide into said reduced diameter region 1134. As discussed above for FIGS. 35-66, therefore, certain embodiments featuring protrusions on the outermost surface of the lug provide space(s) SP for receiving elements, for enhancing smooth operation of the bolt in the field even if other portions of the bolt and receiver are adapted to mate tightly for accurate bolt alignment and accurate shooting.

In certain embodiments, enlarged/maximum diameter regions are purposely provided at or near the distal and proximal end edges of the outermost surface of the lugs. The term "or near" in this context means a distance from a respective end edge equal to or less than ⅕ of the length (between the distal and proximal end edges) of the bolt outermost surface. Examples of such embodiments are the concave embodiment in FIGS. 43-50 with an enlarged diameter region at each end of the outermost surface, the ridges and recesses embodiment of FIGS. 51-58 with a ridge at each end of the outermost surface, the ridges and recesses embodiment of FIGS. 59-66 with a ridge at or near (within a distance of the ends equal to or less than ⅕ of the length between the distal and proximal ends of the outermost surface), and the protrusion embodiment in FIGS. 67-74 with two protrusions at or near (within a distance of the ends equal to or less than ⅕ of the length between the distal and proximal ends of the outermost surface) each of the distal and proximal ends of the outermost surface. This placement of the enlarged/maximum diameter regions, including protrusions, is done to ensure the stability of the bolt during movement in the receiver, by preventing the bolt from canting, that is, preventing the bolt from tilting/falling away from its longitudinal axis being parallel to the longitudinal axis of the receiver.

The bolt lug embodiments shown in FIGS. 35-74 are especially well adapted for use in receivers having a ramped inner surface for excellent mating of the enlarged/maximum diameters of the outermost surface of each lug. This way, the enlarged/maximum diameter portion(s) of each lug outermost surface may mate in extremely tight tolerance with a respective crest of the distal receiver inner surface, while the relatively smaller diameter portion(s) of each lug outermost surface provide a space/pocket(s) for receiving environmental elements to prevent interference of the elements with bolt movement and lug mating. Alternatively, the lug adaptations shown in FIGS. 35-74, and/or other axial non-linearities of the lug outermost surface, may be used in receivers not having a ramped inner surface such as disclosed in this document, for example, when the additional space/pocket (s), provided by the relatively smaller diameter portions(s) of each lug outermost surface being distanced from a non-ramped, cylindrical receiver inner surface at the received distal end, are desired for field operability and reliability.

It has been noted that some prior art receiver and bolt combinations provide a conical or other non-transverse proximal surface on the bolt lug for cooperating with a conical/non-transverse surface on the lug stops. For example, see the conical proximal surface in Irwin U.S. Pat. No. 8,302,340, or the "spherical shaped, conical shaped, parabolic, and/or toroidal shaped" proximal lug surface in Karagias U.S. Pat. No. 10,082,356. On the other hand, the lugs of FIGS. 35-74 have outermost surfaces that have one or more portions adapted to mate with a receiver axial inner surface, rather than with a conical, spherical, parabolic or toroidal receiver or lug stop surface. The lug outermost surfaces of FIGS. 35-74 that are adapted to have enlarged/maximum diameter regions, and relatively smaller diameter regions, on what may be described as the radially-outermost portion of the lugs located: 1) between the radially-outermost distal end edge and proximal end edge of the lug, 2) between the distal-most extremity and a proximal-most extremity of the lug, and 3) distal relative to any surface of the lug that contacts a lug stop. Preferably in many embodiments, the distal surface and the proximal surface of the lug are each perpendicular to the longitudinal axis of the bolt, and the convexity, concavity, ridges and recesses, and protrusions that form the enlarged/maximum diameter regions and the relatively smaller diameter regions are located between said perpendicular distal and proximal surfaces of the lug. Preferably, said smaller diameter regions are not conical, spherical shaped, parabolic, and/or toroidal shaped and are not provided on surfaces that are for contacting/cooperating with lug stops, but are instead entirely distal/forward of the lug stops, including entirely distal/forward of the distalmost surfaces and edges of the lug stops. It should be noted that said smaller diameter regions are purposely made significantly smaller than said enlarged/maximum diameter regions, for example, with the smaller diameter region(s) each being on the order of 0.1-5 millimeters smaller than the enlarged/maximum diameter(s) of the lug, wherein it will be understood that these diameters are measured from the longitudinal axis of the bolt at the lug end of the bolt.

Although the invention has been described above with reference to particular means, materials, and embodiments, it is to be understood that the invention is not limited to these disclosed particulars but extends instead to all possible combinations of such particulars and to all equivalents within the broad scope of this disclosure and within the scope of the following claims.

The invention claimed is:

1. A bolt and receiver combination for a firearm, wherein the bolt has a bolt longitudinal axis between a bolt distal end having lugs and a bolt proximal end, the bolt being adapted to slide distally in the receiver in a direction parallel to a longitudinal axis of the receiver to move the lugs past lug stops and into a lug rotation space in a distal end of the receiver, and to rotate on the bolt longitudinal axis into a locked position wherein each lug is distal of a respective one of the lug stops and has a proximal lug end surface positioned to abut against the respective lug stop upon firing of the firearm;

wherein each lug has a radially outermost surface comprising at least one maximum lug diameter region, and at least one reduced lug diameter region that is smaller than the at least one maximum lug diameter region, wherein said radially outermost surface, the at least one maximum lug diameter region, and the at least one reduced lug diameter region are all distal of the proximal lug end surface;

wherein said at least one maximum lug diameter region mates with an receiver inner surface in the lug rotation space and distal of the lug stops, and said at least one reduced diameter region is distal of the lug stops and is distanced from the receiver inner surface to create a space between the at least one reduced diameter region and said receiver inner surface for receiving elements entering the receiver from the environment to reduce or eliminate interference by the elements with bolt operation.

2. The combination of claim 1, wherein the lug has a distal end surface opposite the proximal end surface, said radially outermost surface of the lug has a proximal end edge connecting to the proximal end surface, and a distal end edge connecting to the distal end surface, and wherein said at least one maximum diameter region is a single maximum diameter region midway between the radially outermost surface proximal and distal end edges.

3. The combination of claim 2, wherein the proximal and distal lug end surfaces each are perpendicular to the longitudinal axis.

4. The combination of claim 2, wherein the proximal end surface is not conical.

5. The combination of claim 1, wherein said outermost surface does not contact any of the lug stops.

6. The combination of claim 1, wherein the respective lug stop has a distalmost portion and said outermost surface is entirely distal of said distalmost portion.

7. The combination of claim 1, wherein the receiver has a receiver axial surface distal of the lugs, and, when the bolt is rotated to the locked position, the at least one maximum diameter region mates with a portion of a receiver axial surface and the at least one reduced lug diameter region is distanced from said receiver axial surface to provide a space between the at least one reduced lug diameter and the receiver axial surface for receiving elements that ever the receiver from an environment around the firearm to minimize interference of the elements with bolt sliding and rotation in the receiver.

8. A bolt for being received in and cooperating with a receiver of a bolt-action firearm, the bolt having a longitudinal axis between a distal end and a proximal end, and lugs protruding radially from the distal end of the bolt, each lug having a proximal end surface that is perpendicular to the longitudinal axis for abutting against a lug stop in the receiver, a distal end surface, and a radially outermost surface that is between said proximal end surface and said distal end surface, the radially outermost surface of each lug being circumferentially curved to allow the bolt to rotate in a cylindrical lug rotation space of the receiver, and the radially out most surface of each lug also having axial curvature between a distal end edge that connects to the distal end surface and a proximal end edge so the outermost surface comprises at least one enlarged diameter region for mating with a receiver axial surface in the lug rotation space and at least one reduced diameter region for providing space between the outermost surface and the receiver axial surface for receiving environmental elements such as ice and dirt that enter the receiver.

* * * * *